US010825467B2

(12) United States Patent
Chebiyyam et al.

(10) Patent No.: US 10,825,467 B2
(45) Date of Patent: Nov. 3, 2020

(54) NON-HARMONIC SPEECH DETECTION AND BANDWIDTH EXTENSION IN A MULTI-SOURCE ENVIRONMENT

(71) Applicant: QUALCOMM Incorporated, San Diego, CA (US)

(72) Inventors: Venkata Subrahmanyam Chandra Sekhar Chebiyyam, Santa Clara, CA (US); Venkatraman Atti, San Diego, CA (US)

(73) Assignee: Qualcomm Incorporated, San Diego, CA (US)

( * ) Notice: Subject to any disclaimer, the term of this patent is extended or adjusted under 35 U.S.C. 154(b) by 221 days.

(21) Appl. No.: 15/956,645

(22) Filed: Apr. 18, 2018

(65) Prior Publication Data

US 2018/0308505 A1 Oct. 25, 2018

Related U.S. Application Data

(60) Provisional application No. 62/488,654, filed on Apr. 21, 2017.

(51) Int. Cl.
*G10L 21/0388* (2013.01)
*G10L 19/008* (2013.01)
(Continued)

(52) U.S. Cl.
CPC ..... *G10L 21/0388* (2013.01); *G10L 19/008* (2013.01); *G10L 19/0204* (2013.01); *G10L 21/038* (2013.01)

(58) Field of Classification Search
None
See application file for complete search history.

(56) References Cited

U.S. PATENT DOCUMENTS 7,346,110 B2 * 3/2008 Minde ..... G10L 19/12 375/240.24
8,386,268 B2 * 2/2013 Nagel ..... G10L 21/038 704/500

(Continued)

FOREIGN PATENT DOCUMENTS

WO 2017139714 8/2017

OTHER PUBLICATIONS

3GPP TS 26.290: "3rd Generation Partnership Project; Technical Specification Group Services and System Aspects; Audio Codec Processing Functions; Extended Adaptive Multi-Rate-Wideband (AMR-WB+) Codec; Transcoding Functions", Version 13.0.0, Release 13, Mobile Competence Centre; 650, Route Des Lucioles; F-06921 Sophia-Antipolis Cedex; France, vol. SA WG4, No. V13.0.0, Dec. 13, 2015 (Dec. 13, 2015), pp. 1-85, XP051046634 [retrieved on Dec. 13, 2015].

(Continued)

*Primary Examiner* — Thuykhanh Le
(74) *Attorney, Agent, or Firm* — Qualcomm Incorporated

(57) ABSTRACT

A device includes a multi-channel encoder configured to receive a first audio signal and a second audio signal, to perform a downmix operation on the first audio signal and the second audio signal to generate a mid signal, to generate a low-band mid signal and a high-band mid signal based on the mid signal, and to determine, based at least partially on a low band voicing value corresponding to the low band signal and a gain value corresponding to the high-band mid signal, a value of a multi-source flag that flag associated with the high-band mid signal. The multi-channel encoder is configured to generate a high-band mid excitation signal based on the multi-source flag and to generate a bitstream based on the high-band mid excitation signal. The device (Continued)

also includes a transmitter configured to transmit the bitstream and the multi-source flag to a second device.

27 Claims, 17 Drawing Sheets

(51) Int. Cl.
*G10L 21/038* (2013.01)
*G10L 19/02* (2013.01)

(56) References Cited

U.S. PATENT DOCUMENTS 9,037,474 B2* 5/2015 Gao ..... G10L 19/022 704/500
2002/0007280 A1* 1/2002 McCree ..... G10L 19/0208 704/500
2002/0087304 A1* 7/2002 Kjorling ..... G10L 21/038 704/219
2005/0004803 A1* 1/2005 Smeets ..... G10L 21/038 704/500
2006/0149538 A1* 7/2006 Lee ..... G10L 19/0204 704/219
2006/0277038 A1* 12/2006 Vos ..... G10L 19/038 704/219
2006/0277039 A1* 12/2006 Vos ..... G10L 19/0208 704/219
2008/0027711 A1* 1/2008 Rajendran ..... G10L 19/167 704/201
2008/0046233 A1* 2/2008 Chen ..... G10L 19/005 704/211
2008/0126082 A1* 5/2008 Ehara ..... G10L 19/24 704/205
2009/0141790 A1* 6/2009 Kawashima ..... G10L 19/005 375/240
2009/0157413 A1* 6/2009 Oshikiri ..... G10L 21/038 704/501
2010/0017198 A1* 1/2010 Yamanashi ..... G10L 21/038 704/205
2010/0063827 A1* 3/2010 Gao ..... G10L 21/038 704/500
2010/0094638 A1* 4/2010 Lee ..... G10L 21/038 704/500
2011/0099018 A1* 4/2011 Neuendorf ..... G10L 21/038 704/500
2011/0200198 A1* 8/2011 Grill ..... G10L 19/173 381/23
2011/0202354 A1* 8/2011 Grill ..... G10L 19/18 704/500
2011/0202358 A1* 8/2011 Neuendorf ..... G10L 19/0208 704/503
2011/0238427 A1* 9/2011 Chen ..... G10L 19/22 704/500
2012/0029925 A1* 2/2012 Duni ..... G10L 25/90 704/500
2012/0046943 A1* 2/2012 Lee ..... G10L 21/038 704/205
2012/0065983 A1* 3/2012 Ekstrand ..... G10L 21/038 704/500
2013/0090933 A1* 4/2013 Villemoes ..... G10L 19/0204 704/500
2013/0156112 A1* 6/2013 Suzuki ..... G10L 21/038 375/240.25
2013/0236022 A1* 9/2013 Virette ..... G10L 19/008 381/22
2013/0346088 A1* 12/2013 Miao ..... G10L 19/00 704/500
2014/0088973 A1* 3/2014 Gibbs ..... G10L 19/20 704/500
2014/0200901 A1* 7/2014 Kawashima ..... G10L 19/265 704/500
2015/0106084 A1* 4/2015 Atti ..... G10L 21/0216 704/226
2015/0106102 A1* 4/2015 Chebiyyam ..... G10L 19/02 704/262
2015/0149156 A1* 5/2015 Atti ..... G10L 19/265 704/205
2015/0162010 A1* 6/2015 Ishikawa ..... G10L 19/00 704/500
2015/0170662 A1* 6/2015 Krishnan ..... G10L 19/08 704/205
2015/0228288 A1* 8/2015 Subasingha ..... G10L 21/038 704/500
2015/0235653 A1* 8/2015 Liu ..... G10L 21/038 704/500
2015/0279384 A1* 10/2015 Atti ..... G10L 19/08 704/223
2015/0294673 A1* 10/2015 Kawashima ..... G10L 19/02 704/206
2015/0332707 A1* 11/2015 Disch ..... G10L 21/0388 704/205
2015/0380007 A1* 12/2015 Atti ..... G10L 25/12 704/219
2015/0380008 A1* 12/2015 Atti ..... G10L 19/265 704/500
2016/0118056 A1* 4/2016 Choo ..... G10L 25/18 381/100
2016/0133273 A1* 5/2016 Kaniewska ..... G10L 21/0388 704/205
2016/0203826 A1* 7/2016 Kaniewska ..... G10L 25/72 704/500

OTHER PUBLICATIONS

International Search Report and Written Opinion—PCT/US2018/028338—ISA/EPO—dated Jul. 20, 2018.

* cited by examiner

NON-HARMONIC SPEECH DETECTION AND BANDWIDTH EXTENSION IN A MULTI-SOURCE ENVIRONMENT

I. CROSS REFERENCE TO RELATED APPLICATIONS

The present application claims priority from U.S. Provisional Patent Application No. 62/488,654 entitled "INTER-CHANNEL BANDWIDTH EXTENSION IN A MULTI-SOURCE ENVIRONMENT," filed Apr. 21, 2017, which is incorporated herein by reference in its entirety.

II. FIELD

The present disclosure is generally related to encoding of an audio signal or decoding of an audio signal.

III. DESCRIPTION OF RELATED ART

Advances in technology have resulted in smaller and more powerful computing devices. For example, there currently exist a variety of portable personal computing devices, including wireless telephones such as mobile and smart phones, tablets and laptop computers that are small, lightweight, and easily carried by users. These devices can communicate voice and data packets over wireless networks. Further, many such devices incorporate additional functionality such as a digital still camera, a digital video camera, a digital recorder, and an audio file player. Also, such devices can process executable instructions, including software applications, such as a web browser application, that can be used to access the Internet. As such, these devices can include significant computing capabilities.

A first device may include or be coupled to one or more microphones to receive an audio signal. The first device encodes the received audio signal and sends the encoded audio signal to a second device. The second device may include one or more output devices (e.g., one or more speakers) to produce an output. For example, the second device decodes the encoded audio signal to generate an output signal that is provided to the one or more output devices.

In mono-encoding or stereo-encoding, an encoder may generate a low-band signal and a high-band signal based on a received audio signal. In either mono-encoding or stereo-encoding, the received audio signal may a combination of multiple sound sources, such as two people talking concurrently. For example, a first sound source may provide a voiced segment (such as the sound of the letter "r") and a second sound source may provide an unvoiced segment (such as the sound "ssss"). In such a scenario, an energy of the voiced segment may be concentrated in the low-band while an energy of the unvoiced segment is concentrated in the high-band. Accordingly, the low-band is highly voiced because the majority (or all) of the energy of the low-band is coming from voiced segment of the first sound source and the high-band is highly noisy because the majority (or all) of the energy of the high-band is coming from the unvoiced segment of the second sound source.

Low-band voicing parameters may be generated based on a low-band signal. The low-band voicing parameters may then be used to generate mixing factors (e.g., gain values that indicate how much of the low-band is noisy, how much of the low-band is harmonics, etc.) that are used to generate a high-band excitation. The harmonic nature of the low-band is extrapolated into the high-band by extending a low-band excitation into the high-band. If the low-band voicing parameters indicate that the low-band is harmonic, the high-band extension will also be harmonic. Alternatively, if the low-band voicing parameters indicate that the low-band is noisy, the high-band extension will also be noisy. In a situation where the low-band and high-band have different harmonicity characteristics, the low band voicing factors may not be reflective of (or indicate) the harmonicity of the high band. Accordingly, in this situation, using the low-band voicing parameters to control generation of the high-band excitation is not reflective of the high-band.

In mono-decoding or stereo-decoding, a decoder receives an encoded low-band signal and an encoded high-band signal. To generate an output signal (reflective of an audio signal received by the encoder), the decoder generates a high-band excitation in a manner similar to the encoder. Similar to the problems described above with the encoder, if low-band voicing parameters used at the decoder are not reflective of the high-band (such as when low-band voicing factors indicate that the low-band is highly voiced and the high-band is highly noisy), a high-band excitation generated at the decoder may not match the high-band at the encoder and a playout quality of an output of the decoder may be degraded.

IV. SUMMARY

In a particular implementation, a device includes an encoder configured to receive an audio signal, to generate a high band signal based on the received audio signal, and to determine a value of a flag indicating a harmonic metric of the high band signal. The device further includes a transmitter configured to transmit an encoded version of the high band signal and the flag to a second device.

In another particular implementation, a method includes receiving an audio signal at an encoder and generating a high band signal based on the received audio signal. The method also includes determining a value of a flag indicating a harmonic metric of the high band signal and transmitting an encoded version of the high band signal and the flag from the encoder to a device.

In another particular implementation, a non-transitory computer-readable medium includes instructions that, when executed by an encoder of a first device, cause the encoder to perform operations including receiving an audio signal at the encoder and generating a high band signal based on the received audio signal. The operations also include determining a value of a flag indicating a harmonic metric of the high band signal and transmitting an encoded version of the high band signal and the flag from the encoder to a device.

In another particular implementation, an apparatus includes means for receiving an audio signal and means for generating a high band signal based on the received audio signal. The apparatus also includes means for determining a value of a flag indicating a harmonic metric of the high band signal and means for transmitting an encoded version of the high band signal and the flag to a device.

In another particular implementation, a device includes an encoder configured to determine a gain frame parameter corresponding to a frame of a high-band signal, to compare the gain frame parameter to a threshold, and, in response to the gain frame parameter being greater than the threshold, modify a flag that corresponds to the frame and that indicates a harmonic metric of the high band signal. The device further includes a transmitter configured to transmit the modified flag.

In another particular implementation, a method includes determining a gain frame parameter corresponding to a frame of a high-band signal and comparing the gain frame parameter to a threshold. The method also includes, in response to the gain frame parameter being greater than the threshold, modifying a flag that corresponds to the frame and that indicates a harmonic metric of the high band signal. The method further includes transmitting the modified flag.

In another particular implementation, a non-transitory computer-readable medium includes instructions that, when executed by an encoder of a first device, cause the encoder to perform operations including determining a gain frame parameter corresponding to a frame of a high-band signal and comparing the gain frame parameter to a threshold. The operations also include, in response to the gain frame parameter being greater than the threshold, modifying a flag that corresponds to the frame and that indicates a harmonic metric of the high band signal. The operations further include transmitting the modified flag.

In another particular implementation, an apparatus includes means for determining a gain frame parameter corresponding to a frame of a high-band signal and means for comparing the gain frame parameter to a threshold. The apparatus further includes means for modifying a flag in response to the gain frame parameter being greater than the threshold. The flag corresponds to the frame and indicates a harmonic metric of the high band signal. The apparatus also includes means for transmitting the modified flag.

In another particular implementation, a device includes a multi-channel encoder configured to receive at least a first audio signal and a second audio signal. The multi-channel encoder is configured to perform a downmix operation on the first audio signal and the second audio signal to generate a mid signal. The multi-channel encoder is configured to generate a low-band mid signal and a high-band mid signal based on the mid signal. The low-band mid signal corresponds to a low frequency portion of the mid signal, and the high-band mid signal corresponds to a high frequency portion of the mid signal. The multi-channel encoder is configured to determine, based at least partially on a voicing value corresponding to the low-band mid signal and a gain value corresponding to the high-band mid signal, a value of a multi-source flag associated with the high-band mid signal. The multi-channel encoder is configured to generate a high-band mid excitation signal based at least in part on the multi-source flag. The encoder is further configured to generate a bitstream based at least in part on the high-band mid excitation signal. The device further includes a transmitter configured to transmit the bitstream and the multi-source flag to a second device.

In another particular implementation, a method includes receiving at least a first audio signal and a second audio signal at a multi-channel encoder. The method includes performing a downmix operation on the first audio signal and the second audio signal to generate a mid signal. The method includes generating a low-band mid signal and a high-band mid signal based on the mid signal. The low-band mid signal corresponds to a low frequency portion of the mid signal, and the high-band mid signal corresponds to a high frequency portion of the mid signal. The method includes determining, based at least partially on a voicing value corresponding to the low-band mid signal and a gain value corresponding to the high-band mid signal, a value of a multi-source flag associated with the high-band mid signal. The method includes generating a high-band mid excitation signal based at least in part on the multi-source flag. The method includes generating a bitstream based at least in part on the high-band mid excitation signal. The method further includes transmitting the bitstream and the multi-source flag from the multi-channel encoder to a device.

In another particular implementation, a non-transitory computer-readable medium includes instructions that, when executed by a multi-channel encoder of a first device, cause the multi-channel encoder to perform operations including receiving at least a first audio signal and a second audio signal at the multi-channel encoder. The operations include performing a downmix operation on the first audio signal and the second audio signal to generate a mid signal. The operations include generating a low-band mid signal and a high-band mid signal based on the mid signal. The low-band mid signal corresponds to a low frequency portion of the mid signal and the high-band mid signal corresponds to a high frequency portion of the mid signal. The operations include determining, based at least partially on a voicing value corresponding to the low-band mid signal and a gain value corresponding to the high-band mid signal, a value of a multi-source flag associated with the high-band mid signal. The operations include generating a high-band mid excitation signal based at least in part on the multi-source flag. The operations include generating a bitstream based at least in part on the high-band mid excitation signal. The operations further include transmitting the bitstream and the multi-source flag from the multi-channel encoder to a device.

In another particular implementation, an apparatus includes means for receiving at least a first audio signal and a second audio signal, means for performing a downmix operation on the first audio signal and the second audio signal to generate a mid signal, and means for generating a low-band mid signal and a high-band mid signal based on the mid signal. The low-band mid signal corresponds to a low frequency portion of the mid signal and the high-band mid signal corresponds to a high frequency portion of the mid signal. The apparatus includes means for determining, based at least partially on a voicing value corresponding to the low band signal and a gain value corresponding to the high-band mid signal, a value of a multi-source flag associated with the high-band mid signal. The apparatus includes means for generating a high-band mid excitation signal based at least in part on the multi-source flag. The apparatus includes means for generating a bitstream based at least in part on the high-band mid excitation signal. The apparatus also includes means for transmitting the bitstream and the multi-source flag to a device.

In another particular implementation, a device includes a receiver configured to receive a bitstream corresponding to an encoded version of an audio signal. The device further includes a decoder configured to generate a high band excitation signal based on a low band excitation signal and further based on a flag value indicating a harmonic metric of a high band signal. The high band signal corresponds to a high band portion of the audio signal.

In another particular implementation, a method includes receiving a bitstream corresponding to an encoded version of an audio signal. The method further includes generating a high band excitation signal based on a low band excitation signal and further based on a first flag value indicating a harmonic metric of a high band signal. The high band signal corresponds to a high band portion of the audio signal.

In another particular implementation, a non-transitory computer-readable medium includes instructions that, when executed by a decoder of a device, cause the decoder to perform operations including receiving a bitstream corresponding to an encoded version of an audio signal. The operations also include generating a high band excitation signal based on a low band excitation signal and further based on a first flag value indicating a harmonic metric of a high band signal. The high band signal corresponds to a high band portion of the audio signal.

In another particular implementation, an apparatus includes means for receiving a bitstream corresponding to an encoded version of an audio signal. The apparatus further includes means for generating a high band excitation signal based on a low band excitation signal and further based on a first flag value indicating a harmonic metric of a high band signal. The high band signal corresponds to a high band portion of the audio signal.

Other implementations, advantages, and features of the present disclosure will become apparent after review of the entire application, including the following sections: Brief Description of the Drawings, Detailed Description, and the Claims.

V. BRIEF DESCRIPTION OF THE DRAWINGS

VI. DETAILED DESCRIPTION

Figure 1:
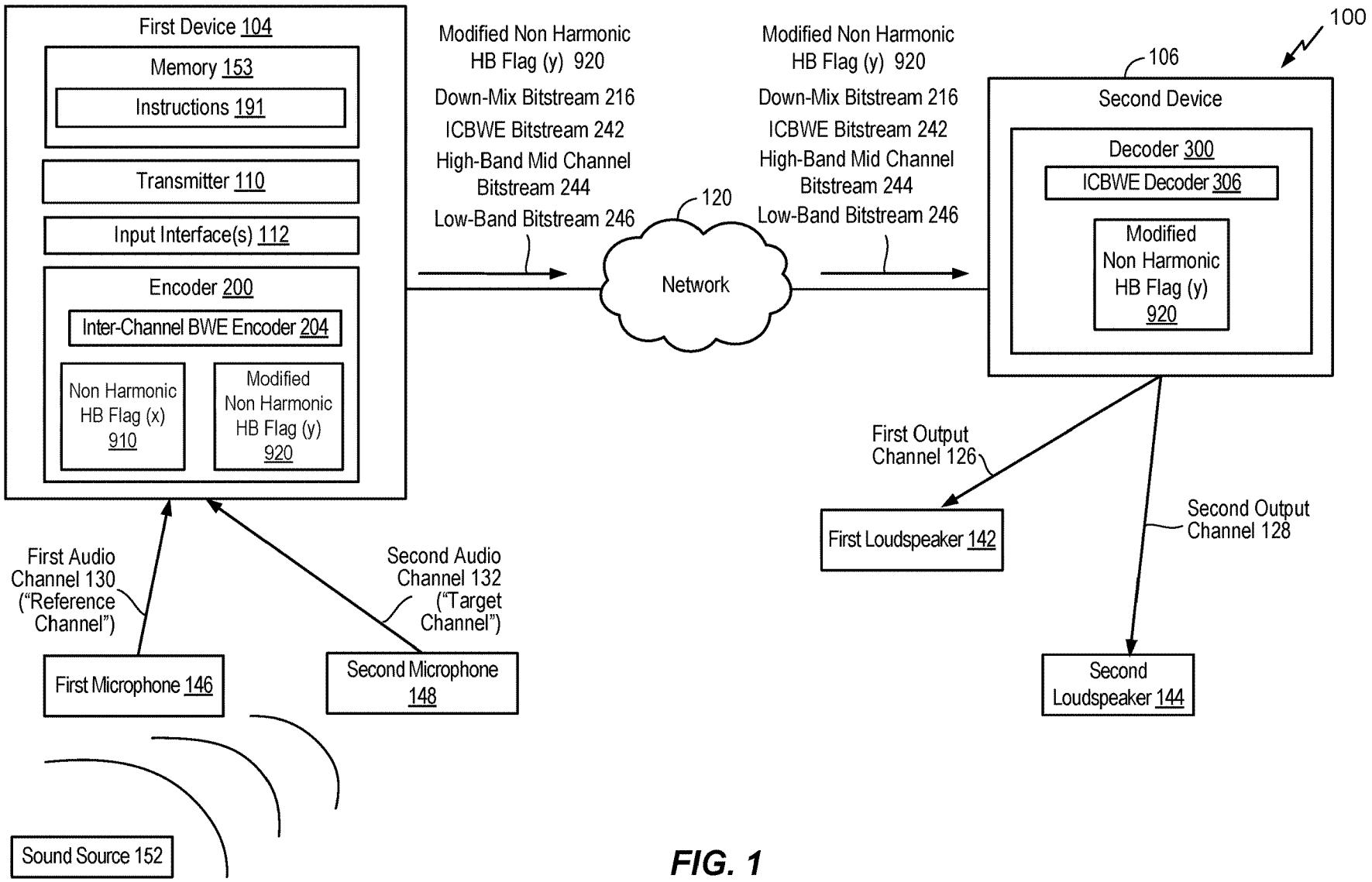
FIG. 1 is a block diagram of a particular illustrative example of a system that includes an encoder operable to determine a first flag value that indicates a harmonic metric of a high band signal and a decoder operable to use a second flag value that indicates a harmonic metric of the high band signal.

Particular aspects of the present disclosure are described below with reference to the drawings. In the description, common features are designated by common reference numbers. As used herein, various terminology is used for the purpose of describing particular implementations only and is not intended to be limiting of implementations. For example, the singular forms "a," "an," and "the" are intended to include the plural forms as well, unless the context clearly indicates otherwise. It may be further understood that the terms "comprise," "comprises," and "comprising" may be used interchangeably with "include," "includes," or "including." Additionally, it will be understood that the term "wherein" may be used interchangeably with "where." As used herein, "exemplary" may indicate an example, an implementation, and/or an aspect, and should not be construed as limiting or as indicating a preference or a preferred implementation. As used herein, an ordinal term (e.g., "first, " "second," "third," etc.) used to modify an element, such as a structure, a component, an operation, etc., does not by itself indicate any priority or order of the element with respect to another element, but rather merely distinguishes the element from another element having a same name (but for use of the ordinal term). As used herein, the term "set" refers to one or more of a particular element, and the term "plurality" refers to multiple (e.g., two or more) of a particular element.

In the present disclosure, terms such as "determining", "calculating", "estimating", "shifting", "adjusting", etc. may be used to describe how one or more operations are performed. It should be noted that such terms are not to be construed as limiting and other techniques may be utilized to perform similar operations. Additionally, as referred to herein, "generating", "calculating", "estimating", "using", "selecting", "accessing", and "determining" may be used interchangeably. For example, "generating", "calculating", "estimating", or "determining" a parameter (or a signal) may refer to actively generating, estimating, calculating, or determining the parameter (or the signal) or may refer to using, selecting, or accessing the parameter (or signal) that is already generated, such as by another component or device.

Systems and devices operable to encode multiple audio signals are disclosed. As described further herein, the present disclosure is related to coding (e.g., encoding or decoding) signals in a high-band while a low-band may be either harmonic or non-harmonic. For example, systems, devices, and methods may be configured to detect a harmonicity of a high-band signal and to set a value of a flag that indicates a harmonic metric (e.g., the harmonicity, such as a relative degree of harmonicity) of a high band signal. The systems, devices, and methods may further be configured to use the flag to generate high band signals and to modify the flag (e.g., modify the value of the flag). For example, the flag (or the modified flag) may be used to determine one or more mixing parameters, noise envelope parameters, gain shape parameters, gain frame parameters, or a combination thereof. The systems, devices, and methods described herein are applicable to mono-coding (e.g., mono-encoding or mono-decoding) and to stereo/multi-channel coding (e.g., stereo/multi-channel encoding, stereo/multi-channel decoding, or both).

A device may include an encoder configured to encode the multiple audio signals. The multiple audio signals may be captured concurrently in time using multiple recording devices, e.g., multiple microphones. In some examples, the multiple audio signals (or multi-channel audio) may be synthetically (e.g., artificially) generated by multiplexing several audio channels that are recorded at the same time or at different times. As illustrative examples, the concurrent recording or multiplexing of the audio channels may result in a 2-channel configuration (i.e., Stereo: Left and Right), a 5.1 channel configuration (Left, Right, Center, Left Surround, Right Surround, and the low frequency emphasis (LFE) channels), a 7.1 channel configuration, a 7.1+4 channel configuration, a 22.2 channel configuration, or a N-channel configuration.

Audio capture devices in teleconference rooms (or telepresence rooms) may include multiple microphones that acquire spatial audio. The spatial audio may include speech as well as background audio that is encoded and transmitted. The speech/audio from a given source (e.g., a talker) may arrive at the multiple microphones at different times depending on how the microphones are arranged as well as where the source (e.g., the talker) is located with respect to the microphones and room dimensions. For example, a sound source (e.g., a talker) may be closer to a first microphone associated with the device than to a second microphone associated with the device. Thus, a sound emitted from the sound source may reach the first microphone earlier in time than the second microphone. The device may receive a first audio signal via the first microphone and may receive a second audio signal via the second microphone.

Mid-side (MS) coding and parametric stereo (PS) coding are stereo coding techniques that may provide improved efficiency over the dual-mono coding techniques. In dual-mono coding, the Left (L) channel (or signal) and the Right (R) channel (or signal) are independently coded without making use of inter-channel correlation. MS coding reduces the redundancy between a correlated L/R channel-pair by transforming the Left channel and the Right channel to a sum-channel and a difference-channel (e.g., a side channel) prior to coding. The sum signal and the difference signal are waveform coded or coded based on a model in MS coding. Relatively more bits are spent on the sum signal than on the side signal. PS coding reduces redundancy in each sub-band by transforming the L/R signals into a sum signal and a set of side parameters. The side parameters may indicate an inter-channel intensity difference (IID), an inter-channel phase difference (IPD), an inter-channel time difference (ITD), side or residual prediction gains, etc. The sum signal is waveform coded and transmitted along with the side parameters. In a hybrid system, the side-channel may be waveform coded in the lower bands (e.g., less than 2 kilohertz (kHz)) and PS coded in the upper bands (e.g., greater than or equal to 2 kHz) where the inter-channel phase preservation is perceptually less critical. In some implementations, the PS coding may be used in the lower bands also to reduce the inter-channel redundancy before waveform coding.

The MS coding and the PS coding may be done in either the frequency-domain or in the sub-band domain. In some examples, the Left channel and the Right channel may be uncorrelated. For example, the Left channel and the Right channel may include uncorrelated synthetic signals. When the Left channel and the Right channel are uncorrelated, the coding efficiency of the MS coding, the PS coding, or both, may approach the coding efficiency of the dual-mono coding.

Depending on a recording configuration, there may be a temporal shift between a Left channel and a Right channel, as well as other spatial effects such as echo and room reverberation. If the temporal shift and phase mismatch between the channels are not compensated, the sum channel and the difference channel may contain comparable energies reducing the coding-gains associated with MS or PS techniques. The reduction in the coding-gains may be based on the amount of temporal (or phase) shift. The comparable energies of the sum signal and the difference signal may limit the usage of MS coding in certain frames where the channels are temporally shifted but are highly correlated. In stereo coding, a Mid channel (e.g., a sum channel) and a Side channel (e.g., a difference channel) may be generated based on the following Formula:

$$M=(L+R)/2,\ S=(L-R)/2, \qquad \text{Formula 1}$$

where M corresponds to the Mid channel, S corresponds to the Side channel, L corresponds to the Left channel, and R corresponds to the Right channel.

In some cases, the Mid channel and the Side channel may be generated based on the following Formula:

$$M=c(L+R),\ S=c(L-R), \qquad \text{Formula 2}$$

where c corresponds to a complex value which is frequency dependent.

Generating the Mid channel and the Side channel based on Formula 1 or Formula 2 may be referred to as "downmixing". A reverse process of generating the Left channel and the Right channel from the Mid channel and the Side channel based on Formula 1 or Formula 2 may be referred to as "upmixing".

In some cases, the Mid channel may be based other formulas such as:

$$M=(L+g_D R)/2, \text{ or} \qquad \text{Formula 3}$$

$$M=g_1 L+g_2 R \qquad \text{Formula4}$$

where $g_1+g_2=1.0$, and where $g_D$ is a gain parameter. In other examples, the downmix may be performed in bands, where $mid(b)=c_1L(b)+c_2R(b)$, where $c_1$ and $c_2$ are complex numbers, where $side(b)=c_3L(b)-c_4R(b)$, and where $c_3$ and $c_4$ are complex numbers.

An ad-hoc approach used to choose between MS coding or dual-mono coding for a particular frame may include generating a mid signal and a side signal, calculating energies of the mid signal and the side signal, and determining whether to perform MS coding based on the energies. For example, MS coding may be performed in response to determining that the ratio of energies of the side signal and the mid signal is less than a threshold. To illustrate, if a Right channel is shifted by at least a first time (e.g., about 0.001 seconds or 48 samples at 48 kHz), a first energy of the mid signal (corresponding to a sum of the left signal and the right signal) may be comparable to a second energy of the side signal (corresponding to a difference between the left signal and the right signal) for voiced speech frames. When the first energy is comparable to the second energy, a higher number of bits may be used to encode the Side channel, thereby reducing coding efficiency of MS coding relative to dual-mono coding. Dual-mono coding may thus be used when the first energy is comparable to the second energy (e.g., when the ratio of the first energy and the second energy is greater than or equal to the threshold). In an alternative approach, the decision between MS coding and dual-mono coding for a particular frame may be made based on a comparison of a threshold and normalized cross-correlation values of the Left channel and the Right channel.

In some examples, the encoder may determine a mismatch value indicative of an amount of temporal misalignment between the first audio signal and the second audio signal. As used herein, a "temporal shift value", a "shift value", and a "mismatch value" may be used interchangeably. For example, the encoder may determine a temporal shift value indicative of a shift (e.g., the temporal mismatch) of the first audio signal relative to the second audio signal. The temporal mismatch value may correspond to an amount of temporal delay between receipt of the first audio signal at the first microphone and receipt of the second audio signal at the second microphone. Furthermore, the encoder may determine the temporal mismatch value on a frame-by-frame basis, e.g., based on each 20 milliseconds (ms) speech/audio frame. For example, the temporal mismatch value may correspond to an amount of time that a second frame of the second audio signal is delayed with respect to a first frame of the first audio signal. Alternatively, the temporal mismatch value may correspond to an amount of time that the first frame of the first audio signal is delayed with respect to the second frame of the second audio signal.

When the sound source is closer to the first microphone than to the second microphone, frames of the second audio signal may be delayed relative to frames of the first audio signal. In this case, the first audio signal may be referred to as the "reference audio signal" or "reference channel" and the delayed second audio signal may be referred to as the "target audio signal" or "target channel". Alternatively, when the sound source is closer to the second microphone than to the first microphone, frames of the first audio signal may be delayed relative to frames of the second audio signal. In this case, the second audio signal may be referred to as the reference audio signal or reference channel and the delayed first audio signal may be referred to as the target audio signal or target channel.

Depending on where the sound sources (e.g., talkers) are located in a conference or telepresence room or how the sound source (e.g., talker) position changes relative to the microphones, the reference channel and the target channel may change from one frame to another; similarly, the temporal delay value may also change from one frame to another. However, in some implementations, the temporal mismatch value may always be positive to indicate an amount of delay of the "target" channel relative to the "reference" channel. Furthermore, the temporal mismatch value may correspond to a "non-causal shift" value by which the delayed target channel is "pulled back" in time such that the target channel is aligned (e.g., maximally aligned) with the "reference" channel. The downmix algorithm to determine the mid channel and the side channel may be performed on the reference channel and the non-causal shifted target channel.

The encoder may determine the temporal mismatch value based on the reference audio channel and a plurality of temporal mismatch values applied to the target audio channel. For example, a first frame of the reference audio channel, X, may be received at a first time ($m_1$). A first particular frame of the target audio channel, Y, may be received at a second time ($n_1$) corresponding to a first temporal mismatch value, e.g., $shift_1=n_1-m_1$. Further, a second frame of the reference audio channel may be received at a third time ($m_2$). A second particular frame of the target audio channel may be received at a fourth time ($n_2$) corresponding to a second temporal mismatch value, e.g., $shift2=n_2-m_2$.

The device may perform a framing or a buffering algorithm to generate a frame (e.g., 20 ms samples) at a first sampling rate (e.g., 32 kHz sampling rate (i.e., 640 samples per frame)). The encoder may, in response to determining that a first frame of the first audio signal and a second frame of the second audio signal arrive at the same time at the device, estimate a temporal mismatch value (e.g., shift1) as equal to zero samples. A Left channel (e.g., corresponding to the first audio signal) and a Right channel (e.g., corresponding to the second audio signal) may be temporally aligned. In some cases, the Left channel and the Right channel, even when aligned, may differ in energy due to various reasons (e.g., microphone calibration).

In some examples, the Left channel and the Right channel may be temporally misaligned due to various reasons (e.g., a sound source, such as a talker, may be closer to one of the microphones than another and the two microphones may be greater than a threshold (e.g., 1-20 centimeters) distance apart). A location of the sound source relative to the microphones may introduce different delays in the Left channel and the Right channel. In addition, there may be a gain difference, an energy difference, or a level difference between the Left channel and the Right channel.

In some examples where there are more than two channels, a reference channel is initially selected based on the levels or energies of the channels, and subsequently refined based on the temporal mismatch values between different pairs of the channels, e.g., t1(ref, ch2), t2(ref, ch3), t3(ref, ch4), . . . , where ch1 is the ref channel initially and t1(·), t2(·), etc. are the functions to estimate the mismatch values. If all temporal mismatch values are positive then ch1 is treated as the reference channel. If any of the mismatch values is a negative value, then the reference channel is reconfigured to the channel that was associated with a mismatch value that resulted in a negative value and the above process is continued until the best selection (i.e., based on maximally decorrelating maximum number of side channels) of the reference channel is achieved. A hysteresis may be used to overcome any sudden variations in reference channel selection.

In some examples, a time of arrival of audio signals at the microphones from multiple sound sources (e.g., talkers) may vary when the multiple talkers are alternatively talking (e.g., without overlap). In such a case, the encoder may dynamically adjust a temporal mismatch value based on the talker to identify the reference channel. In some other examples, the multiple talkers may be talking at the same time, which may result in varying temporal mismatch values depending on who is the loudest talker, closest to the microphone, etc. In such a case, identification of reference and target channels may be based on the varying temporal shift values in the current frame and the estimated temporal mismatch values in the previous frames, and based on the energy or temporal evolution of the first and second audio signals.

In some examples, the first audio signal and second audio signal may be synthesized or artificially generated when the two signals potentially show less (e.g., no) correlation. It should be understood that the examples described herein are illustrative and may be instructive in determining a relationship between the first audio signal and the second audio signal in similar or different situations.

The encoder may generate comparison values (e.g., difference values or cross-correlation values) based on a comparison of a first frame of the first audio signal and a plurality of frames of the second audio signal. Each frame of the plurality of frames may correspond to a particular temporal mismatch value. The encoder may generate a first estimated temporal mismatch value based on the comparison values. For example, the first estimated temporal mismatch value may correspond to a comparison value indicating a higher temporal-similarity (or lower difference) between the first frame of the first audio signal and a corresponding first frame of the second audio signal.

The encoder may determine a final temporal mismatch value by refining, in multiple stages, a series of estimated temporal mismatch values. For example, the encoder may first estimate a "tentative" temporal mismatch value based on comparison values generated from stereo pre-processed and re-sampled versions of the first audio signal and the second audio signal. The encoder may generate interpolated comparison values associated with temporal mismatch values proximate to the estimated "tentative" temporal mismatch value. The encoder may determine a second estimated "interpolated" temporal mismatch value based on the interpolated comparison values. For example, the second estimated "interpolated" temporal mismatch value may correspond to a particular interpolated comparison value that indicates a higher temporal-similarity (or lower difference) than the remaining interpolated comparison values and the first estimated "tentative" temporal mismatch value. If the second estimated "interpolated" temporal mismatch value of the current frame (e.g., the first frame of the first audio signal) is different than a final temporal mismatch value of a previous frame (e.g., a frame of the first audio signal that precedes the first frame), then the "interpolated" temporal mismatch value of the current frame is further "amended" to improve the temporal-similarity between the first audio signal and the shifted second audio signal. In particular, a third estimated "amended" temporal mismatch value may correspond to a more accurate measure of temporal-similarity by searching around the second estimated "interpolated" temporal mismatch value of the current frame and the final estimated temporal mismatch value of the previous frame. The third estimated "amended" temporal mismatch value is further conditioned to estimate the final temporal mismatch value by limiting any spurious changes in the temporal mismatch value between frames and further controlled to not switch from a negative temporal mismatch value to a positive temporal mismatch value (or vice versa) in two successive (or consecutive) frames as described herein.

In some examples, the encoder may refrain from switching between a positive temporal mismatch value and a negative temporal mismatch value or vice-versa in consecutive frames or in adjacent frames. For example, the encoder may set the final temporal mismatch value to a particular value (e.g., 0) indicating no temporal-shift based on the estimated "interpolated" or "amended" temporal mismatch value of the first frame and a corresponding estimated "interpolated" or "amended" or final temporal mismatch value in a particular frame that precedes the first frame. To illustrate, the encoder may set the final temporal mismatch value of the current frame (e.g., the first frame) to indicate no temporal-shift, i.e., shift1=0, in response to determining that one of the estimated "tentative" or "interpolated" or "amended" temporal mismatch value of the current frame is positive and the other of the estimated "tentative" or "interpolated" or "amended" or "final" estimated temporal mismatch value of the previous frame (e.g., the frame preceding the first frame) is negative. Alternatively, the encoder may also set the final temporal mismatch value of the current frame (e.g., the first frame) to indicate no temporal-shift, i.e., shift1=0, in response to determining that one of the estimated "tentative" or "interpolated" or "amended" temporal mismatch value of the current frame is negative and the other of the estimated "tentative" or "interpolated" or "amended" or "final" estimated temporal mismatch value of the previous frame (e.g., the frame preceding the first frame) is positive.

The encoder may select a frame of the first audio signal or the second audio signal as a "reference" or "target" based on the temporal mismatch value. For example, in response to determining that the final temporal mismatch value is positive, the encoder may generate a reference channel or signal indicator having a first value (e.g., 0) indicating that the first audio signal is a "reference" signal and that the second audio signal is the "target" signal. Alternatively, in response to determining that the final temporal mismatch value is negative, the encoder may generate the reference channel or signal indicator having a second value (e.g., 1) indicating that the second audio signal is the "reference" signal and that the first audio signal is the "target" signal.

The encoder may estimate a relative gain (e.g., a relative gain parameter) associated with the reference signal and the non-causal shifted target signal. For example, in response to determining that the final temporal mismatch value is positive, the encoder may estimate a gain value to normalize or equalize the amplitude or power levels of the first audio signal relative to the second audio signal that is offset by the non-causal temporal mismatch value (e.g., an absolute value of the final temporal mismatch value). Alternatively, in response to determining that the final temporal mismatch value is negative, the encoder may estimate a gain value to normalize or equalize the power or amplitude levels of the non-causal shifted first audio signal relative to the second audio signal. In some examples, the encoder may estimate a gain value to normalize or equalize the amplitude or power levels of the "reference" signal relative to the non-causal shifted "target" signal. In other examples, the encoder may estimate the gain value (e.g., a relative gain value) based on the reference signal relative to the target signal (e.g., the unshifted target signal).

The encoder may generate at least one encoded signal (e.g., a mid signal, a side signal, or both) based on the reference signal, the target signal, the non-causal temporal mismatch value, and the relative gain parameter. In other implementations, the encoder may generate at least one encoded signal (e.g., a mid channel, a side channel, or both) based on the reference channel and the temporal-mismatch adjusted target channel. The side signal may correspond to a difference between first samples of the first frame of the first audio signal and selected samples of a selected frame of the second audio signal. The encoder may select the selected frame based on the final temporal mismatch value. Fewer bits may be used to encode the side channel signal because of reduced difference between the first samples and the selected samples as compared to other samples of the second audio signal that correspond to a frame of the second audio signal that is received by the device at the same time as the first frame. A transmitter of the device may transmit the at least one encoded signal, the non-causal temporal mismatch value, the relative gain parameter, the reference channel or signal indicator, or a combination thereof.

The encoder may generate at least one encoded signal (e.g., a mid signal, a side signal, or both) based on the reference signal, the target signal, the non-causal temporal mismatch value, the relative gain parameter, low band parameters of a particular frame of the first audio signal, high band parameters of the particular frame, or a combination thereof. The particular frame may precede the first frame. Certain low band parameters, high band parameters, or a combination thereof, from one or more preceding frames may be used to encode a mid signal, a side signal, or both, of the first frame. Encoding the mid signal, the side signal, or both, based on the low band parameters, the high band parameters, or a combination thereof, may improve estimates of the non-causal temporal mismatch value and inter-channel relative gain parameter. The low band parameters, the high band parameters, or a combination thereof, may include a pitch parameter, a voicing parameter, a coder type parameter, a low-band energy parameter, a high-band energy parameter, an envelope parameter (e.g., a tilt parameter), a pitch gain parameter, a FCB gain parameter, a coding mode parameter, a voice activity parameter, a noise estimate parameter, a signal-to-noise ratio parameter, a formants parameter, a speech/music decision parameter, the non-causal shift, the inter-channel gain parameter, or a combination thereof. A transmitter of the device may transmit the at least one encoded signal, the non-causal temporal mismatch value, the relative gain parameter, the reference channel (or signal) indicator, or a combination thereof. In the present disclosure, terms such as "determining", "calculating", "estimating", "shifting", "adjusting", etc. may be used to describe how one or more operations are performed. It should be noted that such terms are not to be construed as limiting and other techniques may be utilized to perform similar operations.

In some implementations, the encoder includes a downmixer configured to convert a stereo pair of channels into a mid/side channel pair. A low-band mid channel (a low-band portion of the mid channel) and a low-band side channel are provided to a low-band encoder. The low-band encoder is configured to generate a low-band bit stream. Additionally, the low-band encoder is configured to generate low-band parameters, such as a low-band excitation, a low-band voicing parameter(s), etc. The low-band excitation and a high-band mid channel (a high-band portion of the mid channel) are provided to a BWE encoder. The BWE encoder generates a high-band mid channel bitstream and high-band parameters (e.g., LPC, gain frame, gain shift, etc.).

The encoder, such as the BWE encoder, is configured to determine a flag value that indicates a harmonicity of a high-band signal, such as the high-band mid signal. For example, the flag value may indicate a harmonicity metric of the high-band signal. To illustrate, the flag value may indicate whether the high-band signal is harmonic or non-harmonic (e.g., noisy). As another illustrative example, the flag value may indicate whether the high-band signal is strongly harmonic, strongly non-harmonic, or weakly harmonic (e.g., between strongly harmonic and strongly non-harmonic).

The flag value may be determined based on one or more low-band parameters, one or more high-band parameters, or a combination thereof. The one or more low-band parameters and the one or more high-band parameters may correspond to a current frame or to a previous frame. For example, the encoder may determine, based on the Low Band (LB) and High Band (HB) parameters, a Non-Harmonic HB flag which indicates whether the HB is non-harmonic or not. Examples of parameters that may be used to determine the flag value include a high-band long term energy, a high-band short term energy, a ratio based on the high-band short term energy and the high-band long term energy, a previous frame's high-band gain frame, a current frame's high-band gain frame, low-band voicing parameters, or a combination thereof. Additionally or alternatively, other parameters available to an encoder (or decoder) may be used to determine the flag value (the harmonicity of the high-band signal). In a particular implementation, a value of the flag (for a current frame) is determined based on low band voicing (of the current frame), a previous frame's gain frame, and the high-band mid channel (of the current frame).

Based on the one or more low-band parameters, the one or more high-band parameters, one or more other parameters, or a combination thereof, an estimation or a prediction is made whether the high-band is harmonic (or is non harmonic). One or more techniques may be used to determine a value of the flag (e.g., to determine the harmonic metric). Some techniques may include: If-else logic (Decision Trees) (with or without some smoothing/hysteresis for smoother decisions), Gaussian Mixture Model (GMM) (e.g., based on measures provided by the GMM such as the degree of HB Harmonic and the degree of HB Non-Harmonic), other classification tools (e.g., Support Vector Machines, Neural Networks, etc.), or a combination thereof.

As an illustrative example, to determine the value of the flag, a predetermined GMM may be used to determine probabilities of whether the high-band signal is harmonic and non harmonic. For example, a first likelihood that the high-band is harmonic may be determined. Alternatively, a second likelihood that the high-band is non harmonic may be determined. In some implementations, both the first likelihood and the second likelihood are determined. In implementations where the flag can have one of two values (e.g., a first value indicating harmonic and a second value indicating non harmonic), the first likelihood (of the high-band being harmonic) may be compared to a first threshold. If the first likelihood is greater than or equal to the first threshold, the flag indicates that the high-band signal is harmonic; otherwise, the value of the flag indicates that the high-band signal is non harmonic. Alternatively, the second likelihood (of the high-band being non harmonic) may be compared to a second threshold. If the second likelihood is greater than or equal to the second threshold, the flag indicates that the high-band signal is non harmonic; otherwise, the value of the flag indicates that the high-band signal is harmonic. In another implementation, the value of the flag may be set to correspond to the greater of the first likelihood and the second likelihood.

In implementations where the flag can have more than two values (e.g., a first value indicating harmonic, a second value indicating non harmonic, and a third value indicating neither dominate harmonic nor dominate non harmonic), if the first likelihood is less than the first threshold and the second likelihood is less than the second threshold, the flag is set to the third value. Additional thresholds may be applied to the first likelihood or the second likelihood to determine additional values of the flag that correspond to additional harmonic metrics. Additional examples of the flag, the value of the flag, and how the value of the flag can impact encoding or decoding operations are described further herein.

In a TD-BWE encoding process, the low band excitation is non-linearly extended (e.g., apply a non-linearity function) to generate a harmonic high-band excitation. The harmonic high-band excitation can be used to determine a high band excitation, as described further below. One or more high-band parameters may be determined based on the high band excitation.

To generate the high band excitation, envelope modulated noise is used to generate a noisy component of the high band excitation. The envelope is extracted from (e.g., based on) the harmonic high-band excitation. The envelope modulation is performed by applying a low pass filter on the absolute values of the harmonic high-band excitation. To illustrate, a noise envelope modulator may extract an envelope from the harmonic high band excitation and apply that envelope on random noise (from a random noise generator) so that modulated noise output by the noise envelope modulator has a similar temporal envelope as the high band excitation.

The flag (indicating the harmonic metric) is used to control a noise envelope estimation process which estimates the noise envelope to be applied to the random noise by the noise envelope modulator (to generate the modulated noise). To illustrate, noise envelope control parameters may include filter coefficients for the low pass filtering to be performed on the harmonic high band excitation. To illustrate, if the flag indicates that the high-band is harmonic, the noise envelope control parameters indicate that the envelope to be applied to the random noise is to be a slow varying envelope (e.g., the noise envelope modulator can use a large length of samples such that the noise envelope has a large resolution). As another example, if the flag indicates that the high-band is non harmonic, the noise envelope control parameters indicate that the envelope to be applied to the random noise is to be a fast-varying envelope (e.g., the noise envelope modulator can use a small length of samples such that the noise envelope has a fine resolution).

Additionally, mixing parameters (e.g., gain values, such as Gain1 (Encoder) and Gain2 (Encoder)) to be applied to the harmonic high-band excitation and to the modulated noise, respectively, may be determined based on the flag and the low band voice factors. Stated another way, the mixing parameters indicate the proportions of the harmonic high-band excitation and the modulated noise that are to be combined to generate the high band excitation. In some implementations, Gain1+Gain2=1. Gain1 may be applied to the harmonic high-band excitation and Gain2 may be applied to the modulated noise. The gain adjusted harmonic high-band excitation and the gain adjusted modulated noise may be combined (e.g., summed) to generate the high band excitation.

To illustrate, if the flag indicates that the high band is non harmonic (e.g., strongly non harmonic), Gain2 is greater than Gain1. In some implementations, if the flag indicates that the high band is non harmonic (e.g., strongly non harmonic), Gain2 is set to one and Gain1 is set to zero. Thus, if the flag indicates that the high band is non harmonic (e.g., strongly non harmonic), the high-band excitation should reflect a noisy high band.

If the flag indicates that the high band is harmonic (e.g., strongly harmonic), Gain1 may be greater than Gain2. In some implementations, if the flag indicates that the high band is harmonic (e.g., strongly harmonic), Gain1 is set to one and Gain2 is set to zero. Thus, if the flag indicates that the high band is harmonic (e.g., strongly harmonic), the high-band excitation should reflect a harmonic high band.

If the flag indicates that the high band is not strongly harmonic and is not strongly non harmonic, Gain1 may be set to a first value and Gain2 may be set to a second value. In some examples, Gain1 may be greater than or equal to Gain2. In other examples, Gain1 may be less than or equal to Gain 2. The value of Gain1 and the value of Gain2 may be determined based on the low band voice factors.

After the high-band excitation is generated, one or more parameters are determined. For example, high band gain shapes and high-band gain frames may be determined based at least in part on the high-band excitation.

Since estimation of the value of flag is based on a gain frame (e.g., the previous frame's gain frame), but the gain frame of the current frame is estimated after the high-band excitation is generated (and the excitation is based on the flag), there may be a cyclic dependency between the flag and the high-band gain frame. Once the high band gain frame is determined, the value of the flag (for the current frame) can be modified to generate a modified flag. For example, if the high-band gain frame (of the current frame) is greater than a threshold, thus indicating that there is non-harmonic content in the high band, the flag may be modified to indicate the high-band is non-harmonic (e.g., strongly non-harmonic).

The above modification is optional and may not be performed. Additionally, or alternatively, modification of the flag may be based on the pre-quantized high-band gain frame, the quantized high-band gain frame, the quantized or unquantized high-band gain shape, or a combination thereof. The modified flag may be transmitted to the decoder. In implementations where modification of the flag is optional, the unmodified flag is transmitted to the decoder and the decoder may generate a modified version of the flag.

In some implementations, the flag (or the modified flag) may be used for coding the inter channel relationships to be transmitted to the decoder. For example, the flag (or the modified flag) may be used to determine mixing values (e.g., gains) associated with generation of the ICBWE non-reference channel excitation.

The decoder may receive the flag (or the modified flag). In implementations where the decoder receives the flag (and does not receive the modified flag), the decoder may generate a modified flag based on the flag. In some implementations, the decoder does not receive the flag or the modified flag and is configured to generate a modified flag based on one or more parameters, such as the parameters described above with respect to the encoder (and that are available to the decoder), front end stereo scene analysis results, downmix parameters, other parameters, or a combination thereof, as non-limiting, illustrative examples.

To generate an output signal (reflective of an audio signal received by the encoder), the decoder generates a high-band excitation in a manner similar to the encoder. To illustrate, based on the received modified flag, the decoder generates a gain adjusted modulated noise and a gain adjusted harmonic high-band excitation that are combined to generate a high-band excitation. Based on the generated excitation, decoder values of the gain frame and the gain shapes and other parameters are generated. It is noted that since the flag used at the encoder and decoder may differ in value for a particular frame, the high-band excitation based on which the high-band gain frame and the high-band gain shapes are estimated at the encoder may be different from the excitation on which these values are applied at the decoder.

In some implementations, the flag (or the modified flag) may be used for coding the inter channel relationships at the decoder. For example, the flag (or the modified flag) may be used to determine mixing values (e.g., gains) associated with generation of the ICBWE non-reference channel excitation.

By using the flag (or the modified flag) to generate high-band excitation at the encoder or the decoder, problems associated with low-band voicing parameters not reflecting a harmonicity of the high-band (such as when low-band voicing factors indicate that the low-band is highly voiced and the high-band is highly noisy) may be reduced or eliminated. For example, a high-band excitation generated at the decoder using the flag may better match the high-band at the encoder and a playout quality of an output of the decoder may not be degraded.

To illustrate, in mono-encoding or stereo-encoding, an encoder may generate a low-band signal and a high-band signal based on a received audio signal. In either mono-encoding or stereo-encoding, the received audio signal may a combination of multiple sound sources, such as two people talking concurrently. For example, a first sound source may provide a voiced segment (such as the sound of the letter "r") and a second sound source may provide an unvoiced segment (such as the sound "ssss"). In such a scenario, an energy of the voiced segment may be concentrated in the low-band while an energy of the unvoiced segment is concentrated in the high-band. Accordingly, the low-band is highly voiced because the majority (or all) of the energy of the low-band is coming from voiced segment of the first sound source and the high-band is highly noisy because the majority (or all) of the energy of the high-band is coming from the unvoiced segment of the second sound source. If low-band voicing parameters indicate that the low-band is noisy and the high-band is harmonic, the flag (or the modified flag) may be used during encoding, decoding, or both so that the nature of the low-band signal does not negatively impact the high-band excitation, such that the high-band excitation is not reflective of the high-band.

Referring to FIG. 1, a particular illustrative example of a system is disclosed and generally designated 100. The system 100 includes a first device 104 communicatively coupled, via a network 120, to a second device 106. The network 120 may include one or more wireless networks, one or more wired networks, or a combination thereof.

The first device 104 may include a memory 153, an encoder 200, a transmitter 110, and one or more input interfaces 112. The memory 153 may be a non-transitory computer-readable medium that includes instructions 191. The instructions 191 may be executable by the encoder 200 to perform one or more of the operations described herein. A first input interface of the input interfaces 112 may be coupled to a first microphone 146. A second input interface of the input interfaces 112 may be coupled to a second microphone 148. The encoder 200 may include an inter-channel bandwidth extension (ICBWE) encoder 204. The ICBWE encoder 204 may be configured to estimate one or more spectral mapping parameters based on a synthesized non-reference high-band and a non-reference target channel. Additional details associated with the operations of the ICBWE encoder 204 are described with respect to FIGS. 2 and 4-5. The first device 104 may also include a flag (e.g., a non harmonic high-band (HB) flag (x) 910) or a modified flag (e.g., a modified non harmonic high-band (HB) flag (y) 920), as described further with reference to FIG. 9. In some implementations, the first device 104 may not include the modified flag (e.g., the modified non harmonic HB flag (y) 920).

The second device 106 may include a decoder 300. The decoder 300 may include an ICBWE decoder 306. The ICBWE decoder 306 may be configured to extract one or more spectral mapping parameters from a received spectral mapping bitstream. Additional details associated with the operations of the ICBWE decoder 306 are described with respect to FIGS. 3 and 6. The second device 106 may be coupled to a first loudspeaker 142, a second loudspeaker 144, or both. Although not shown, the second device 106 may include other components, such a processor (e.g., central processing unit), a microphone, a receiver, a transmitter, an antenna, a memory, etc. The second device 106 may also include the modified flag (e.g., the modified non harmonic HB flag (y) 920), as described further with reference to FIG. 10. In some implementations, the second device 106 may additionally or alternatively include the flag (e.g., a non harmonic HB flag (x) 910).

During operation, the first device 104 may receive a first audio channel 130 (e.g., a first audio signal) via the first input interface from the first microphone 146 and may receive a second audio channel 132 (e.g., a second audio signal) via the second input interface from the second microphone 148. The first audio channel 130 may correspond to one of a right channel or a left channel. The second audio channel 132 may correspond to the other of the right channel or the left channel. A sound source 152 (e.g., a user, a speaker, ambient noise, a musical instrument, etc.) may be closer to the first microphone 146 than to the second microphone 148. Accordingly, an audio signal from the sound source 152 may be received at the input interfaces 112 via the first microphone 146 at an earlier time than via the second microphone 148. This natural delay in the multi-channel signal acquisition through the multiple microphones may introduce a temporal misalignment between the first audio channel 130 and the second audio channel 132.

According to one implementation, the first audio channel 130 may be a "reference channel" and the second audio channel 132 may be a "target channel". The target channel may be adjusted (e.g., temporally shifted) to substantially align with the reference channel. According to another implementation, the second audio channel 132 may be the reference channel and the first audio channel 130 may be the target channel. According to one implementation, the reference channel and the target channel may vary on a frame-to-frame basis. For example, for a first frame, the first audio channel 130 may be the reference channel and the second audio channel 132 may be the target channel. However, for a second frame (e.g., a subsequent frame), the first audio channel 130 may be the target channel and the second audio channel 132 may be the reference channel. For ease of description, unless otherwise noted below, the first audio channel 130 is the reference channel and the second audio channel 132 is the target channel. It should be noted that the reference channel described with respect to the audio channels 130, 132 may be independent from the high-band reference channel indicator that is described below. For example, the high-band reference channel indicator may indicate that a high-band of either of the audio channels 130, 132 is the high-band reference channel, and the high-band reference channel indicator may indicate a high-band reference channel which could be either the same channel or a different channel from the reference channel.

Figure 2A:
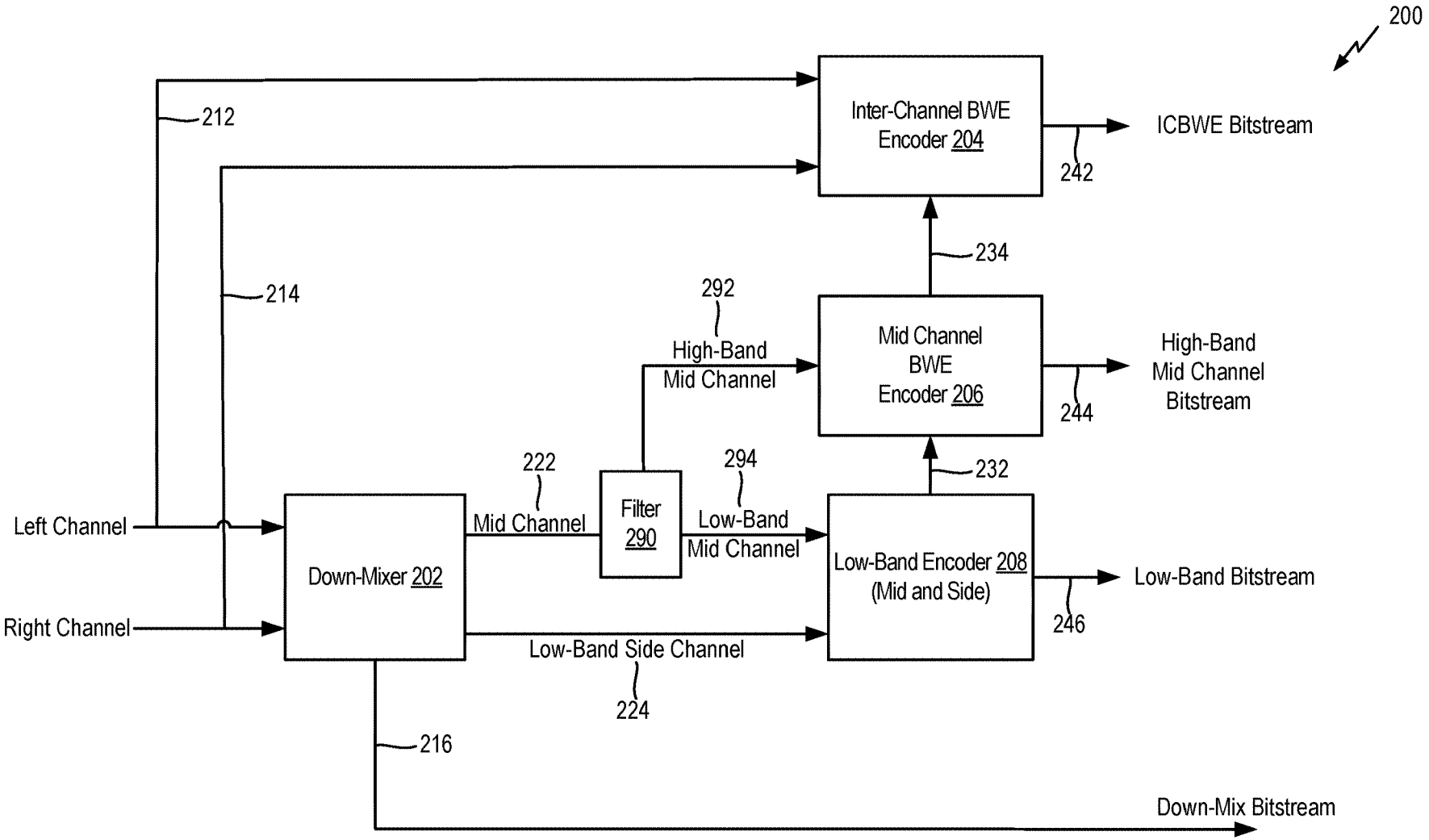
FIG. 2A is a diagram illustrating the encoder of FIG. 1.
Figure 4:
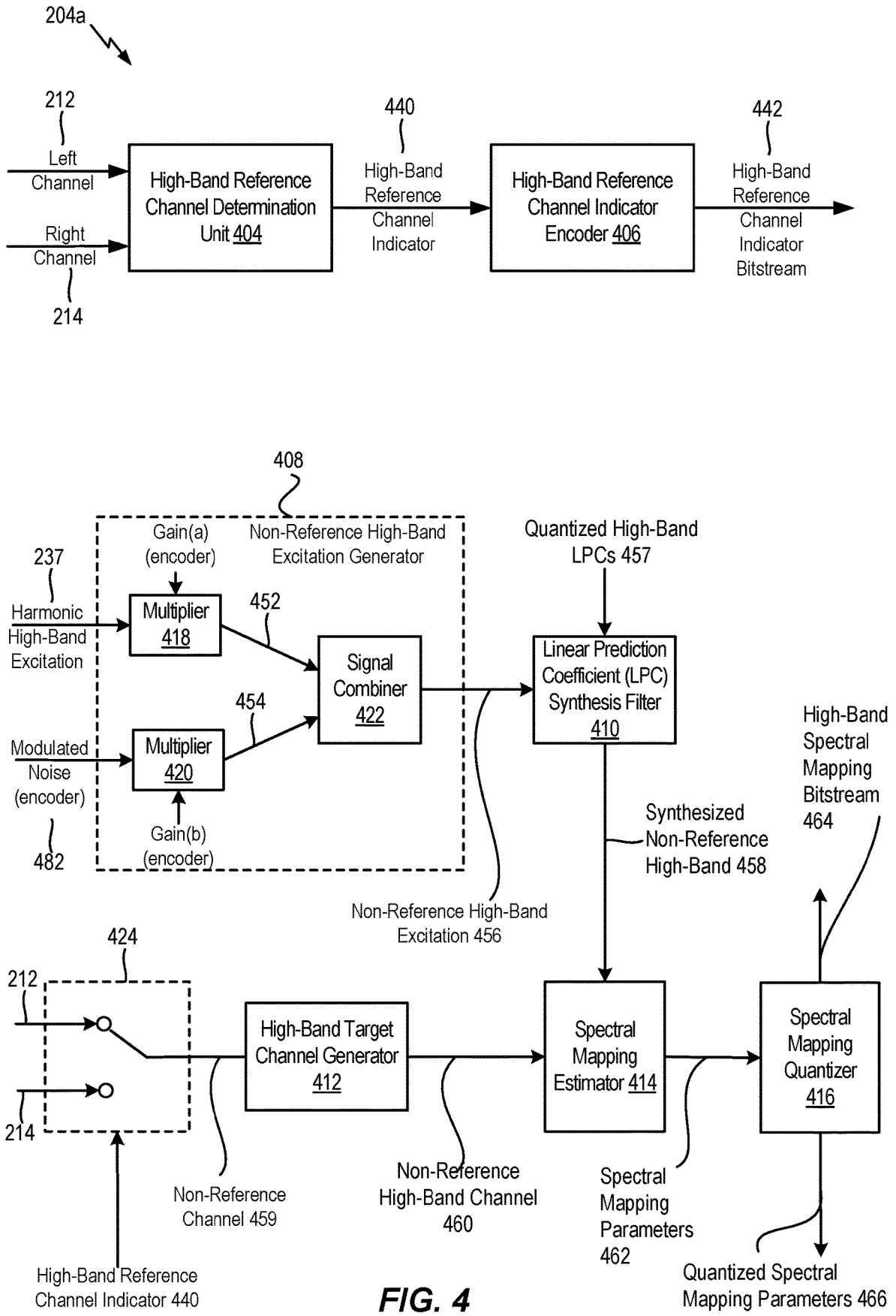
FIG. 4 is a diagram illustrating a first portion of an inter-channel bandwidth extension encoder of the encoder of FIG. 1.
Figure 5:
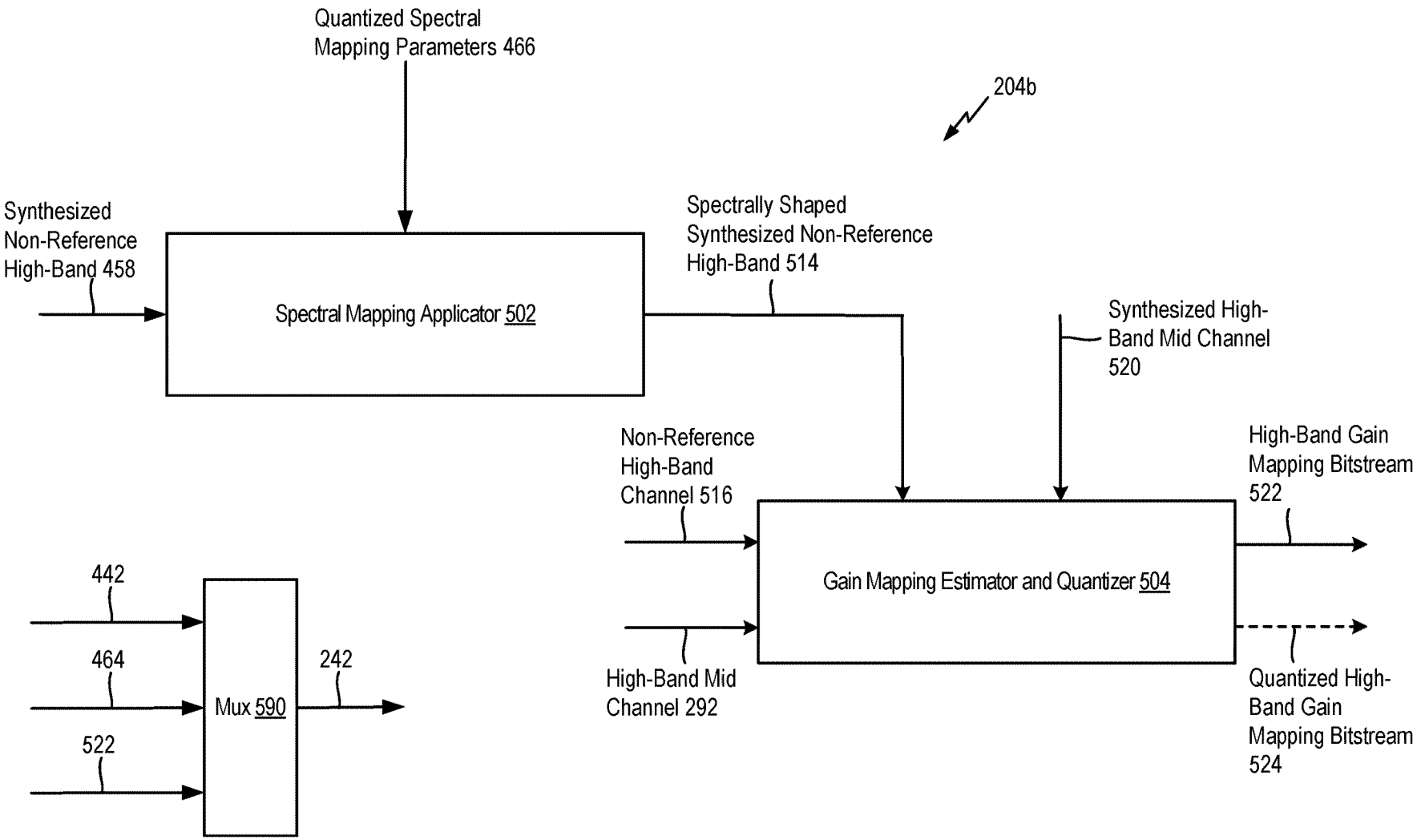
FIG. 5 is a diagram illustrating a second portion of the inter-channel bandwidth extension encoder of the encoder of FIG. 1.

As described in greater detail with respect to FIGS. 2A, 4, and 5, the encoder 200 may generate a down-mix bitstream 216, an ICBWE bitstream 242, a high-band mid channel bitstream 244, and a low-band bitstream 246. The transmitter 110 may transmit the down-mix bitstream 216, the ICBWE bitstream 242, the high-band mid channel bitstream 244, or a combination thereof, via the network 120, to the second device 106. Alternatively, or in addition, the transmitter 110 may store the down-mix bitstream 216, the ICBWE bitstream 242, the high-band mid channel bitstream 244, or a combination thereof, at a device of the network 120 or a local device for further processing or decoding later.

The decoder 300 may perform decoding operations based on the down-mix bitstream 216, the ICBWE bitstream 242, the high-band mid channel bitstream 244, and the low-band bitstream 246. For example, the decoder 300 may generate a first channel (e.g., a first output channel 126) and a second channel (e.g., a second output channel 128) based on the down-mix bitstream 216, the low-band bitstream 246, the ICBWE bitstream 242, and the high-band mid channel bitstream 244. The second device 106 may output the first output channel 126 via the first loudspeaker 142. The second device 106 may output the second output channel 128 via the second loudspeaker 144. In alternative examples, the first output channel 126 and second output channel 128 may be transmitted as a stereo signal pair to a single output loudspeaker.

As described below, the ICBWE encoder 204 of FIG. 1 may estimate spectral mapping parameters based on a maximum-likelihood measure, or an open-loop or a closed-loop spectral distortion reduction measure such that a spectral shape (e.g., the spectral envelope or spectral tilt) of a spectrally shaped synthesized non-reference high-band channel is substantially similar to a spectral shape (e.g., spectral envelope) of a non-reference target channel. The spectral mapping parameters may be transmitted to the decoder 300 in the ICBWE bitstream 242 and used at the decoder 300 to generate the output signals 126, 128 having reduced artifacts and improved spatial balance between left and right channels.

In some implementations, as described further below, the encoder 200 receives an audio signal, such as the first audio channel 130. The encoder 200 generates a high band signal (not shown) based on the received audio signal (e.g., the first audio channel 130). The encoder 200 determines a first flag value (of the non harmonic HB flag (x) 910) indicating a harmonic metric of the high band signal. The encoder 200 is further configured to generate a high band excitation signal (not shown) at least partially based on the first flag value (e.g., the non harmonic HB flag (x) 910). The high band excitation signal may be used to generate one or more parameters, such as a gain shape parameter, a gain frame parameter, etc. The encoder 200 outputs an encoded version of the high band signal, such as high-band mid channel bitstream 244.

In some implementations, the encoder 200 may determine a gain frame parameter corresponding to a frame of a high-band signal and may compare a gain frame parameter to a threshold. In response to the gain frame parameter being greater than the threshold, the encoder 200 can selectively modify the flag (e.g., the non harmonic HB flag (x) 910 that corresponds to the frame and that indicates a harmonic metric of the high band signal) to generate a modified flag (e.g., the modified non harmonic HB flag (y) 920). The encoder 200 may output the modified flag (e.g., the modified non harmonic HB flag (y) 920).

In some implementations, the decoder 300 may receive a bitstream corresponding to an encoded version of an audio signal. For example, the bitstream may include or correspond to the high-band mid channel bitstream 244, the low-band bitstream 246, the ICBWE bitstream 242, the down-mix bitstream 216, or a combination thereof. The decoder 300 may generate a high band excitation signal (not shown) based on a low band excitation signal (not shown) and further based on a flag value (e.g., the modified non harmonic HB flag (y) 920) indicating a harmonic metric of a high band signal. The high band signal corresponds to a high band portion of the audio signal, such as a high band portion of the first audio channel 130.

Referring to FIG. 2A, a particular implementation of an encoder 200 operable to estimate spectral mapping parameters is shown. The encoder 200 includes a down-mixer 202, the ICBWE encoder 204, a mid channel BWE encoder 206, a low-band encoder 208, and a filterbank 290.

A left channel 212 and a right channel 214 may be provided to the down-mixer 202. According to one implementation, the left channel 212 and the right channel 214 may be frequency-domain channels (e.g., transform-domain channels). According to another implementation, the left channel 212 and the right channel 214 may be time-domain channels. The down-mixer 202 may be configured to down-mix the left channel 212 and the right channel 214 to generate a down-mix bitstream 216, a mid channel 222, and a low-band side channel 224. Although the low-band side channel 224 is shown to be estimated, in other alternative implementations, a full bandwidth side channel may be alternatively generated and encoded and a corresponding bit-stream may be transmitted to a decoder. The down-mix bitstream 216 may include down-mix parameters (e.g., shift parameters, target gain parameters, reference channel indicator, interchannel level differences, interchannel phase differences, etc.) based on the left channel 212 and the right channel 214. The down-mix bitstream 216 may be transmitted from the encoder 200 to a decoder, such as a decoder 300 of FIG. 3A.

The mid channel 222 may represent an entire frequency band of the channels 212, 214, and the low-band side channel 224 may represent a low-band portion of the channels 212, 214. As a non-limiting example, the mid channel 222 may represent the entire frequency band (20 Hz to 16 kHz) of the channels 212, 214 if the channels 212, 214 are super-wideband channels, and the low-band side channel 224 may represent the low-band portion (e.g., 20 Hz to 8 kHz or 20 Hz to 6.4 kHz) of the channels 212, 214. The mid channel 222 may be provided to the filterbank 290, and the low-band side channel 224 may be provided to the low-band encoder 208.

The filterbank 290 may be configured to separate high-frequency components and low-frequency components of the mid channel 222. To illustrate, the filterbank 290 may separate the high-frequency components of the mid channel 222 to generate a high-band mid channel 292, and the filterbank 290 may separate the low-frequency components of the mid channel 222 to generate a low-band mid channel 294. In the scenario where the coding mode is super-wideband, the high-band mid channel 292 may span from 8 kHz to 16 kHz, and the low-band mid channel 294 may span from 20 Hz to 8 kHz. It should be appreciated that the coding mode and the frequency ranges described herein are merely for illustrative purposes and should not be construed as limiting. In other implementations, the coding mode may be different (e.g., a wideband coding mode, a full-band coding mode, etc.) and/or the frequency ranges may be different. In other implementations, the down-mixer 202 may be configured to directly provide the low-band mid channel 294 and the high-band mid channel 292. In such implementations, filtering operations at the filterbank 290 may be bypassed. The high-band mid channel 292 may be provided to the mid channel BWE encoder 206, and the low-band mid channel 294 may be provided to the low-band encoder 208.

The low-band encoder 208 may be configured to encode the low-band mid channel 294 and the low-band side channel 224 to generate a low-band bitstream 246. In some implementations, one or more of the following steps including, generation of the low-band side channel 224, encoding of the low-band side channel 224, and including the information corresponding to the low-band side channel as a part of the low-band bitstream 246, may be bypassed. According to one implementation, the low-band encoder 208 may include a mid channel low-band encoder (e.g., not shown and based on ACELP or TCX coding) configured to generate a low-band mid channel bitstream by encoding the low-band mid channel 294. The low-band encoder 208 may also include a side channel low-band encoder (e.g., not shown and based on ACELP or TCX coding) configured to generate a low-band side channel bitstream by encoding the low-band side channel 224. The low-band bitstream 246 may be transmitted from the encoder 200 to a decoder (e.g., the decoder 300 of FIG. 3A).

The low-band encoder 208 may also generate a low-band excitation 232 that is provided to the mid channel BWE encoder 206. The mid channel BWE encoder 206 may be configured to encode the high-band mid channel 292 to generate a high-band mid channel bitstream 244. For example, the mid channel BWE encoder 206 may estimate linear prediction coefficients (LPCs), gain shape parameters, gain frame parameters, etc., based on the low-band excitation 232 and the high-band mid channel 292 to generate the high-band mid channel bitstream 244. According to one implementation, the mid channel BWE encoder 206 may encode the high-band mid channel 292 using time domain bandwidth extension. The high-band mid channel bitstream 244 may be transmitted from the encoder 200 to a decoder (e.g., the decoder 300 of FIG. 3A).

The mid channel BWE encoder 206 may provide one or more parameters 234 to the ICBWE encoder 204. The one or more parameters 234 may include a harmonic high-band excitation (e.g., the harmonic high-band excitation 237 of FIG. 2B), modulated noise (e.g., the modulated noise 482 of FIG. 4), quantized gain shapes, quantized linear prediction coefficients (LPCs), quantized gain frames, etc. The left channel 212 and the right channel 214 may also be provided to the ICBWE encoder 204. The ICBWE encoder 204 may be configured to extract gain mapping parameters associated with the channels 212, 214, spectral shape mapping parameters associated with the channels 212, 214, etc., to facilitate mapping the one or more parameters 234 to the channels 212, 214. The extracted parameters may be included in the ICBWE bitstream 242. The ICBWE bitstream 242 may be transmitted from the encoder 200 to the decoder. Operations associated with the ICBWE encoder 204 are described in further detail with respect to FIGS. 4-5. Thus, the ICBWE encoder 204 of FIG. 2A may estimate spectral shape mapping parameters, quantize the spectral shape mapping parameters into the ICBWE bitstream 242, and transmit the ICBWE bitstream 242 to the decoder.

The encoder 200 of FIG. 2A may receive two channels 212, 214 and perform a downmix of the channels 212, 214 to generate the mid channel 222, the down-mix bitstream 216, and, in some implementations, the low-band side channel 224. The encoder 200 may encode the mid channel 222 and the low-band side channel 224 using the low-band encoder 208 to generate the low-band bitstream 246. The encoder 200 may also generate mapping information indicating how to map left and right decoded high-band channels (at the decoder) from a high-band mid channel (at the decoder) using the ICBWE encoder 204.

The ICBWE encoder 204 of FIG. 2A may estimate spectral mapping parameters based on a maximum-likelihood measure, or an open-loop or a closed-loop spectral distortion reduction measure such that a spectral envelope of a spectrally shaped synthesized non-reference high-band channel is substantially similar to a spectral envelope of a non-reference target channel. The spectral mapping parameters may be transmitted to the decoder 300 in the ICBWE bitstream 242 and used at the decoder 300 to generate the output signals having reduced artifacts.

In a mono implementation of aspects of the disclosure described herein, FIG. 2A may not include the down-mixer 202, the ICBWE encoder 204, and the side LB encoding portion of the low-band encoder 208. In the mono implementation, there is a single input channel and low-band and high band split encoding is performed. The low band may undergo ACELP encoding, and an excitation from the low-band ACELP, may be used for the high band coding.

Figure 2B:
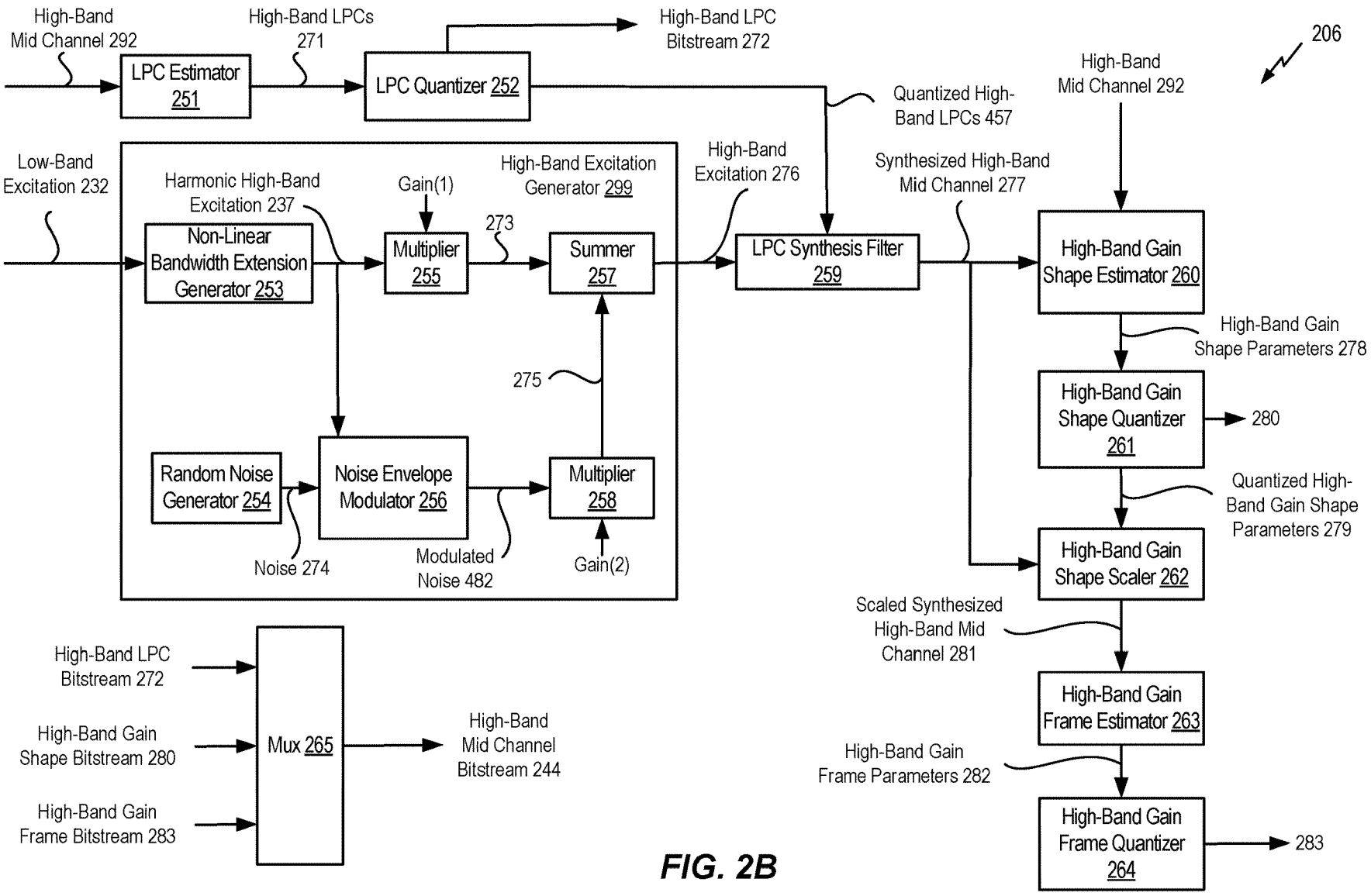
FIG. 2B is a diagram illustrating a mid channel bandwidth extension (BWE) encoder.

Referring to FIG. 2B, a particular implementation of the mid channel BWE encoder 206 is shown. The mid channel BWE encoder 206 includes a linear prediction coefficient (LPC) estimator 251, an LPC quantizer 252, and an LPC synthesis filter 259. The high-band mid channel 292 is provided to the LPC estimator 251, and the LPC estimator 251 may be configured to predict high-band LPCs 271 based on the high-band mid channel 292. The high-band LPCs 271 are provided to the LPC quantizer 252. The LPC quantizer 252 may be configured to quantize the high-band LPCs to generate quantized high-band LPCs 457 and a high-band LPC bitstream 272. The quantized high-band LPCs 457 are provided to the LPC synthesis filter 259, and the high-band LPC bitstream is provided to a multiplexer 265.

The mid channel BWE encoder 206 also includes a high-band excitation generator 299 that includes a non-linear bandwidth extension (BWE) generator 253, a random noise generator 254, a multiplier 255, a noise envelope modulator 256, a summer 257, and a multiplier 258. The low-band excitation 232 from the low-band encoder 208 is provided to the non-linear BWE generator 253. The non-linear BWE generator 253 may perform a non-linear extension on the low-band excitation 232 to generate a harmonic high-band excitation 237. The harmonic high-band excitation 237 may be included in the one or more parameters 234. The harmonic high-band excitation 237 is provided to the multiplier 255 and the noise envelope modulator 256. The signal multiplier may be configured to adjust the harmonic high-band excitation 237 based on a gain factor (Gain(1) (encoder)) to generate a gain-adjusted harmonic high-band excitation 273. The gain-adjusted harmonic high-band excitation 273 is provided to the summer 257.

The random noise generator 254 may be configured to generate noise 274 that is provided to the noise envelope modulator 256. The noise envelope modulator 256 may be configured to modulate the noise 274 based on the harmonic high-band excitation 237 to generate modulated noise 482. The modulated noise 482 is provided to the multiplier 258. The multiplier 258 may be configured to adjust the modulated noise 482 based on a gain factor (Gain(2) (encoder)) to generate gain-adjusted modulated noise 275. The gain-adjusted modulated noise 275 is provided to the summer 257, and the summer 257 may be configured to add the gain-adjusted harmonic high-band excitation 273 and the gain-adjusted modulated noise 275 to generate a high-band excitation 276. The high-band excitation 276 is provided to the LPC synthesis filter 259.

It should be noted that in some implementations Gain(1) (encoder) and Gain(2) (encoder) may be vectors with each value of the vector corresponding to a scaling factor of the corresponding signal in subframes.

The LPC synthesis filter 259 may be configured to apply the quantized high-band LPCs 457 to the high-band excitation 276 to generate a synthesized high-band mid channel 277. The synthesized high-band mid channel 277 is provided to a high-band gain shape estimator 260 and to a high-band gain shape scaler 262. The high-band mid channel 292 is also provided to the high-band gain shape estimator 260. The high-band gain shape estimator 260 may be configured to generate high-band gain shape parameters 278 based on the high-band mid channel 292 and the synthesized high-band mid channel 277. The high-band gain shape parameters 278 are provided to a high-band gain shape quantizer 261.

The high-band gain shape quantizer 261 may be configured to quantize the high-band gain shape parameters 278 and generate quantized high-band gain shape parameters 279. The quantized high-band gain shape parameters 279 are provided to the high-band gain shape scaler 262. The high-band gain shape quantizer 261 may also be configured to generate a high-band gain shape bitstream 280 that is provided to the multiplexer 265.

The high-band gain shape scaler 262 may be configured to scale the synthesized high-band mid channel 277 based on the quantized high-band gain shape parameters 279 to generate a scaled synthesized high-band mid channel 281. The scaled synthesized high-band mid channel 281 is provided to a high-band gain frame estimator 263. The high-band gain frame estimator 263 may be configured to estimate high-band gain frame parameters 282 based on the scaled synthesized high-band mid channel 281. The high-band gain frame parameters 282 are provided to a high-band gain frame quantizer 264.

The high-band gain frame quantizer 264 may be configured to quantize the high-band gain frame parameters 282 to generate a high-band gain frame bitstream 283. The high-band gain frame bitstream 283 is provided to the multiplexer 265. The multiplexer 265 may be configured to combine the high-band LPC bitstream 272, the high-band gain shape bitstream 280, the high-band gain frame bitstream 283, and other information to generate the high-band mid channel bitstream 244. According to one implementation, the other information may include information associated with the modulated noise 482, the harmonic high-band excitation 237, the quantized high-band LPCs 457, etc. As described in greater detail with respect to FIG. 4, the ICBWE encoder 204 may use the information provided to the multiplexer 265 for signal processing operations.

Figure 3A:
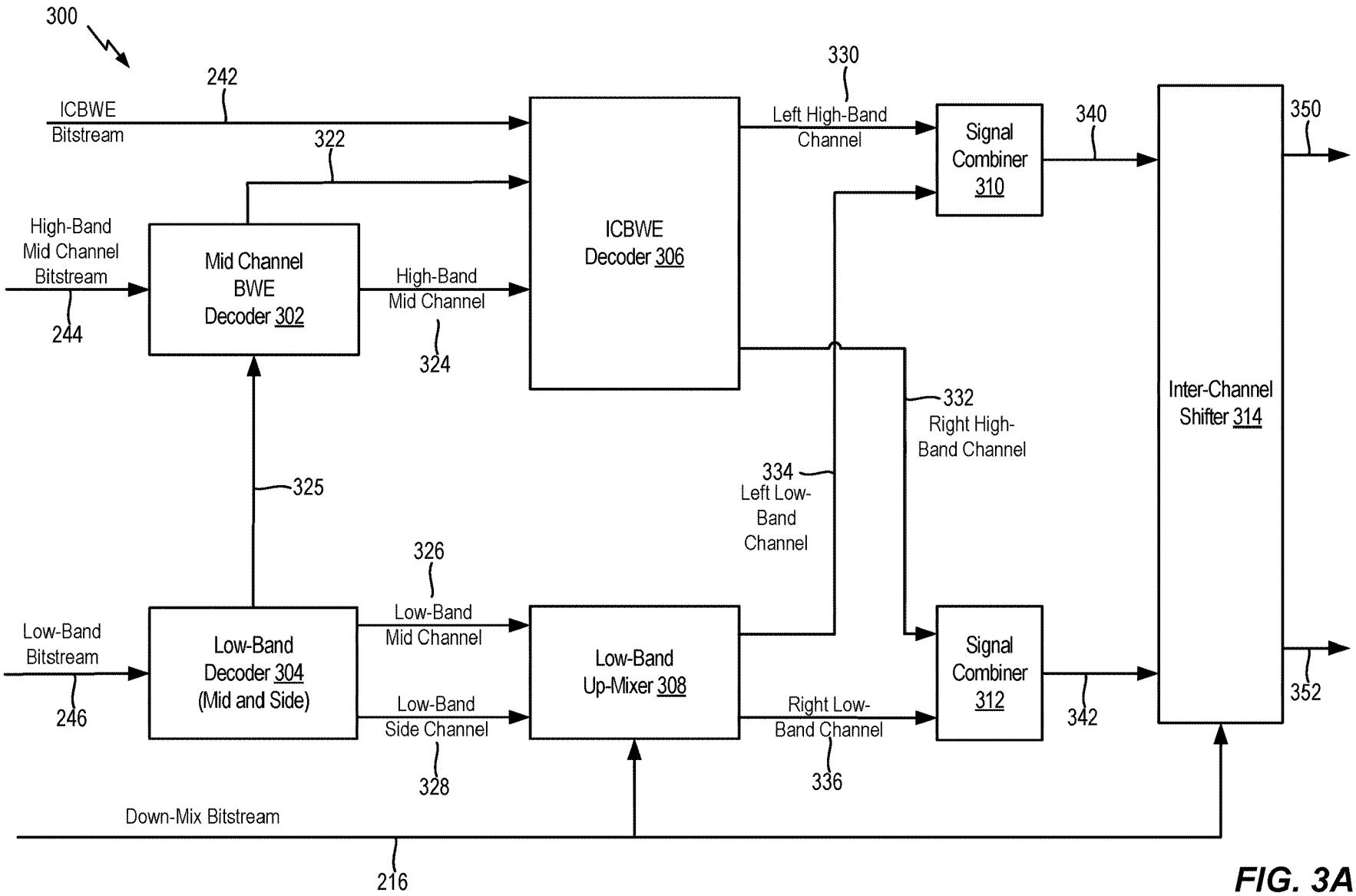
FIG. 3A is a diagram illustrating the decoder of FIG. 1.

Referring to FIG. 3A, a particular implementation of the decoder 300 operable to perform spectral shape mapping is shown. The decoder 300 includes a mid channel BWE decoder 302, a low-band decoder 304, an ICBWE decoder 306, a low-band up-mixer 308, a signal combiner 310, a signal combiner 312, and an inter-channel shifter 314.

FIG. 3A illustrates the decoder 300 in a stereo implementation. In case of mono operation, the upmix, Shifter, ICBWE and side LB decoding part of the Mid-Side LB Decoder may be omitted. Input to the decoder is mid LB bitstream and mid HB bitstream, and the LB decoded Mid signal is mixed with the Mid BWE decoded HB signal to generate the decoded Mid signal, which is output from the decoder.

As illustrated in FIG. 3A, the low-band bitstream 246, transmitted from the encoder 200, may be provided to the low-band decoder 304. As described above, the low-band bitstream 246 may include the low-band mid channel bitstream and the low-band side channel bitstream. The low-band decoder 304 may be configured to decode the low-band mid channel bitstream to generate a low-band mid channel 326 that is provided to the low-band up-mixer 308. The low-band decoder 304 may also be configured to decode the low-band side channel bitstream to generate a low-band side channel 328 that is provided to the low-band up-mixer 308. The low-band decoder 304 may also be configured to generate a low-band excitation signal 325 that is provided to the mid channel BWE decoder 302.

The mid channel BWE decoder 302 may be configured to decode the high-band mid channel bitstream 244 based on the low-band excitation signal 325 to generate one or more parameters 322 (e.g., a harmonic high-band excitation, modulated noise, quantized gain shapes, quantized linear prediction coefficients (LPCs), quantized gain frames, etc.) and a high-band mid channel 324. The one or more parameters 322 may correspond to the one or more parameters 234 of FIG. 2A. According to one implementation, the mid channel BWE decoder 302 may use time domain bandwidth extension decoding to decoder the high-band mid channel bitstream 244. The one or more parameters 322 and the high-band mid channel 324 are provided to the ICBWE decoder 306.

The ICBWE bitstream 242 may also be provided to the ICBWE decoder 306. The ICBWE decoder 306 may be configured to generate left high-band channel 330 and a right high-band channel 332 based on the ICBWE bitstream 242, the one or more parameters 322, and the high-band mid channel 324. Thus, based on the ICBWE bitstream 242 and signals and parameters from the mid channel BWE decoding, the ICBWE decoder 306 may generate the decoded left high-band channel 330 and the decoded right high-band channel 332. Operations associated with the ICBWE decoder 306 are described in further detail with respect to FIG. 6. The left high-band channel 330 is provided to the signal combiner 310, and the right high-band channel 332 is provided to the signal combiner 312. The low-band up-mixer 308 may be configured to up-mix the low-band mid channel 326 and the low-band side channel 328 based on the down-mix bitstream 216 to generate a left low-band channel 334 and a right low-band channel 336. The left low-band channel 334 is provided to the signal combiner 310, and the right low-band channel 336 is provided to the signal combiner 312.

The signal combiner 310 may be configured to combine the left high-band channel 330 and the left low-band channel 334 to generate an unshifted left channel 340. The unshifted left channel 340 is provided to the inter-channel shifter 314. The signal combiner 312 may be configured to combine the right high-band channel 332 and the right low-band channel 336 to generate an unshifted right channel 342. The unshifted right channel 342 is provided to the inter-channel shifter 314. It should be noted that in some implementations, operations associated with the inter-channel shifter 314 may be bypassed. For example, if the down-mixer at the corresponding encoder is not configured to shift any of the channels prior to mid channel and side channel generation, operations associated with the inter-channel shifter 314 may be bypassed. The inter-channel shifter 314 may be configured to shift the unshifted left channel 340 based on the shift information associated with the down-mix bitstream 216 to generate a left channel 350. The inter-channel shifter 314 may also be configured to shift the unshifted right channel 342 based on the shift information associated with the down-mix bitstream 216 to generate a right channel 352. For example, the inter-channel shifter 314 may use the shift information from the down-mix bitstream 216 to shift the unshifted left channel 340, the unshifted right channel 342, or a combination thereof, to generate the left channel 350 and the right channel 352. According to one implementation, the left channel 350 is a decoded version of the left channel 212, and the right channel 352 is a decoded version of the right channel 214.

Figure 3B:
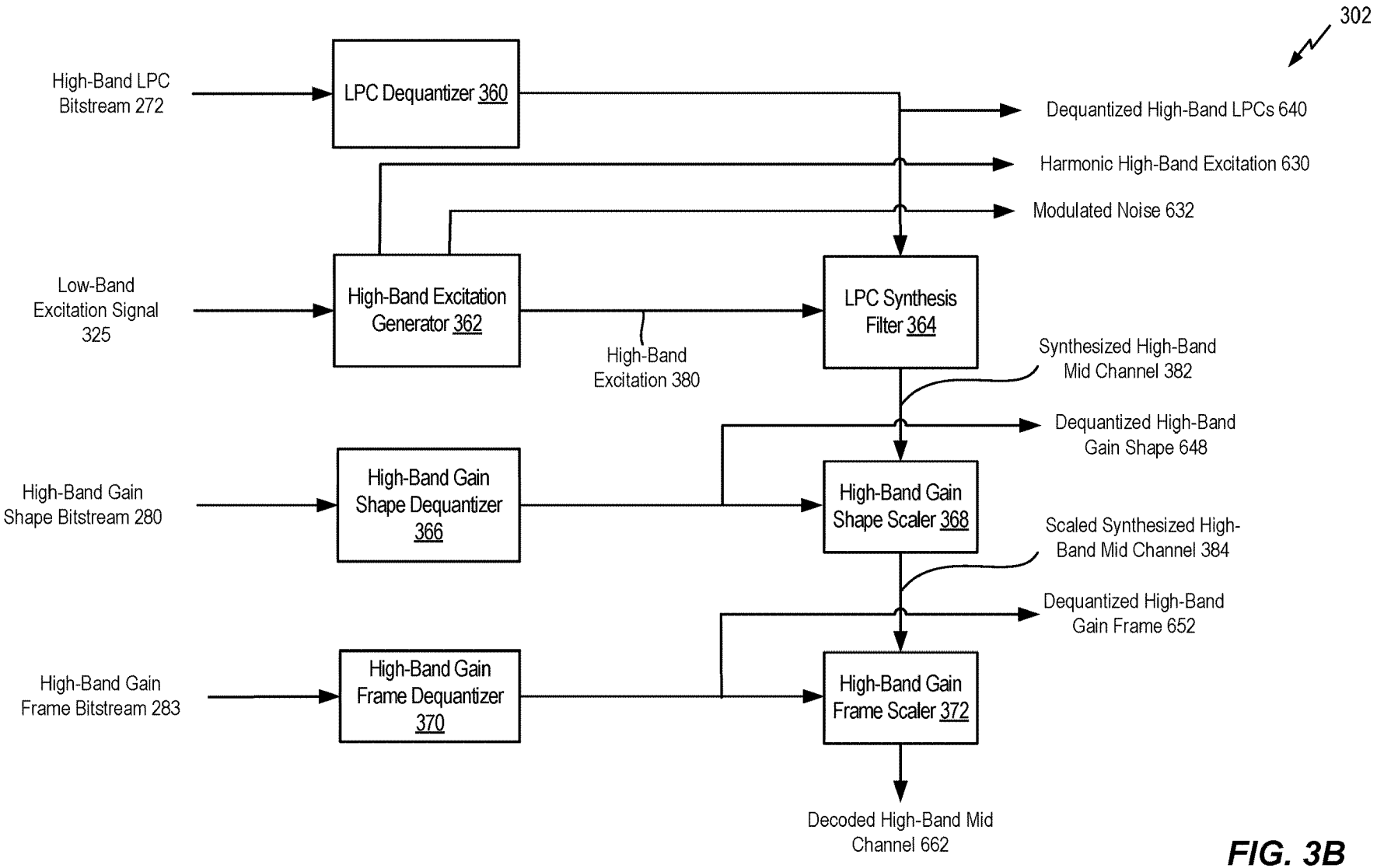
FIG. 3B is a diagram illustrating a mid channel BWE decoder.

Referring to FIG. 3B, a particular implementation of the mid channel BWE decoder 302 is shown. The mid channel BWE decoder 302 includes an LPC dequantizer 360, a high-band excitation generator 362, an LPC synthesis filter 364, a high-band gain shape dequantizer 366, a high-band gain shape scaler 368, a high-band gain frame dequantizer 370, and a high-band gain frame scaler 372.

The high-band LPC bitstream 272 is provided to the LPC dequantizer 360. The LPC dequantizer may extract dequantized high-band LPCs 640 from the high-band LPC bitstream 272. As described with respect to FIG. 6, the dequantized high-band LPCs 640 may be used by the ICBWE decoder 306 for signal processing operations.

The low-band excitation signal 325 is provided to the high-band excitation generator 362. The high-band excitation generator 362 may generate a harmonic high-band excitation 630 based on the low-band excitation signal 325 and may generate modulated noise 632. As described with respect to FIG. 6, the harmonic high-band excitation 630 and the modulated noise 632 may be used by the ICBWE decoder 306 for signal processing operations. The high-band excitation generator 362 may also generate a high-band excitation 380. The high-band excitation generator 362 may be configured to operate in a substantially similar manner as the high-band excitation generator 299 of FIG. 2B. For example, the high-band excitation generator 362 may perform similar operations on the low-band excitation signal 325 (as the high-band excitation generator 299 performs on the low-band excitation 232) to generate the high-band excitation 380. According to one implementation, the high-band excitation 380 may be substantially similar to the high-band excitation 276 of FIG. 2B. The high-band excitation 380 is provided to the LPC synthesis filter 364. The LPC synthesis filter 364 may apply the dequantized high-band LPCs 640 to the high-band excitation 380 to generate a synthesized high-band mid channel 382. The synthesized high-band mid channel 382 is provided to the high-band gain shape scaler 368.

The high-band gain shape bitstream 280 is provided to the high-band gain shape dequantizer 366. The high-band gain shape dequantizer 366 may be configured to extract a dequantized high-band gain shape 648 from the high-band gain shape bitstream 280. The dequantized high-band gain shape 648 is provided to the high-band gain shape scaler 368 and to the ICBWE decoder 306 for signal processing operations, as described with respect to FIG. 6. The high-band gain shape scaler 368 may be configured to scale the synthesized high-band mid channel 382 based on the dequantized high-band gain shape 648 to generate a scaled synthesized high-band mid channel 384. The scaled synthesized high-band mid channel 384 is provided to the high-band gain frame scaler 372.

The high-band gain frame bitstream 283 is provided to the high-band gain frame dequantizer 370. The high-band gain frame dequantizer 370 may be configured to extract a dequantized high-band gain frame 652 from the high-band gain frame bitstream 283. The dequantized high-band gain frame 652 is provided to the high-band gain frame scaler 372 and to the ICBWE decoder 306 for signal processing operations, as described with respect to FIG. 6. The high-band gain frame scaler 372 may apply the dequantized high-band gain frame 652 to the scaled synthesized high-band mid channel 384 to generate a decoded high-band mid channel 662. The decoded high-band mid channel 662 is provided to the ICBWE decoder 306 for signal processing operations, as described with respect to FIG. 6.

Referring to FIGS. 4-5, a particular implementation of the ICBWE encoder 204 is shown. A first portion 204*a* of the ICBWE encoder 204 is shown in FIG. 4, and a second portion 204*b* of the ICBWE encoder 204 is shown in FIG. 5.

The first portion 204*a* of the ICBWE encoder 204 includes a high-band reference channel determination unit 404 and a high-band reference channel indicator encoder 406. The left channel 212 and the right channel 214 are provided to the high-band reference channel determination unit 404. The high-band reference channel determination unit 404 may be configured to determine whether the left channel 212 or the right channel 214 is the high-band reference channel. For example, the high-band reference channel determination unit 404 may generate a high-band reference channel indicator 440 indicating whether the left channel 212 or the right channel 214 is used to estimate the non-reference channel 459. The high-band reference channel indicator 440 may be estimated based on energies of the left channel 212 and the right channel 214, the inter-channel shift between the left channel 212 and the right channel 214, the reference channel indicator generated at the down-mixer, the reference channel indicator based on the non-casual shift estimation, and the left and right high-band channel energies.

According to one implementation, the high-band reference channel indicator 440 may be determined using multi-stage techniques where each stage improves an output of a previous stage to determine the high-band reference channel indicator 440. For example, at a first stage, the high-band reference channel determination unit 404 may generate the high-band reference channel indicator 440 based on a reference signal. To illustrate, the high-band reference channel determination unit 404 may generate the high-band reference channel indicator 440 to indicate that the right channel 214 is designated as a high-band reference channel in response to determining that the reference signal indicates that the second audio channel 132 (e.g., a right audio signal) is designated as a reference signal. Alternatively, the high-band reference channel determination unit 404 may generate the high-band reference channel indicator 440 to indicate that the left channel 212 is designated as a high-band reference channel in response to determining that the reference signal indicates that the first audio channel 130 (e.g., a left audio signal) is designated as a reference signal.

At a second stage, the high-band reference channel determination unit 404 may refine (e.g., update) the high-band reference channel indicator 440 based on a gain parameter, a first energy associated with the left channel 212, a second energy associated with the right channel 214, or a combination thereof. For example, the high-band reference channel determination unit 404 may set (e.g., update) the high-band reference channel indicator 440 to indicate that the left channel 212 is designated as a reference channel and that the right channel 214 is designated as a non-reference channel in response to determining that the gain parameter satisfies a first threshold, that a ratio of the first energy (e.g., the left full-band energy) and the right energy (e.g., the right full-band energy) satisfies a second threshold, or both. As another example, the high-band reference channel determination unit 404 may set (e.g., update) the high-band reference channel indicator 440 to indicate that the right channel 214 is designated as a reference channel and that the left channel 212 is designated as a non-reference channel in response to determining that the gain parameter fails to satisfy the first threshold, that the ratio of the first energy (e.g., the left full-band energy) and the right energy (e.g., the right full-band energy) fails to satisfy the second threshold, or both.

At a third stage, the high-band reference channel determination unit 404 may refine (e.g., further update) the high-band reference channel indicator 440 based on the left energy and the right energy. For example, the high-band reference channel determination unit 404 may set (e.g., update) the high-band reference channel indicator 440 to indicate that the left channel 212 is designated as a reference channel and that the right channel 214 is designated as a non-reference channel in response to determining that a ratio of the left energy (e.g., the left HB energy) and the right energy (e.g., the right HB energy) satisfies a threshold. As another example, the high-band reference channel determination unit 404 may set (e.g., update) the high-band reference channel indicator 440 to indicate that the right channel 214 is designated as a reference channel and that the left channel 212 is designated as a non-reference channel in response to determining that a ratio of the left energy (e.g., the left HB energy) and the right energy (e.g., the right HB energy) fails to satisfy a threshold. The high-band reference channel indicator encoder 406 may encode the high-band reference channel indicator 440 to generate a high-band reference channel indicator bitstream 442.

The first portion 204*a* of the ICBWE encoder 204 also includes a non-reference high-band excitation generator 408, a linear prediction coefficient (LPC) synthesis filter 410, a high-band target channel generator 412, a spectral mapping estimator 414, and a spectral mapping quantizer 416. The non-reference high-band excitation generator 408 includes a signal multiplier 418, a signal multiplier 420, and a signal combiner 422.

The harmonic high-band excitation 237 is provided to the signal multiplier 418, and modulated noise 482 is provided to the signal multiplier 420. In a particular implementation, the harmonic high-band excitation 237 may be based on a harmonic modeling (e.g., (·)^2 or |.|) that is different than the harmonic modeling used for the low-band excitation 232 generation. In an alternate implementation, the harmonic high-band excitation 237 may be based on the non-reference low band excitation signal. The modulated noise 482 may be based on the envelope modulated noise of the harmonic high-band excitation 237 or the low-band excitation 232. In another alternate implementation, the modulated noise 482 may be random noise that is temporally shaped based on the non-linear harmonic high-band excitation signal 237 (e.g., a whitened non-linear harmonic high-band excitation signal). The temporal shaping may be based on a voice-factor controlled first-order adaptive filter.

The signal multiplier 418 applies a gain (Gain(a) (encoder)) to the harmonic high-band excitation 237 to generate a gain-adjusted harmonic high-band excitation 452, and the signal multiplier 420 applies a gain (Gain(b) (encoder)) to the modulated noise 482 to generate gain-adjusted modulated noise 454. The gain-adjusted harmonic high-band excitation 452 and the gain-adjusted modulated noise 454 are provided to the signal combiner 422. The signal combiner 422 may be configured to combine the gain-adjusted harmonic high-band excitation 452 and the gain-adjusted modulated noise 454 to generate a non-reference high-band excitation 456. The non-reference high-band excitation 456 may be generated in a similar manner as the high-band mid channel excitation. However, the gains (Gain(a) (encoder) and Gain(b) (encoder)) may be modified versions of the gains used to generate the high-band mid channel excitation based on the relative energies of the high-band reference and high-band non-reference channels, the noise floor of the high-band non-reference channel, etc.

It should be noted that in some implementations Gain(a) (encoder) and Gain(b) (encoder) may be vectors with each value of the vector corresponding to a scaling factor of the corresponding signal in subframes.

The mixing gains (Gain(a) (encoder) and Gain(b) (encoder)) may also be based on the voice factors corresponding to a high-band mid channel, a high-band non-reference channel, or derived from the low-band voice factor or voicing information. The mixing gains (Gain(a) (encoder) and Gain(b) (encoder)) may also be based on the spectral envelope corresponding to the high-band mid channel and the high-band non-reference channel. In another alternate implementation, the mixing gains (Gain(a) (encoder) and Gain(b) (encoder)) may be based on the number of talkers or background sources in the signal and the voiced-unvoiced characteristic of the left (or reference, target) and right (or target, reference) channels.

The non-reference high-band excitation 456 is provided to the LPC synthesis filter 410. The LPC synthesis filter 410 may be configured to generate a synthesized non-reference high-band 458 based on the non-reference high-band excitation 456 and quantized high-band LPCs 457 (e.g., LPCs of the high-band mid channel). For example, the LPC synthesis filter 410 may apply the quantized high-band LPCs 457 to the non-reference high-band excitation 456 to generate the synthesized non-reference high-band 458. The synthesized non-reference high-band 458 is provided to the spectral mapping estimator 414.

The high-band reference channel indicator 440 may be provided (as a control signal) to a switch 424 that receives the left channel 212 and the right channel 214 as inputs. Based on the high-band reference channel indicator 440, the switch 424 may provide either the left channel 212 or the right channel 214 to the high-band target channel generator 412 as a non-reference channel 459. For example, if the high-band reference channel indicator 440 indicates that the left channel 212 is the reference channel, the switch 424 may provide the right channel 214 to the high-band target channel generator 412 as the non-reference channel 459. If the high-band reference channel indicator 440 indicates that the right channel 214 is the reference channel, the switch 424 may provide the left channel 212 to the high-band target channel generator 412 as the non-reference channel 459.

The high-band target channel generator 412 may filter low-band signal components of the non-reference channel 459 to generate a non-reference high-band channel 460 (e.g., the high-band portion of the non-reference channel 459). In some implementations, the non-reference high-band channel 460 may be spectrally flipped based on further signal processing operations (e.g., a spectral flip operation). The non-reference high-band channel 460 is provided to the spectral mapping estimator 414. The spectral mapping estimator 414 may be configured to generate spectral mapping parameters 462 that map the spectrum (or energies) of the non-reference high-band channel 460 to the spectrum of the synthesized non-reference high-band 458. For example, the spectral mapping estimator 414 may generate filter coefficients that map the spectrum of the non-reference high-band channel 460 to the spectrum of the synthesized non-reference high-band 458. For example, the spectral mapping estimator 414 determines the spectral mapping parameters 462 that map the spectral envelope of the synthesized non-reference high-band 458 to be substantially approximate to the spectral envelope of the non-reference high-band channel 460 (e.g., the non-reference high-band signal). The spectral mapping parameters 462 are provided to the spectral mapping quantizer 416. The spectral mapping quantizer 416 may be configured to quantize the spectral mapping parameters 462 to generate a high-band spectral mapping bitstream 464 and quantized spectral mapping parameters 466. The quantized spectral mapping parameters 466 may be applied as a filter h(z) according to the following:

$$h(z) = \frac{1}{1 - \sum_i u_i z^{-i}}$$

where $u_i$ is the quantized spectral mapping parameters 466.

The second portion 204*b* of the ICBWE encoder 204 includes a spectral mapping applicator 502, a gain mapping estimator and quantizer 504, and a multiplexer 590. The synthesized non-reference high-band 458 and the quantized spectral mapping parameters 466 are provided to the spectral mapping applicator 502. The spectral mapping applicator 502 may be configured to generate a spectrally shaped synthesized non-reference high-band 514 based on the synthesized non-reference high-band 458 and the quantized spectral mapping parameters 466. For example, spectral mapping applicator 502 may apply the quantized spectral mapping parameters to the synthesized non-reference high-band 458 to generate the spectrally shaped synthesized non-reference high-band 514. In other alternative implementations, the spectral mapping applicator 502 may apply the spectral mapping parameters 462 (e.g., the unquantized parameter) to the synthesized non-reference high-band 458 to generate the spectrally shaped synthesized non-reference high-band 514. The spectrally shaped synthesized non-reference high-band 514 may be used to estimate the high-band gain mapping parameters. For example, the spectrally shaped synthesized non-reference high-band 514 is provided to the gain mapping estimator and quantizer 504.

Thus, the spectral mapping estimator 414 may use a spectral shape application that filters using the above-described filter h(z). The spectral mapping estimator 414 may estimate and quantize a value for the parameter ($u_i$). In an example implementation, the filter h(z) may be a first order filter and the spectral envelope of a signal may be approximated as a ratio of autocorrelation coefficients of lag index one (lag(1)) and lag index zero (lag(0)). If t(n) represents the $n^{th}$ sample of the non-reference high-band channel 460, x(n) represents the $n^{th}$ sample of the synthesized non-reference high-band 458, and y(n) represents the $n^{th}$ sample of the spectrally shaped synthesized non-reference high-band 514, then $y(n)=h(n)\circledast x(n)$, where $\circledast$ is the symbol for the signal convolution operation.

The spectral envelope of a signal s(n) may be expressed as:

$$\frac{r_{ss}(1)}{r_{ss}(0)}$$

where $r_{ss}(n)=\Sigma_{i=-\infty}^{\infty} s(i)*s(i+n)$ is the autocorrelation of the signal at lag(n). Because $y(n)=h(n)\circledast x(n)$, $r_{yy}(n)=r_{hh}(n)\circledast r_{xx}(n)$. To solve for ($u_i$, i=0,1) such that the envelope of y(n) is approximate to the envelope of t(n), the envelope (T) of t(n) may be equal to:

$$T = \frac{r_{tt}(1)}{r_{tt}(0)}.$$

Also, it can be shown that $$r_{hh}(n) = \frac{u^{|n|}}{1 - u^2}$$

when $$h(z) = \frac{1}{1 - u * z^{-1}}.$$

Thus, encoder 200 may determine the envelope (T), such that $$\frac{r_{yy}(1)}{r_{yy}(0)} = T.$$

It should be noted that when the $r_{yy}$ values are expanded, there could potentially be many approximations to obtain multiple possible approximations of the value of u. Both iterative and analytical solutions can be obtained for the above equation. A non-limiting example of an analytical solution is described herein. By expanding the above equation to terms with u's exponent up to two, the result is:

$$a * u^2 + b * u + c = 0, \text{ where,}$$

$$a = 2 * T * \frac{r_{xx}(1)}{r_{xx}(0)} - \frac{r_{xx}(3)}{r_{xx}(0)} - \frac{r_{xx}(1)}{r_{xx}(0)},$$

$$b = 2 * T * \frac{r_{xx}(1)}{r_{xx}(0)} - \frac{r_{xx}(2)}{r_{xx}(0)} - 1$$

$$c = T - \frac{r_{xx}(1)}{r_{xx}(0)}$$

Two possible solutions for (u) may exist due to the nature of quadratic equations. Because the two possible solutions may be real or imaginary, if $b^2-4*a*c$ is ≥0, there are two real solutions. Otherwise, there are two imaginary solutions.

Because, in general, the non-reference channel has a steeper roll-off in spectral energy at higher frequencies, smaller values of (u) may be preferred (including negative values). A smaller value of (u) envelopes the signal such that there is a steeper roll off in spectral energy at higher frequencies. According to one implementation, values of (u) whose absolute value is <1 (i.e., $|u_{final}|<1$) may be used.

If there are no real solutions, the previous frame's (u) may be used as the current frame's (u). If there are one or more real solutions and there are no real solution with an absolute value less than one, the previous frame's $u_{final}$ value may be used for the current frame. If there are one or more real solutions and there is one real solution with an absolute value less than one, the current frame may use the real solution as the $u_{final}$ value. If there are one or more real solutions and there is more than one real solution with an absolute value less than one, the current frame may use the smallest (u) value as the $u_{final}$ value or the current frame may use the (u) value that is closest to the previous frame's (u) value.

In an alternate implementation, the spectral mapping parameters may be estimated based on the spectral analysis of the non-reference high-band channel and the non-reference high-band excitation 456, to maximize the spectral match between the spectrally shaped non-reference HB signal and the non-reference HB target channel. In another implementation, the spectral mapping parameters may be based on the LP analysis of the non-reference high-band channel and the synthesized high-band mid channel 520 or high-band mid channel 292.

A non-reference high-band channel 516, a synthesized high-band mid channel 520, and the high-band mid channel 292 are also provided to the gain mapping estimator and quantizer 504. The gain mapping estimator and quantizer 504 may generate a high-band gain mapping bitstream 522 and a quantized high-band gain mapping bitstream 524 based on the spectrally shaped synthesized non-reference high-band 514, the non-reference high-band channel 516, the synthesized high-band mid channel 520, and the high-band mid channel 292. For example, the gain mapping estimator and quantizer 504 may generate a set of adjustment gain parameters based on the synthesized high-band mid channel 520 and the spectrally shaped synthesized non-reference high-band 514. To illustrate, the gain mapping estimator and quantizer 504 may determine a synthesized high-band gain corresponding to a difference (or ratio) between an energy (or power) of the synthesized high-band mid channel 510 and an energy (or power) of the spectrally shaped synthesized non-reference high-band 514. The set of adjustment gain parameters may indicate the synthesized high-band gain.

The gain mapping estimator and quantizer 504 may generate the first set of adjustment gain parameters based on a set of adjustment gain parameters and a predicted set of adjustment gain parameters. For example, the first set of adjustment gain parameters may indicate a difference between the set of adjustment gain parameters and the predicted set of adjustment gain parameters. As another example, the first set of adjustment gain parameters may correspond to a product of the predicted set of adjustment gain parameters and the ratio of the first energy of the synthesized high-band mid channel 520 and the second energy of the spectrally shaped synthesized non-reference high-band 514 (e.g., first set of adjustment gain parameters=predicted set of adjustment gain parameters* (first energy of the synthesized high-band mid channel 520/second energy of the spectrally shaped synthesized non-reference high-band 514).

The high-band reference channel indicator bitstream 442, the high-band spectral mapping bitstream 464, and the high-band gain mapping bitstream 522 are provided to the multiplexer 590. The multiplexer 590 may be configured to generate the ICBWE bitstream 242 by multiplexing the high-band reference channel indicator bitstream 442, the high-band spectral mapping bitstream 464, and the high-band gain mapping bitstream 522. The ICBWE bitstream 242 may be transmitted to a decoder, such as the decoder 300 of FIG. 3A.

Figure 6:
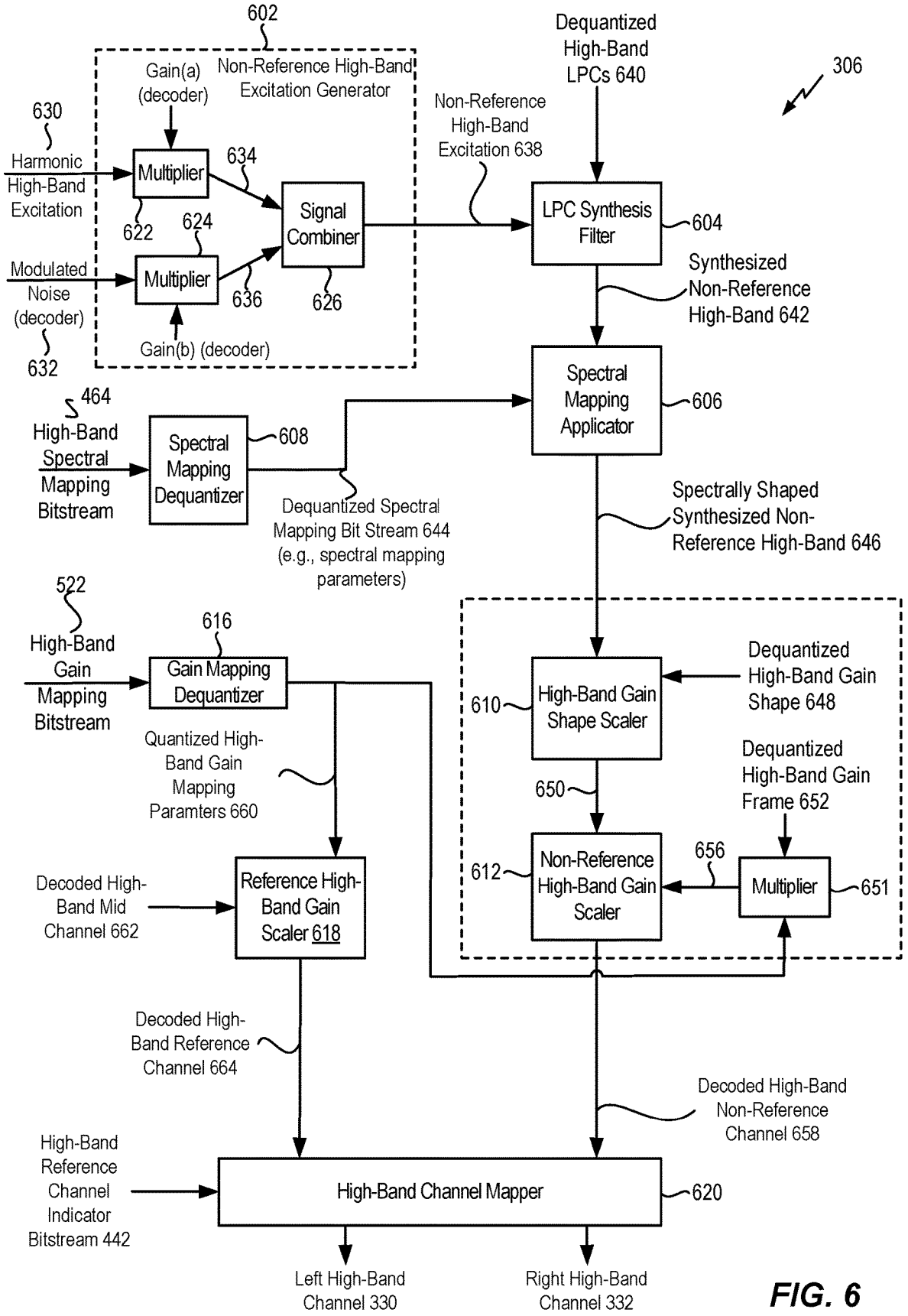
FIG. 6 is a diagram illustrating an inter-channel bandwidth extension decoder of FIG. 1.

Referring to FIG. 6, a particular implementation of the ICBWE decoder 306 is shown. The ICBWE decoder 306 includes a non-reference high-band excitation generator 602, a LPC synthesis filter 604, a spectral mapping applicator 606, a spectral mapping dequantizer 608, a high-band gain shape scaler 610, a non-reference high-band gain scaler 612, a gain mapping dequantizer 616, a reference high-band gain scaler 618, and a high-band channel mapper 620. The non-reference high-band excitation generator 602 includes a signal multiplier 622, a signal multiplier 624, and a signal combiner 626.

A harmonic high-band excitation 630 (generated from the low-band bitstream 246) is provided to the signal multiplier 622, and modulated noise 632 is provided to the signal multiplier 624. The signal multiplier 622 applies a gain (Gain(a) (decoder)) to the harmonic high-band excitation 630 to generate a gain-adjusted harmonic high-band excitation 634, and the signal multiplier 624 applies a gain (Gain(b) (decoder)) to the modulated noise 632 to generate gain-adjusted modulated noise 636. It should be noted that in some implementations Gain(a) (decoder) and Gain(b) (decoder) may be vectors with each value of the vector corresponding to a scaling factor of the corresponding signal in subframes. The mixing gains (Gain(a) (decoder) and Gain(b) (decoder)) may also be based on the voice factors corresponding to synthesized high-band mid channel, synthesized high-band non-reference channel, or derived from the low-band voice factor or voicing information. The mixing gains (Gain(a) (decoder) and Gain(b) (decoder)) may also be based on the spectral envelope corresponding to the synthesized high-band mid channel, synthesized high-band non-reference channel, or derived from the low-band voice factor or voicing information. In another alternate implementation, the mixing gains (Gain(a) (decoder) and Gain(b) (decoder)) may be based on the number of talkers or background sources in the signal and the voiced-unvoiced characteristic of the left (or reference, target) and right (or target, reference) channels. The gain-adjusted harmonic high-band excitation 634 and the gain-adjusted modulated noise 636 are provided to the signal combiner 626. The signal combiner 626 may be configured to combine the gain-adjusted harmonic high-band excitation 634 and the gain-adjusted modulated noise 636 to generate a non-reference high-band excitation 638. Thus, the non-reference high-band excitation 638 may be generated in a substantially similar manner as the non-reference high-band excitation 456 of the ICBWE encoder 204.

The non-reference high-band excitation 638 in provided to the LPC synthesis filter 604. The LPC synthesis filter 604 may be configured to generate a synthesized non-reference high-band 642 based on the non-reference high-band excitation 638 and dequantized high-band LPCs 640 (from a bitstream transmitted from the encoder 200) of the high-band mid channel. For example, the LPC synthesis filter 604 may apply the dequantized high-band LPCs 640 to the non-reference high-band excitation 638 to generate the synthesized non-reference high-band 642. The synthesized non-reference high-band 642 is provided to the spectral mapping applicator 606.

The high-band spectral mapping bitstream 464 from the encoder 200 is provided to the spectral mapping dequantizer 608. The spectral mapping dequantizer 608 may be configured to decode the high-band spectral mapping bitstream 464 to generate a dequantized spectral mapping bitstream 644. The dequantized spectral mapping bitstream 644 is provided to the spectral mapping applicator 606. The spectral mapping applicator 606 may be configured to apply the dequantized spectral mapping bitstream 644 to the synthesized non-reference high-band 642 (in a substantially similar manner as at the ICBWE encoder 204) to generate a spectrally shaped synthesized non-reference high-band 646. For example, the dequantized spectral mapping bitstream 644 may be applied as a filter as follows:

$$\frac{1}{1 - u * z^{-1}}$$

where u is the quantized spectral mapping parameters. The spectrally shaped synthesized non-reference high-band 646 is provided to the high-band gain shape scaler 610.

The high-band gain shape scaler 610 may be configured to scale the spectrally shaped synthesized non-reference high-band 646 based on a quantized high-band gain shape (from a bitstream transmitted from the encoder 200) to generate a scaled signal 650. The scaled signal 650 is provided to the non-reference high-band gain scaler 612. A multiplier 651 may be configured to multiply a dequantized high-band gain frame 652 (e.g., the mid channel gain frame) by quantized high-band gain mapping parameters 660 (from the high-band gain mapping bitstream 522) to generate a resulting signal 656. The resulting signal 656 may be generated by applying the product of the dequantized high-band gain frame 652 and the quantized high-band gain mapping parameters 660 or using two sequential gain stages. The resulting signal 656 is provided to the non-reference high-band gain scaler 612. The non-reference high-band gain scaler 612 may be configured to scale the scaled signal 650 by the resulting signal 656 to generate a decoded high-band non-reference channel 658. The decoded high-band non-reference channel 658 is provided to the high-band channel mapper 620. According to another implementation, a predicted reference channel gain mapping parameter may be applied to the mid channel to generate the decoded high-band non-reference channel 658.

The high-band gain mapping bitstream 522 from the encoder 200 is provided to the gain mapping dequantizer 616. The gain mapping dequantizer 616 may be configured to decode the high-band gain mapping bitstream 522 to generate quantized high-band gain mapping parameters 660. The quantized high-band gain mapping parameters 660 are provided to the reference high-band gain scaler 618, and a decoded high-band mid channel 662 (generated from the high-band mid channel bitstream 244) is provided to the reference high-band gain scaler 618. The reference high-band gain scaler 618 may be configured to scale the decoded high-band mid channel 662 based on the quantized high-band gain mapping parameters 660 to generate a decoded high-band reference channel 664. The decoded high-band reference channel 664 is provided to the high-band channel mapper 620.

The high-band channel mapper 620 may be configured to designate the decoded high-band reference channel 664 or the decoded high-band non-reference channel 658 as the left high-band channel 330. For example, the high-band channel mapper 620 may determine whether the left high-band channel 330 is a reference channel (or non-reference channel) based on the high-band reference channel indicator bitstream 442 from the encoder 200. Using similar techniques, the high-band channel mapper 620 may be configured to designate the other of the decoded high-band reference channel 664 and the decoded high-band non-reference channel 658 as the right high-band channel 332.

The techniques described with respect to FIGS. 1-6 may enable improved high-band estimation for audio encoding and audio decoding. For example, the quantized spectral mapping parameters 466 may be used to generate a synthesized high-band channel (e.g., the spectrally shaped synthesized non-reference high-band 514) having a spectral envelope that approximates the spectral envelope of a high-band channel (e.g., the non-reference high-band channel 460). Thus, the quantized spectral mapping parameters 466 may be used at the decoder 300 to generate a synthesized high-band channel (e.g., the spectrally shaped synthesized non-reference high-band 646) that approximates the spectral envelope of the high-band channel at the encoder 200. As a result, reduced artifacts may occur when reconstructing the high-band at the decoder 300 because the high-band may have a similar spectral envelope as the low-band on the encoder-side.

Figure 7:
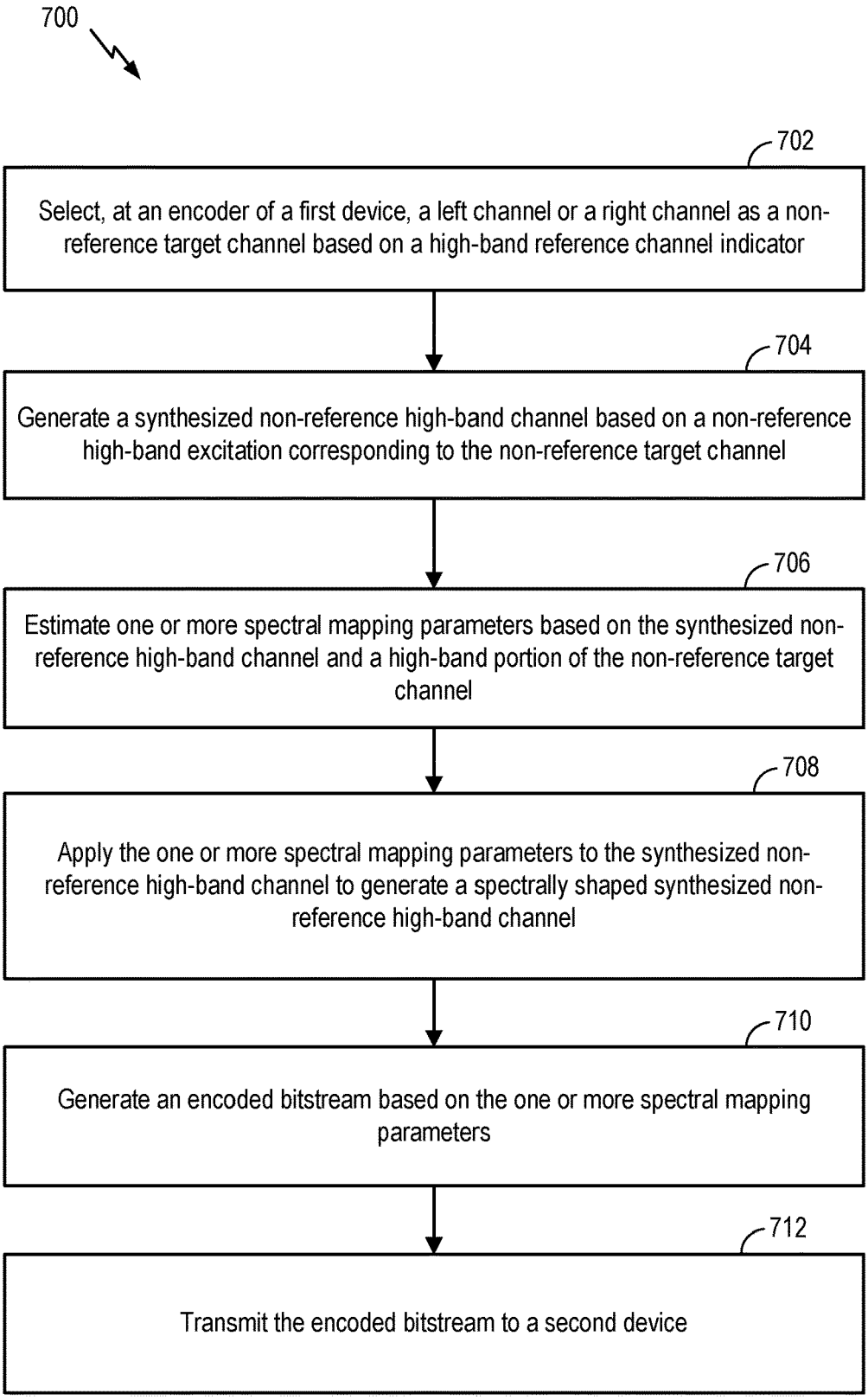
FIG. 7 is a particular example of a method of estimating one or more spectral mapping parameters.

Referring to FIG. 7, a method 700 of estimating spectral mapping parameters is shown. The method 700 may be performed by the first device 104 of FIG. 1. In particular, the method 700 may be performed by the encoder 200.

The method 700 includes selecting, at an encoder of a first device, a left channel or a right channel as a non-reference target channel based on a high-band reference channel indicator, at 702. For example, referring to FIG. 4, the switch 424 may select the left channel 212 or the right channel 214 as the non-reference high-band channel 460 based on the high-band reference channel indicator 440.

The method 700 includes generating a synthesized non-reference high-band channel based on a non-reference high-band excitation corresponding to the non-reference target channel, at 704. For example, referring to FIG. 4, the LPC synthesis filter 410 may generate the synthesized non-reference high-band 458 by applying the quantized high-band LPCs 457 to the non-reference high-band excitation 456. In some implementations, the method 700 also includes generating a high-band portion of the non-reference target channel.

The method 700 also includes estimating one or more spectral mapping parameters based on the synthesized non-reference high-band channel and a high-band portion of the non-reference target channel, at 706. For example, referring to FIG. 4, the spectral mapping estimator 414 may estimate the spectral mapping parameters 462 based on the synthesized non-reference high-band 458 and the non-reference high-band channel 460.

According to one implementation, the one or more spectral mapping parameters are estimated based on a first autocorrelation value of the non-reference target channel at lag index one and a second autocorrelation value of the non-reference target channel at lag index zero. The one or more spectral mapping parameters may include a particular spectral mapping parameter of at least two spectral mapping parameter candidates. In one implementation, the particular spectral mapping parameter may correspond to a spectral mapping parameter of a previous frame if the at least two spectral mapping parameter candidates are non-real candidates. In another implementation, the particular spectral mapping parameter may correspond to a spectral mapping parameter of a previous frame if each spectral mapping parameter candidate of the at least two spectral mapping parameter candidates have an absolute value that is greater than one. In another implementation, the particular spectral mapping parameter may correspond to a spectral mapping parameter candidate having an absolute value less than one if only one spectral mapping parameter candidate of the at least two spectral mapping parameter candidates has an absolute value less than one. In another implementation, the particular spectral mapping parameter may correspond to a spectral mapping parameter candidate having a smallest value if more than one of the at least two spectral mapping parameter candidates have an absolute value less than one. In another implementation, the particular spectral mapping parameter may correspond to a spectral mapping parameter of a previous frame if more than one of the at least two spectral mapping parameter candidates have an absolute value less than one.

The method 700 also includes applying the one or more spectral mapping parameters to the synthesized non-reference high-band channel to generate a spectrally shaped synthesized non-reference high-band channel, at 708.

Applying the one or more spectral parameters may correspond to filtering the synthesized non-reference high-band channel based on a spectral mapping filter. The spectrally shaped synthesized non-reference high-band channel may have a spectral envelope that is similar to a spectral envelope of the non-reference target channel. For example, referring to FIG. 5, the spectral mapping applicator 502 may apply the quantized spectral mapping parameters 466 to the synthesized non-reference high-band 458 to generate the spectrally shaped synthesized non-reference high-band 514. The spectrally shaped synthesized non-reference high-band 514 may have a spectral envelope that is similar to a spectral envelope of the non-reference high-band channel 460. The spectrally shaped synthesized non-reference high-band channel may be used to estimate a gain mapping parameter.

The method 700 also includes generating an encoded bitstream based on the one or more spectral mapping parameters, at 710. For example, referring to FIG. 4, the spectral mapping quantizer 416 may generate the high-band spectral mapping bitstream 464 based on the spectral mapping parameters 462.

The method 700 further includes transmitting the encoded bitstream to a second device, at 712. For example, referring to FIG. 1, the transmitter 110 may transmit the ICBWE bitstream 242 (that includes the high-band spectral mapping bitstream 464) to the second device 106.

The method 700 may enable improved high-band estimation for audio encoding and audio decoding. For example, the quantized spectral mapping parameters 466 may be used to generate a synthesized high-band channel (e.g., the spectrally shaped synthesized non-reference high-band 514) having a spectral envelope that approximates the spectral envelope of a high-band channel (e.g., the non-reference high-band channel 460). Thus, the quantized spectral mapping parameters 466 may be used at the decoder 300 to generate a synthesized high-band channel (e.g., the spectrally shaped synthesized non-reference high-band 646) that approximates the spectral envelope of the high-band channel at the encoder 200. As a result, reduced artifacts may occur when reconstructing the high-band at the decoder 300 because the high-band may have a similar spectral envelope as the low-band on the encoder-side.

Figure 8:
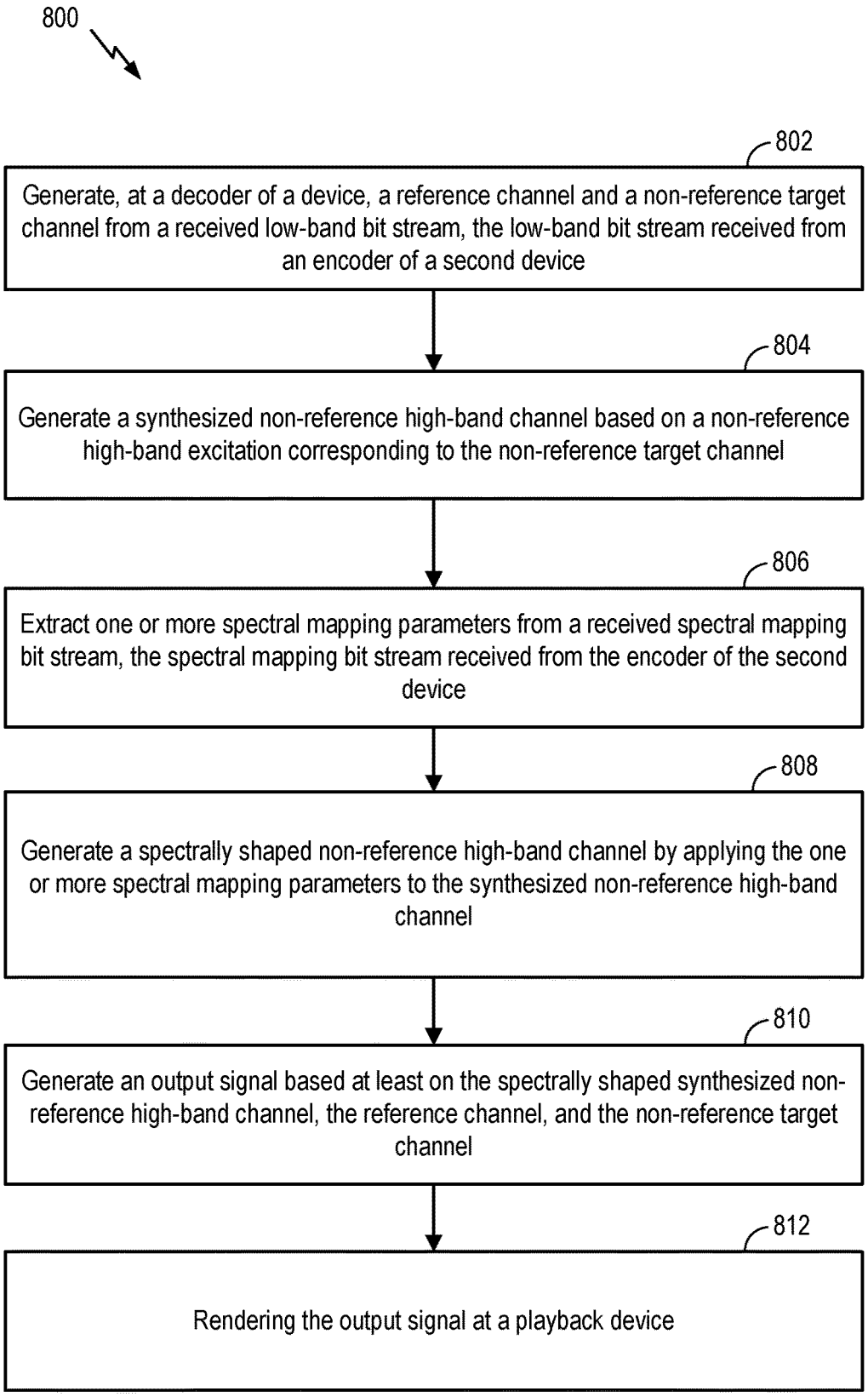
FIG. 8 is a particular example of a method of extracting one or more spectral mapping parameters.

Referring to FIG. 8, a method 800 of extracting spectral mapping parameters is shown. The method 800 may be performed by the second device 106 of FIG. 1. In particular, the method 800 may be performed by the decoder 300.

The method 800 includes generating, at a decoder of a device, a reference channel and a non-reference target channel from a received bitstream, at 802. The bitstream may be received from an encoder of a second device. For example, referring to FIG. 1, the decoder 300 may generate a non-reference channel from the low-band bitstream 246. The reference channel and the non-reference target channel may be up-mixed channels generated at the decoder 300. As a non-limiting example, if the low-band reference channel is the low-band portion of the left channel, the high-band portion of the left channel may correspond to the high-band reference channel. According to one implementation, the decoder 300 may generate the left and right channels without generating the reference channel and the non-reference target channel.

The method 800 also includes generating a synthesized non-reference high-band channel based on a non-reference high-band excitation corresponding to the non-reference target channel, at 804. For example, referring to FIG. 6, the LPC synthesis filter 604 may generate the synthesized non-reference high-band 642 by applying the dequantized high-band LPCs 640 to the non-reference high-band excitation 638.

The method 800 further includes extracting one or more spectral mapping parameters from a received spectral mapping bitstream, at 806. The spectral mapping bitstream may be received from the encoder of the second device. For example, referring to FIG. 6, the spectral mapping dequantizer 608 may extract the dequantized spectral mapping bitstream 644 from the high-band spectral mapping bitstream 464.

The method 800 also includes generating a spectrally shaped non-reference high-band channel by applying the one or more spectral mapping parameters to the synthesized non-reference high-band channel, at 808. The spectrally shaped synthesized non-reference high-band channel may have a spectral envelope that is similar to a spectral envelope of the non-reference target channel. For example, referring to FIG. 6, the spectral mapping applicator 606 may apply the dequantized spectral mapping bitstream 644 to the synthesized non-reference high-band to generate the spectrally shaped synthesized non-reference high-band 646. The spectrally shaped synthesized non-reference high-band 646 may have a spectral envelope that is similar to a spectral envelope of the non-reference target channel.

The method 800 also includes generating an output signal based at least on the spectrally shaped non-reference high-band channel, the reference channel, and the non-reference target channel, at 810. For example, referring to FIG. 1, the decoder 300 may generate at least one of the output signals 126, 128 based on the spectrally shaped synthesized non-reference high-band 646.

The method 800 further includes rendering the output signal at playback device, at 812. For example, referring to FIG. 1, the loudspeakers 142, 144 may render and output the output signals 126, 128, respectively.

The method 800 may enable improved high-band estimation for audio encoding and audio decoding. For example, the quantized spectral mapping parameters 466 may be used to generate a synthesized high-band channel (e.g., the spectrally shaped synthesized non-reference high-band 514) having a spectral envelope that approximates the spectral envelope of a high-band channel (e.g., the non-reference high-band channel 460). Thus, the quantized spectral mapping parameters 466 may be used at the decoder 300 to generate a synthesized high-band channel (e.g., the spectrally shaped synthesized non-reference high-band 646) that approximates the spectral envelope of the high-band channel at the encoder 200. As a result, reduced artifacts may occur when reconstructing the high-band at the decoder 300 because the high-band may have a similar spectral envelope as the low-band on the encoder-side.

Figure 9:
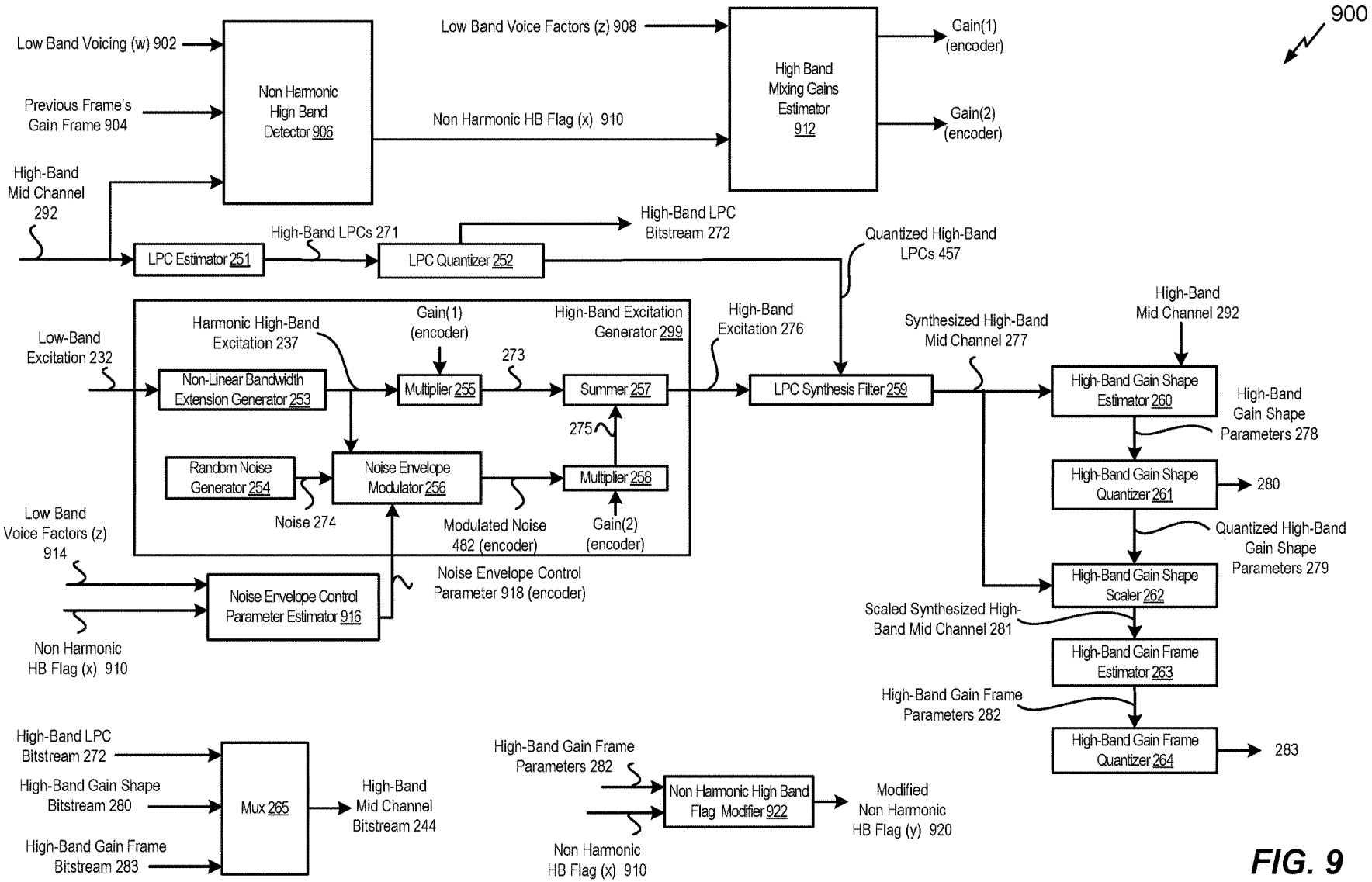
FIG. 9 is a diagram illustrating a mid channel bandwidth extension (BWE) encoder configured to use a flag that indicates a harmonic metric of a high band signal.

Referring to FIG. 9, a particular implementation of an encoder 900 is shown. The encoder 900 may include or correspond to the encoder 200 of FIG. 1 or the mid channel BWE encoder 206 of FIG. 2B.

The encoder 900 includes the LPC estimator 251, the LPC quantizer 252, the high-band excitation generator 299 (including the non-linear BWE generator 253, the multiplier 255, the summer 257, the random noise generator 254, the noise envelope modulator 256, and the multiplier 258), the LPC synthesis filter 259, the high-band gain shape estimator 260, the high-band gain shape quantizer 261, the high-band gain shape scaler 262, the high-band gain frame estimator 263, the high-band gain frame quantizer 264, the multiplexer 265, a non harmonic high band detector 906, a high band mixing gains estimator 912, and a noise envelope control parameter estimator 916. Additionally, in some implementations, the encoder 900 also includes a non harmonic high band flag modifier 922.

The non harmonic high band detector 906 is configured to generate the non harmonic HB flag (x), (e.g., the multi-source flag) 910. The non harmonic HB flag (e.g., the multi-source flag, x) 910 may have a value that indicates a harmonic metric of a high band signal, such as the high-band mid channel 292. For example, the non harmonic high band detector 906 may receive low band voicing (w) 902, a previous frame's gain frame 904, and the high-band mid channel 292, and the non harmonic high band detector 906 may determine the non harmonic HB flag (e.g., the multi-source flag, x) 910 based on the low band voicing (w) 902, the previous frame's gain frame 904, and the high-band mid channel 292, as further described herein.

The high band mixing gains estimator 912 is configured to receive low band voicing factors (z) 908 and the non harmonic HB flag (x) 910. The high band mixing gains estimator 912 is configured to generate mixing gains (e.g., a first gain "Gain(1)" (encoder) and a second gain "Gain(2)" (encoder)) based on the low band voicing factors (z) 908 and the non harmonic HB flag (x) 910, as further described herein. It is noted that mixing at a high band excitation generator of the decoder is performed based on Gain(1) (decoder) and the Gain(2) (decoder), as described with reference to FIG. 10.

As described above with reference to FIG. 2B, in a TD-BWE encoding process, the low-band excitation 232 is non-linearly extended by the non-linear BWE generator 253 to generate the harmonic high-band excitation 237.

The noise envelope control parameter estimator 916 is configured to receive low band voice factors (z) 914 and the non harmonic HB flag (x) 910. The low band voice factors (z) 914 may be the same as or different from the low band voicing factors (z) 908. The noise envelope control parameter estimator 916 is configured to generate a noise envelope control parameter(s) 918 (encoder) based on the low band voice factors (z) 914 and the non harmonic HB flag (x) 910. The noise envelope control parameter estimator 916 is configured to provide the noise envelope control parameter (s) 918 (encoder) to the noise envelope modulator 256. As used herein, a "parameter (encoder)" refers to a parameter used by an encoder, and a "parameter (decoder)" refers to a parameter used by a decoder.

Envelope modulated noise (e.g., modulated noise 482 (encoder)) is used for generating the noisy component of the high-band excitation 276. For example, an envelope used by the noise envelope modulator 256 (to generate the modulated noise 482 (encoder)) may be extracted based on the harmonic high-band excitation 237. The envelope modulation is performed by the noise envelope modulator 256 by applying a low pass filter on the absolute values of the harmonic high-band excitation 237. The low pass filter parameters are determined based on the noise envelope control parameter(s) 918 (encoder) determined by the noise envelope control parameter estimator 916.

Figure 10:
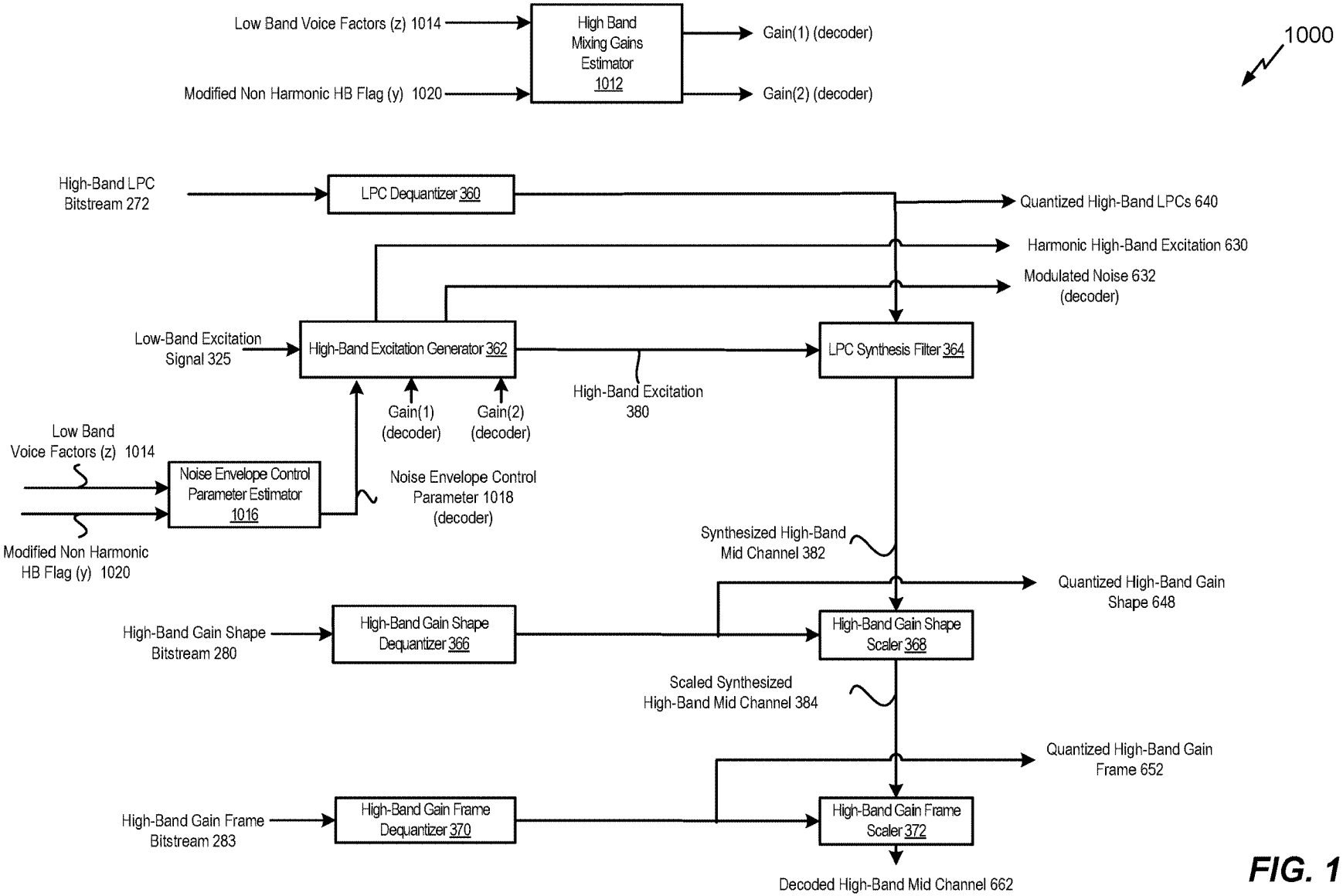
FIG. 10 is a diagram illustrating a mid channel BWE decoder configured to use a flag that indicates a harmonic metric of a high band signal.

It is noted that similar (or the same) envelope modulation is performed at the decoder, such as the decoder 300 of FIG. 1, as described further herein with reference to FIG. 10. The decoder may determine a noise envelope control parameter (decoder) based on low band voice factors and a non harmonic HB flag, such as the non harmonic HB flag (x) 910, the modified non harmonic HB flag (y) 920, or another non harmonic HB flag. In situations where the non harmonic HB flag (x) 910 indicates that the harmonic metric is not harmonic (e.g., strongly non harmonic), the gain-adjusted harmonic high-band excitation 273 may not be generated or the Gain(1) (encoder) may be set to a value of zero.

To illustrate, if the flag (e.g., the non harmonic HB flag (x) 910) indicates that the high-band is harmonic, the noise envelope control parameter(s) 918 (encoder) indicate that the envelope to be applied to the noise 274 is to be a fast-varying envelope (e.g., the noise envelope modulator 256 can use a small length of samples—the noise envelope estimation process for each sample is less heavily reliant on the absolute value of the harmonic HB Excitation's corresponding sample). As another example, if the flag (e.g., the non harmonic HB flag (x) 910) indicates that the high-band is non harmonic, the noise envelope control parameter(s) 918 (encoder) indicate that the envelope to be applied to the noise 274 is to be a slow-varying envelope (e.g., the noise envelope modulator 256 can use a large length of samples—the noise envelope estimation process for each sample is more heavily reliant on the absolute value of the harmonic HB Excitation's corresponding sample). In another example, the flag (e.g., the non harmonic flag or the multi-source flag, x) indicates whether multiple audio sources are associated with the high-band mid signal. In an example embodiment, the non harmonic flag or the multi-source flag (x) is used to control the noise envelope parameter 916, 1016, and the Gain (1) and Gain(2) for the high-band exictataion generation 299, 362. The noise envelope modulator 256 may apply the envelope (e.g., based on the noise envelope control parameter(s) 918) to the noise 274 to generate the modulated noise 482 (encoder).

The high-band excitation 276 (e.g., a mixed HB excitation determined based on the harmonic high-band excitation 237, Gain1 (encoder), the modulated noise 482 (encoded), and Gain2 (encoder)) is used for further processing. For example, based on the high-band mid channel 292, the encoder 900 may estimate and quantize one or more LPCs to be applied to the high-band excitation 276 to generate the synthesized high-band mid channel 277. Based on the high-band mid channel 292 and the synthesized high-band mid channel 277, high band gain shapes and high band gain frame are further extracted and quantized for transmission to the decoder, such as the decoder 300 of FIG. 1.

The non harmonic high band flag modifier 922 is configured to receive the high-band gain frame parameters 282 and the non harmonic HB flag (x) 910. The non harmonic high band flag modifier 922 is configured to generate a modified non harmonic HB flag (y) 920 based on the high-band gain frame parameters 282 and the non harmonic HB flag (x) 910. For some frames, the non harmonic HB flag (x) 910 and the modified non harmonic HB flag (y) 920 may indicate the same harmonic metric for the high-band (e.g., the non harmonic HB flag (x) 910 and the modified non harmonic HB flag (y) 920 may have the same value). For other frames, the non harmonic HB flag (x) 910 and the modified non harmonic HB flag (y) 920 may indicate different harmonic metrics for the high-band (e.g., the non harmonic HB flag (x) 910 and the modified non harmonic HB flag (y) 920 may have different values). Although modification of the non harmonic HB flag (x) 910 is described as being based on the high-band gain frame parameters 282 (e.g., pre-quantized HB gain frame parameters), in other implementations, the non harmonic HB flag (x) 910 may be modified based on the high-band gain frame bitstream 283 (e.g., quantized HB gain frame parameters) or both the high-band gain frame bitstream 283 (e.g., the quantized HB gain frame parameters) and the high-band gain frame parameters 282 (e.g., pre-quantized HB gain frame parameters). Additionally, it is noted that modification of the non harmonic HB flag (x) 910 is optional. In some implementations, such as stereo operation implementations, the encoder 900 (e.g., a TD-BWE encoder) outputs one or more other parameters for use in in the ICBWE as described with reference to FIGS. 2B and 11.

Referring to FIG. 10, a particular implementation of a decoder 1000 is shown. The decoder may include or correspond to the decoder 300 of FIG. 1 or the ICBWE decoder 306 of FIG. 3. The decoder 1000 includes the LPC dequantizer 360, the high-band excitation generator 362, the LPC synthesis filter 364, the high-band gain shape dequantizer 366, the high-band gain shape scaler 368, the high-band gain frame dequantizer 370, the high-band gain frame scaler 372, a high band mixing gains estimator 1012, and a noise envelope control parameter estimator 1016. In some implementations, the decoder 1000 is a TD-BWE decoder used for mid signal high band coding (e.g., mid channel BWE decoding).

The decoder 1000 is configured to receive one or more bitstreams. The one or more bit streams may include the high-band LPC bitstream 272, the high-band gain shape bitstream 280 and the high-band gain frame bitstream 283. The decoder 1000 is further configured to receive a modified non harmonic HB flag (y) 1020. The modified non harmonic HB flag (e.g., the multi-source flag, y) 1020 may include or correspond to the non harmonic HB flag (x) 910 or the modified non harmonic HB flag (y) 920. For example, the decoder 1000 may receive the modified non harmonic HB flag (y) 920 (from the encoder 900) as the modified non harmonic HB flag (y) 1020.

In other implementations, the decoder 1000 may receive the non harmonic HB flag (x) 910 (from the encoder 900) and may generate the modified non harmonic HB flag (y) 1020. For example, the decoder 1000 may include a non harmonic high band flag modifier, such as the non harmonic high band flag modifier 922 of FIG. 9, and may receive the non harmonic HB flag (x) 910. In this example, the decoder 1000 may also receive a high band gain frame parameter, such as the high-band gain frame parameters 282 from the encoder 900, and the decoder 1000 may determine the non harmonic HB flag (y) 1020 based on the high band gain frame parameter and the non harmonic HB flag (x) 910. In some implementations, the decoder 1000 is configured to generate the modified non harmonic HB flag (y) 1020 independent of the non harmonic HB flag (x) 910 and the modified non harmonic HB flag (y) 920.

The decoder 1000 may also receive low band voice factors (z) 1014. The low band voice factors (z) 1014 may include or correspond to the low band voice factors (z) 914 of FIG. 9. In some implementations, the decoder 1000 may receive the low band voice factors (z) 914 as the low band voice factors (z) 1014. In other implementations, the decoder 1000 may calculate the low band voice factors (z) 1014 or may receive the low band voice factors (z) 1014 from another component, such as the low-band decoder 304, the mid channel BWE decoder 302, or the ICBWE decoder 306 of FIG. 3A.

The decoder 1000 may perform operations similar to those described with reference to the ICBWE decoder 306 of FIGS. 3A and 3B and similar to those described with reference to the encoder 900 of FIG. 9. For example, the high band mixing gains estimator 1012 may perform operations similar to those described with reference to the high band mixing gains estimator 912 of FIG. 9. To illustrate, the high band mixing gains estimator 1012 may receive the low band voice factors (z) 1014 and the modified non harmonic HB flag (y) 1020. Based on the low band voice factors (z) 1014 and the modified non harmonic HB flag (y) 1020, the high band mixing gains estimator 1012 generates mixing gains (e.g., Gain(1) (decoder) and Gain(2) (decoder)), as further described herein. The mixing gains (e.g., Gain(1) (decoder) and Gain(2) (decoder)) are provided to the high-band excitation generator 362. The high-band excitation generator 362 may correspond to the high-band excitation generator 299 of FIG. 9 and perform operations similar to those described with respect to the high-band excitation generator 299 of FIG. 9.

The noise envelope control parameter estimator 1016 may perform operations similar to the noise envelope control parameter estimator 916 of FIG. 9. To illustrate, the noise envelope control parameter estimator 1016 receives the low band voice factors (z) 1014 and the modified non harmonic HB flag (y) 1020. The noise envelope control parameter estimator 1016 generates the noise envelope control parameter 1018 (decoder) based on the low band voice factors (z) 1014 and the modified non harmonic HB flag (y) 1020, similar to the generation of the noise envelope control parameter(s) 918 described with reference to FIG. 9.

Based on the modified non harmonic HB flag (y) 1020, the decoder 1000 generates a high-band excitation 380. Generation of the high-band excitation 380 my include the high-band excitation generator 362 generating modulated noise and performing a mixing operation to generate the high-band excitation 380. The modulated noise may be generated based on the noise envelope control parameter 1018 (decoder). The mixing operation may be performed based on Gain(1) (decoder) and Gain(2) (decoder), as described with reference to FIG. 9.

Based on the generated high-band excitation 380, decoder values of the gain frame and the gain shapes, and other parameters from the BWE bitstream are determined. Additionally, the decoder 1000 generates the decoded high-band mid channel 662. For example, dequantized high-band LPCs 640, dequantized high-band gain shape 648, and dequantized high-band gain frame 652 are used to generate the decoded high-band mid channel. It is noted that since the modified non harmonic HB flag (y) 1020 used by the decoder 1000 may differ (in value for a particular frame) from the non harmonic HB flag (x) 910 and the modified non harmonic HB flag (y) 920 used by the encoder 900, the high-band excitation 276 on which the gain frame and gain shapes are estimated at the encoder 900 may be different from the high-band excitation 380 on which the gain frame and gain shapes are applied at the decoder 1000.

In some implementations, the decoder 1000 (e.g., a TD-BWE decoder) also outputs some other parameters which are used in the ICBWE decoding in case of stereo operation, as described with reference to FIGS. 3A, 3B, and 6.

In stereo encoding and decoding, envelope shape modulated noise for the ICBWE, the target high band channel, and the mid channel may be similar or may differ for the different channels. Also, mixing gains may differ for the mid channel, the ICBWE, and the target high band channel, and may be determined as described in FIGS. 11-12.

As described with reference to FIGS. 9 and 10, BWE may be performed with different non-linear mixing, different non-linear configurations, etc., based on the value of the flag, such as the non harmonic HB flag (x) 910. For example, the value of the flag may indicate the presence of multiple sources or multiple objects, etc., that may correspond to different coding modes (e.g., voiced, unvoiced, background, etc.). Thus, the non harmonic HB flag (x) 910 may be referred to as a multi-source flag. As a result, enhanced coding and reproduction may be achieved by the encoder/decoder of FIGS. 9-12.

Figure 11:
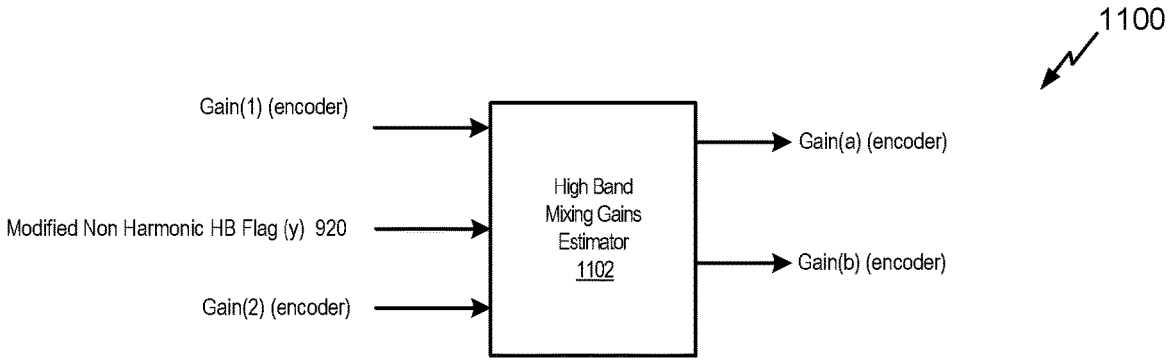
FIG. 11 is a diagram illustrating a third portion of an inter-channel bandwidth extension encoder of the encoder of FIG. 1 that is configured to use a flag that indicates a harmonic metric of a high band signal.

Referring to FIG. 11, a particular implementation of a third portion 1100 of an inter-channel bandwidth extension encoder of the encoder of FIG. 1 is shown. In some implementations, the third portion 1100 is included in the ICBWE encoder 204.

The third portion 1100 includes a high band mixing gains estimator 1102. The high band mixing gains estimator 1102 is configured to receive the mixing gains (e.g., Gain(1) (encoder) and Gain(2) (encoder)), described with reference to FIGS. 2B and 9, and to receive the modified non harmonic HB flag (y) 920, described with reference to FIG. 9. The high band mixing gains estimator 1102 is configured to generate Gain(a) (encoder) and Gain(b) (encoder), which may be provided to the non-reference high-band excitation generator 408 of FIG. 4.

In some implementations, the Gain(a) (encoder) and the Gain(b) (encoder) are determined based on the relative energies of the HB reference and non reference channels, the noise floor of the HB non reference channel, etc. Additionally, or alternatively, the Gain(a) (encoder) and the Gain(b) (encoder) may be the same as the Gain(1) (encoder) and the Gain(2) (encoder) described with reference to FIGS. 2B and 9. In other implementations, the Gain(a) (encoder) and Gain(b) (encoder) are an average value of Gain(1) (encoder) and Gain (2) (encoder) respectively estimated in multiple subframes per each processing frame, and these values are modified further based on the modified non harmonic HB flag (y) 920. It should be noted that in some alternate implementations, the high band mixing gains estimator 1102 may determine the values of Gain(a) (encoder) and Gain(b) (encoder) based on the non harmonic HB flag (x) 910.

Figure 12:
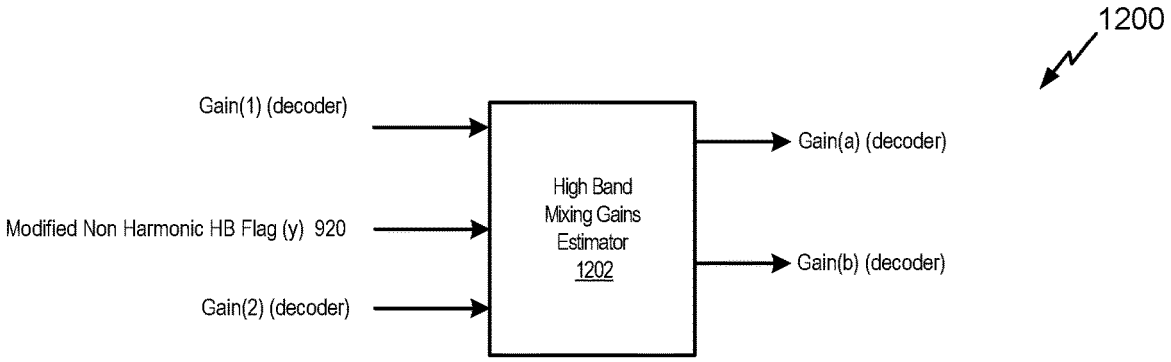
FIG. 12 is a diagram illustrating a portion of an inter-channel bandwidth extension decoder of FIG. 1 that is configured to use a flag that indicates a harmonic metric of a high band signal.

Referring to FIG. 12, a particular implementation of a portion 1200 of an inter-channel bandwidth extension decoder of the decoder of FIG. 1 is shown. In some implementations, the portion 1200 is included in the ICBWE decoder 306.

The portion 1200 includes a high band mixing gains estimator 1202. The high band mixing gains estimator 1202 is configured to receive the mixing gains (e.g., Gain(1) (decoder) and Gain(2) (decoder)), described with reference to FIGS. 3B and 10, and to receive the modified non harmonic HB flag (y) 920, described with reference to FIGS. 9 and 10. The high band mixing gains estimator 1202 is configured to generate Gain(a) (decoder) and Gain(b) (decoder). The Gain(a) (decoder) and the Gain(b) (decoder) may be provided to the non-reference high-band excitation generator 602 of FIG. 6. In other implementations, the Gain (a) (decoder) and Gain (b) (decoder) are an average value of Gain(1) (decoder) and Gain (2) (decoder) respectively estimated in multiple subframes per each processing frame, and these values are modified further based on the modified non harmonic HB flag (y) 1020. It should be noted that in some alternate implementations, the high band mixing gains estimator 1202 may determine the values of Gain(a) (decoder) and Gain(b) (decoder) based on the non harmonic HB flag (x) equivalent either transmitted from an encoder or estimated at the ICBWE decoder 306 itself.

In an illustrative implementation of aspects described above, the following example is provided along with pseudo-code related to generation, use, and modification of the flag (e.g., the non harmonic HB flag (x) 910), the modified flag (e.g., the modified non harmonic HB flag (y) 920), or both. An example of how the non harmonic HB flag (e.g., the non harmonic HB flag (x) 910) is identified and how the non harmonic HB flag (e.g., the non harmonic HB flag (x) 910) is modified are described below.

In a particular implementation, an estimation of high-band (HB) Energy (denoted HB_Energy) of a frame is determined. It is noted that Energy and power (e.g., which may be the square root of Energy) are used interchangeably. Additionally, a Long Term HB Energy (denoted HB_Energy_LongTerm) is retrieved. The Long Term HB Energy may have been smoothed over multiple frames. A ratio may be calculated as: ratio=(HB_Energy)/(HB_Energy_LongTerm).

An average of the LB voicing is determined based on a strength of correlation of the LB signal at pitch lag. Voicing is different from voice factors: a voice factor is a parameter of the algebraic code-excited linear prediction (ACELP) coding method of mid LB which signifies the ratio of a mixture of the adaptive codebook gain and the fixed codebook gain). Additionally, a previous (e.g., most recent) frame's gain frame may be retrieved.

The HB energy ratio, the average of the LB voicing, and the previous frame's gain frame may be used to calculate the likelihood (denoted pu below) of the HB being non harmonic based on a Gaussian Mixture Model (GMM) with pre-computed mean and covariance components for non harmonic HB signals. Additionally, the ratio, the average of the LB voicing, and the previous frame's gain frame may be used to calculate the likelihood (denoted pv below) of the HB being harmonic based on a Gaussian Mixture Model with pre-computed mean and covariance components for harmonic HB signals. Based on these likelihoods (pu and pv), different possible relations between these likelihoods may be classified as varying levels of harmonicity of HB.

To further illustrate, examples below depict illustrative pseudo-code (e.g., simplified C-code in floating point) that may be compiled and stored in a memory, such as the memory 153 of the first device 104 or a memory of the second device 106 of FIG. 1, or the memory 1832 of FIG. 18. The pseudo-code illustrates a possible implementation of aspects described herein. The pseudo-code includes comments which are not part of the executable code. In the pseudo-code, a beginning of a comment is indicated by a forward slash and asterisk (e.g., "/*") and an end of the comment is indicated by an asterisk and a forward slash (e.g., "*/"). To illustrate, a comment "COMMENT" may appear in the pseudo-code as /*COMMENT*/.

In the provided example, the "==" operator indicates an equality comparison, such that "A==B" has a value of TRUE when the value of A is equal to the value of B and has a value of FALSE otherwise. The "&&" operator indicates a logical AND operation. The "||" operator indicates a logical OR operation. The ">" operator represents "greater than", the ">=" operator represents "greater than or equal to", and the "<" operator indicates "less than". The term "f" following a number indicates a floating point (e.g., decimal) number format.

In the provided example, "*" may represent a multiplication operation, "+" or "sum" may represent an addition operation, "abs" may represent an absolute value operation, "avg" may represent an average operation, "++" may indicate an increment, "−" may indicate a subtraction operation, and "/" may represent a division operation. The "=" operator represents an assignment (e.g., "a=1" assigns the value of 1 to the variable "a").

Example 1A is presented below which classifies different possible relations between likelihoods as varying levels of harmonicity of a high-band. In a particular implementation, the operations of Example 1A are performed by the non harmonic high band detector 906 of FIG. 9.

Example 1A

```
    if (pv < 0.1 && pu > 0.1 || Prev_Frame's_Non_Harmonic_HB_Flag == 1 &&
pu*2.4479 > pv)          /*previous frame's non harmonic high-band flag is denoted
as "Prev_Frame's_Non_Harmonic_HB_Flag" */
        {
            Non_Harmonic_HB_Flag = 1; /* Indicates strong Non-Harmonic HB
*/
        }
        else if (pu < 0.2f && pv > 0.5f ||
Prev_Frame's_Non_Harmonic_HB_Flag == 0 && pu*2.4479 < pv)
        {
            Non_Harmonic_HB_Flag = 0; /* Indicates strong Harmonic HB */
        }
        else
        {
            Non_Harmonic_HB_Flag = 2; /* Indicates strong Weak Non-
Harmonic HB */
        }
```

Example 1B is presented below which classifies different possible relations between likelihoods as one of two different levels of harmonicity of a high band. For example, the non-harmonic HB flag may indicate harmonic or non harmonic. In a particular implementation, the operations of Example 1B are performed by the non harmonic high band detector 906 of FIG. 9.

Example 1B

```
hCPE->hStereoICBWE->MSFlag = 0;      /* Init the multi-source flag */
v = 0.3333f * sum_f(voicing, 3);     /* This is the average low band voicing */
t = log10( (hCPE->hStereoICBWE->icbweRefEner + 1e-6f) / (lbEner + 1e-6f) );
/* Spectral Tilt */
/* Three Level Decision Tree to calculate a regression (regression is an
indicator of the likelihood of non-harmonic HB content) value first */
/* Pre-determined thresholds for the decision tree is stored in the thr[ ]
array. Pre-determined regression values based on the conditions satisfied
are present in the regV[ ] array */
if( t < thr[0] )
{
    if( t < thr[1] )
    {
        regression = (v < thr[3]) ? regV[0] : regV[1];
    }
    else
    {
        regression = (v < thr[4]) ? regV[2] : regV[3];
    }
}
else
{
    if( t < thr[2] )
    {
        regression = (v < thr[5]) ? regV[4] : regV[5];
    }
    else
    {
        regression = (v < thr[6]) ? regV[6] : regV[7];
    }
}
/* Convert the regression to a hard decision (classification) */
if( regression > 0.79f && !( st->bwidth < SWB || hCPE->vad_flag == 0 ) )
/* When regression is quite high and when the frame has SWB content or
higher and when the current frame is an active frame, choose MSFlag = 1
indicating Non-Harmonic content */
{
    MSFlag = 1;
}
```

Example 2 is presented below which extracts the noisy envelope based on the noisy envelope control parameter and applies it on the white noise signal. Example 2 also includes operations to determine a noise envelope control parameter, such as the noise envelope control parameter(s) 918 (encoder) or the noise envelope control parameter 1018 (decoder). In a particular implementation, the operations of Example 2 are performed by the noise envelope control parameter estimator 916 and the noise envelope modulator 256 of FIG. 9 or the noise envelope control parameter estimator 1016 and the high-band excitation generator 362 of FIG. 10. Although Example 2 includes a non harmonic flag having at least three possible values, in other implementations, similar operations may be performed based on a non harmonic flag having two possible values. Additionally or alternatively, similar operations may be performed based on the multi-source flag MSFlag of Example 1B.

Example 2

```
/* Noise Envelope Control Parameter estimation */
if (Non_Harmonic_HB_Flag > 0) /* Indicating that the HB is not strongly
harmonic. In other words, the value of the flag > 0 means that the HB is at
least weakly non harmonic */
{
    temp = 0.995f;
    filter_numerator = 1.0f - temp; /* Control parameter 1 */
    filter_denominator = -temp; /* Control parameter 2 */
}
else
{
  temp = 1.09875f - 0.49875f * average(voice_factors);
  filter_numerator = 1.0f - temp; /* Control parameter 1 */
  filter_denominator = -temp; /* Control parameter 2 */
}
/* Noise Envelope Modulator - Extract Envelope based on the filter
coefficients */
for( k = 0; k < FrameLength; k++ )
{
    Noise_Envelope[k] = temp + filter_numerator *
abs(Harmonic_Excitation[k]);
    temp = - filter_denominator * Noise_Envelope[k];
}
/* Noise Envelope Modulator - Apply Envelope on the random noise */
for( k = 0; k < FrameLength; k++ )
{
    Modulated_Noise[k] = Random_Noise[k] * Noise_Envelope[k];
}
```

Control of how the noise envelope is estimated based on the Non_Harmonic_HB_Flag enables control the envelope of the noise, which in effect controls the "buzziness" of the decoded high-band signal. The more harmonic a signal, the "buzzier" the signal tends to be. Alternatively, the less harmonic a signal, the less "buzzier" (and the more clear) the signal tends to be. With respect to the pseudo-code of Example 2, when implemented at a decoder, such as the decoder 300 or the decoder 1000, the Non Harmonic HB Flag is replaced by the received Non Harmonic HB Flag, which may be either the same or it may be the modified non harmonic HB Flag. In other implementations, when implemented at the decoder, the Non Harmonic HB Flag is determined at the decoder.

Example 3 is presented below which the excitation mixing (e.g., gains) is based on the Non Harmonic HB Flag. In a particular implementation, the operations of Example 3 are performed by the high-band excitation generator 299 of FIG. 9 or the high-band excitation generator 362 of FIG. 10. Although Example 3 includes a non harmonic flag having at least three possible values, in other implementations, similar operations may be performed based on a non harmonic flag having two possible values. Additionally or alternatively, similar operations may be performed based on the multi-source flag MSFlag of Example 1B.

Example 3

```
if (Non_Harmonic_HB_Flag == 1) /* A value of 1 for this flag implies that the HB
is strongly non harmonic */
    {
        /* Strongly Non harmonic. So, directly use scaled modulated noise and do
not mix any harmonic excitation component */
        scale = square_root(
Energy(Harmonic_HB_Excitation)/Energy(Modulated_Noise) );
        for( k = 0; k < FrameLength; k++ )
        {
            High_Band_Excitation[k] = Modulated_Noise[k] * scale;
        }
    }
    else
    {
            /* Actually, mix the harmonic and noisy components */
            if (Non_Harmonic_HB_Flag == 2) /* Indicates that the HB is weakly Non
Harmonic */
            {
                /* Since HB is weakly non Harmonic, we use only half the value
that would have been used for the case when HB is strongly harmonic */
                temp = sqrt( voice_factors) * 0.5f;
```

-continued

```
            }
            else /* Non_Harmonic_HB_Flag == 0 – Implies that the HB is strongly
Harmonic */
            {
                temp = sqrt( voice_factors);
            }
            Gain1 = square_root (temp);
            Gain2 = square_root (1.0f – vf_tmp) * square_root(
Energy(Harmonic_HB_Excitation)/Energy(Modulated_Noise) );
              for( k=0; k < FrameLength; k++ )
              {
                  High_Band_Excitation[k] = Gain1 * Harmonic_HB_Excitation[k] +
Gain2 * Modulated_Noise[k];
              }
        }
```

Figure 13:
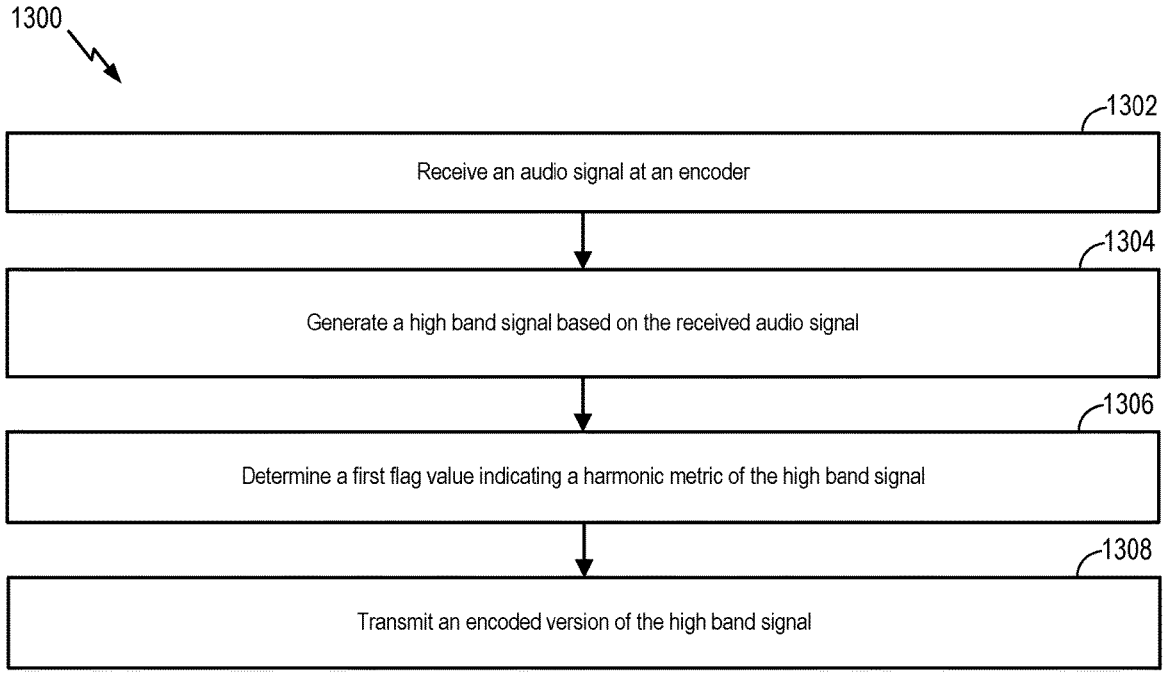
FIG. 13 is a particular example of a method of determining a flag value indicating a harmonic metric of a high band signal.

Referring to FIG. 13, a method 1300 of audio signal encoding is shown. The method 1300 may be performed by the first device 104 of FIG. 1. In particular, the method 1300 may be performed by the encoder 200, such as at the encoder 900 of FIG. 9 (e.g., a mid channel BWE encoder).

The method 1300 includes receiving an audio signal at an encoder, at 1302. For example, in a stereo implementation, the audio signal may correspond to the mid channel 222 of FIG. 2 that is received at the encoder 900. In a non-stereo implementation, the audio signal may correspond to an audio signal received via the first audio channel 130 or the second audio channel 132 of FIG. 1.

The method 1300 includes generating a high band signal based on the received audio signal, at 1304. For example, in a stereo implementation, the high band signal may correspond to the high-band mid channel 292 of FIG. 2, The method 1300 also includes determining a first flag value indicating a harmonic metric of the high band signal, at 1306. For example, the first flag value may correspond to a value of the non harmonic HB flag (x) 910 of FIG. 9. The harmonic metric may be determined to have a value of strong harmonic, weak harmonic, or strong non-harmonic. Alternatively, the harmonic metric may be determined to have a value of harmonic or non harmonic.

In some implementations, an encoded version of the high band signal may be transmitted, at 1308. For example, the encoded version of the high band signal may correspond to the high-band mid channel bitstream 244, the ICBWE bitstream 242, the down-mix bitstream 216, or any combination thereof, of FIG. 2.

The method 1300 may also include generating a low band signal based on the received audio signal (e.g., the low-band mid channel 294 of FIG. 2A) and determining the flag value at least partially based on a low band voicing value (e.g., the low band voicing (w) 902 of FIG. 9) of the low band signal. A gain frame value (e.g., the high-band gain frame parameters 282 of FIG. 9) corresponding to a first frame of the audio signal may be determined, and the first flag value corresponding to a second frame that follows the first frame of the audio signal may be determined at least partially based on the gain frame value of the first frame (e.g., the previous frame's gain frame 904 of FIG. 9).

The first flag value may be determined at least partially based on a ratio of an energy metric of a frame of the high band signal (e.g., the high-band mid channel 292 of FIG. 9) to a multi-frame energy metric of the high-band signal, such as described with reference to the non harmonic high band detector 906 of FIG. 9.

A high band excitation signal may be generated based on a harmonically extended low band excitation signal and further based on the first flag value to generate a synthesized version of the high band signal, such as the scaled synthesized high-band mid channel 281 of FIG. 9 generated using the high-band excitation 276 that is based on the harmonic high-band excitation 237 and using mixing gains and noise envelope control parameter(s) 918 that are based on the non harmonic HB flag (x) 910. The encoder may modify the first flag value based on a gain frame parameter corresponding to the synthesized version exceeding a threshold, such as at the non harmonic high band flag modifier 922.

The method 1300 may be performed at a stereo encoder that receives the audio signal (e.g., the first audio channel 130) and a second audio signal (e.g., the second audio channel 132) and generates a mid signal (e.g., the mid channel 222) based on the audio signal and the second audio signal. The high band signal may correspond to a high-band portion of the mid signal (e.g., the high-band mid channel 292 of FIG. 2 and FIG. 9). As an example, the first flag value may be used to generate the high-band excitation 276 in the BWE encoder of FIG. 9. As another example, the first flag value may be used to generate a non-reference high band excitation signal at least partially based on the first flag value during an inter-channel band width extension (ICBWE) encoding operation (e.g., the non-reference high-band excitation 638 of FIG. 6 generated using mixing gains from the high band mixing gains estimator 1102 of FIG. 11).

The method 1300 may enable improved encoding accuracy based on the first flag value indicating a harmonic metric of the high band signal. For example, the first flag value may be used to control generation the high-band excitation 276, such as depicted with reference to the high-band excitation generator 299 of FIG. 9. Enhanced encoding accuracy may enable improved accuracy of audio playback at a decoding device, such as the second device 106 of FIG. 1.

Figure 14:
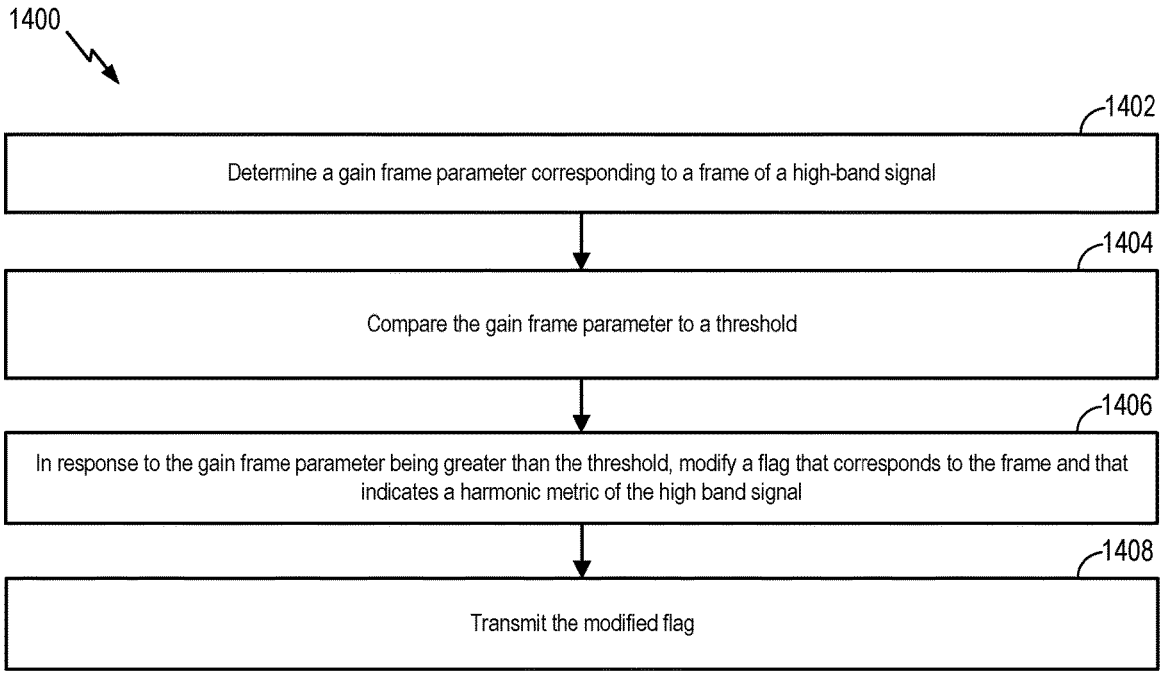
FIG. 14 is a particular example of a method of modifying a flag that indicates a harmonic metric of a high band signal.

Referring to FIG. 14, a method 1400 of audio signal encoding is shown. The method 1400 may be performed by the first device 104 of FIG. 1. In particular, the method 1400 may be performed by the encoder 200, such as at the encoder 900 of FIG. 9 (e.g., a mid channel BWE encoder).

The method 1400 includes determining a gain frame parameter corresponding to a frame of a high band signal, at 1402. For example, the gain frame parameter may correspond to one or more of the high-band gain frame parameters 282 of FIG. 9. The gain frame parameter may be generated by generating a high-band excitation signal (e.g., the high-band excitation 276 of FIG. 9) based on a low-band excitation signal and based on a flag (e.g., the non harmonic HB flag (x) 910 of FIG. 9), generating a synthesized version of the high-band signal (e.g., the scaled synthesized high-band mid channel 281 of FIG. 9) based on the high-band excitation signal, and comparing the frame of the high-band signal to a frame of the synthesized version of the high-band signal (e.g., to generate the high-band gain frame parameters 282).

The method 1400 includes comparing the gain frame parameter to a threshold, at 1404. For example, referring to FIG. 9, the non harmonic high band flag modifier 922 may compare one or more of the high-band gain frame parameters to a threshold amount. For example, a relatively large value of the high-band gain frame parameter may indicate that a frame of a high band signal that is predicted to be strongly harmonic may instead be non-harmonic.

The method 1400 includes, in response to the gain frame parameter being greater than the threshold, modifying a flag that corresponds to the frame and that indicates a harmonic metric of the high band signal. In some implementations, the flag (e.g., the non harmonic HB flag (x) 910 of FIG. 9) may be modified from having a first value indicating the high band signal is harmonic to having a second value indicating the high band signal is non-harmonic.

The method 1400 further includes, transmitting the modified flag, at 1408. For example, the modified flag (e.g., the modified non harmonic HB flag (y) 920 of FIG. 9) may be transmitted to the second device 106 via the high-band mid channel bitstream 244, the ICBWE bitstream 242, the down-mix bitstream 216, or any combination thereof, of FIG. 2.

The method 1400 may enable improved encoding accuracy by correcting flag values that are determined to incorrectly indicate a harmonic metric of the high band. The modified flag value may be used in additional encoding, such as to determine mixing gain values for inter-channel BWE encoding, as described with reference to FIGS. 2, 6, and 11. Sending the modified flag value to a decoder may enable the decoder to generate a more accurate synthesized version of an audio signal at the decoder. Enhanced decoding accuracy may enable improved accuracy of audio playback at a decoding device.

Figure 15:
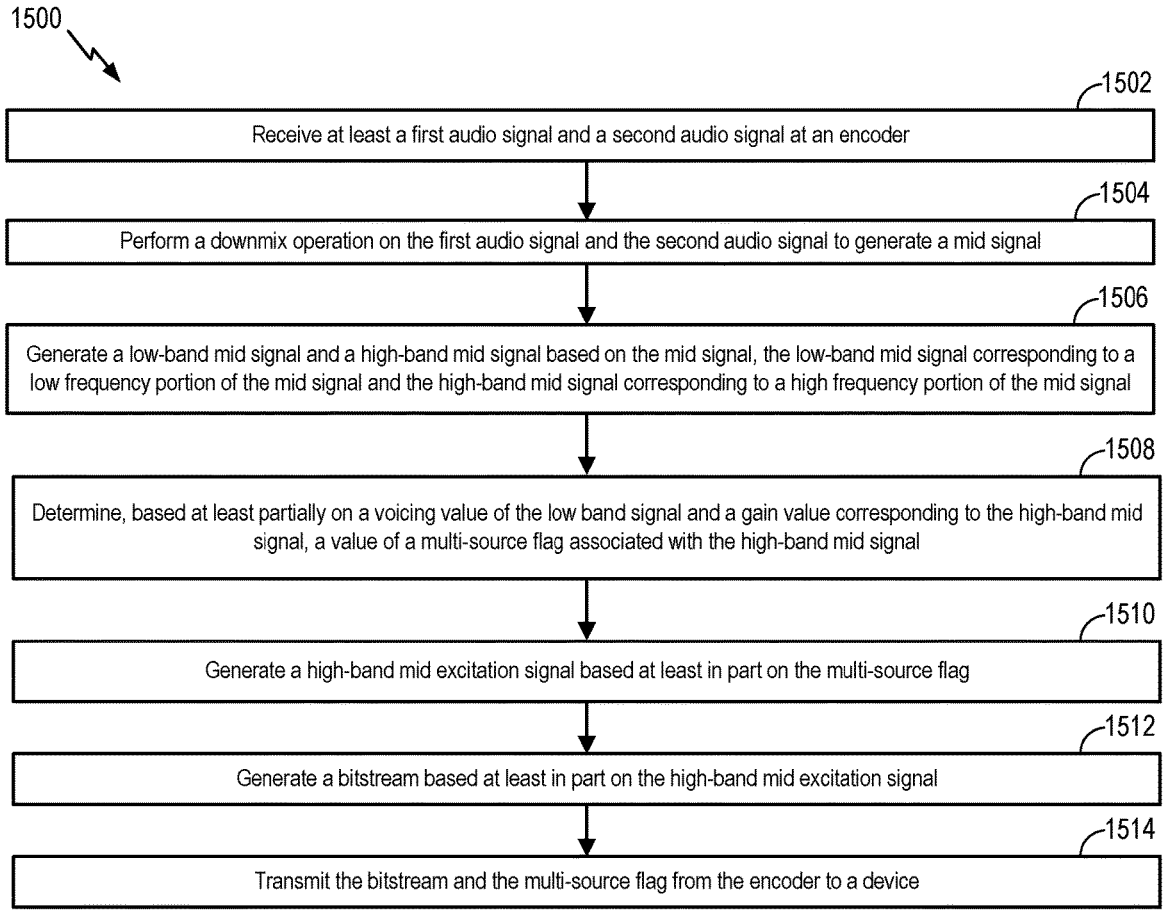
FIG. 15 is a particular example of a method of generating a high band signal based at least partially on a flag that indicates a harmonic metric of the high band signal.

Referring to FIG. 15, a method 1500 of audio signal encoding is shown. The method 1500 may be performed by the first device 104 of FIG. 1. In particular, the method 1500 may be performed by the encoder 200, such as at the encoder 900 of FIG. 9 (e.g., a mid channel BWE encoder).

The method 1500 includes receiving at least a first audio signal and a second audio signal at an encoder, at 1502. For example, in a stereo implementation, the first audio signal may correspond to the left channel of FIG. 2 and the second audio signal may correspond to the right channel of FIG. 2.

The method 1500 includes performing a downmix operation on the first audio signal and the second audio signal to generate a mid signal, at 1504. For example, the mid signal may correspond to the mid channel 222 of FIG. 2. The downmix operation may be performed by the downmixer 202 of FIG. 2.

The method 1500 includes generating a low-band mid signal and a high-band mid signal based on the mid signal, at 1506. For example, the low-band mid signal may correspond to the low-band mid channel 294 of FIG. 2, and the high-band mid signal may correspond to the high-band mid channel 292 of FIG. 2. The low-band mid signal corresponds to a low frequency portion of the mid signal, and the high-band mid signal corresponds to a high frequency portion of the mid signal.

The method 1500 includes determining, based at least partially on a voicing value of the low band signal and a gain value corresponding to the high-band mid signal, a value of a multi-source flag associated with the high-band mid signal, at 1508. For example, the flag may correspond to a value of the non harmonic HB flag (x) 910 of FIG. 9, which may be referred to as a multi-source flag. In a particular implementation, the multi-source flag indicates whether multiple audio sources are associated with the high-band mid signal. The value of the flag may be based on the low band voicing (w) 902 and the previous frame's gain frame 904 of FIG. 9.

The method 1500 includes generating a high-band mid excitation signal based at least in part on the multi-source flag, at 1510. For example, the high-band mid excitation signal may include or correspond to the high-band excitation 276 of FIG. 9. In a particular implementation, the encoder may be configured to generate the high band excitation signal by combining a non-linear harmonic excitation signal (e.g., the harmonic high-band excitation 237) and modulated noise (e.g., the modulated noise 482), and the encoder may control mixing of the non-linear harmonic excitation signal and the modulated noise based on the multi-source flag. For example, the encoder may be configured to set a value of at least one of a first gain associated with the non-linear harmonic excitation signal (e.g., Gain(1) of FIG. 9) and a second gain associated with the modulated noise (e.g., Gain(2) of FIG. 9) based on the multi-source flag. As another example, the encoder may be configured to generate modulated noise based on the non-linear harmonic excitation signal (e.g., the harmonic high-band excitation 237) and further based on a noise envelope control parameter (e.g., the noise envelope control parameter(s) 918 of FIG. 9). The noise envelope control parameter may be at least partially based on the multi-source flag (e.g., the noise envelope control parameter estimator 916 is responsive to the non harmonic HB flag (x) 910), and the encoder may be configured to generate the high-band mid excitation signal at least partially based on the modulated noise (e.g., via applying Gain (2) to the modulated noise 482 at the multiplier 258 and combining with an output of the multiplier 255 of FIG. 9 to generate the high-band excitation 276). The noise envelope control parameter may be further based on a low band voice factor, such as one or more of the low band voice factors (z) 914 of FIG. 9.

The method 1500 includes generating a bitstream based at least in part on the high-band mid excitation signal, at 1512. For example, the bitstream may correspond to the high-band mid channel bitstream 244, the ICBWE bitstream 242, the down-mix bitstream 216, or any combination thereof, of FIG. 2A.

The method 1500 further includes transmitting the bitstream and the multi-source flag from the encoder to a device, at 1514. For example, the bitstream may correspond to the high-band mid channel bitstream 244, the ICBWE bitstream 242, the down-mix bitstream 216, or any combination thereof, of FIG. 2A, and the bitstream and the multi-source flag may be transmitted to the second device 106 (e.g., a decoder) of FIG. 1.

The method 1500 may enable improved encoding accuracy based on the flag indicating a harmonic metric of the high band signal that is used to control generation the high-band excitation 276, such as depicted with reference to the high-band excitation generator 299 of FIG. 9. Enhanced encoding accuracy may enable improved accuracy of audio playback at a decoding device, such as the second device 106 of FIG. 1.

Figure 16:
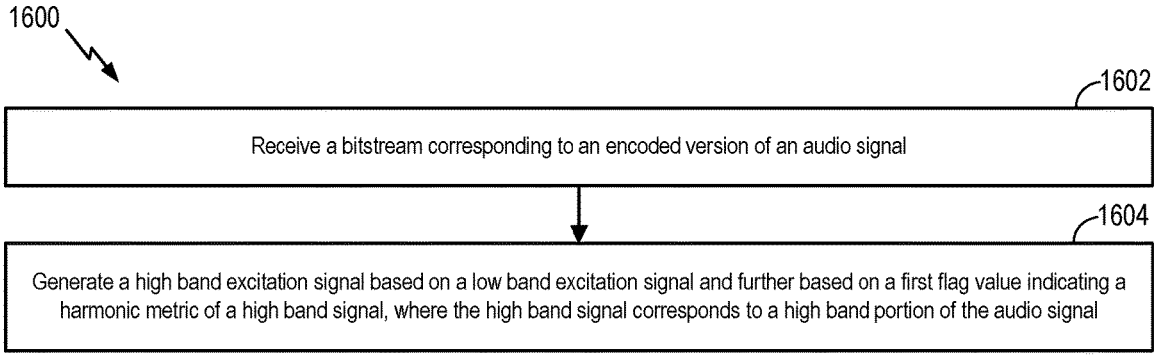
FIG. 16 is a particular example of a method of using a flag that indicates a harmonic metric of a high band portion of an audio signal.

Referring to FIG. 16, a method 1600 of audio signal decoding is shown. The method 1600 may be performed by the second device 106 of FIG. 1. In particular, the method 1600 may be performed by the decoder 300, such as at the decoder 1000 of FIG. 10 (e.g., a mid channel BWE decoder).

The method 1600 includes receiving a bitstream corresponding to an encoded version of an audio signal, at 1602. For example, referring to FIG. 1, the decoder 300 may receive the bitstream including the low-band bitstream 246, the high-band mid channel bitstream 244, the ICBWE bitstream 242, the down-mix bitstream 216, or any combination thereof.

The method 1600 also includes generating a high band excitation signal based on a low band excitation signal and further based on a first flag value indicating a harmonic metric of a high band signal, where the high band signal corresponds to a high band portion of the audio signal, at 1604. To illustrate, the harmonic metric may have a value of strong harmonic, weak harmonic, or strong non-harmonic, such as described with reference to the non harmonic HB flag (x) 910 and the modified non harmonic HB flag (y) 920, 1020 of FIG. 9 and FIG. 10. Alternatively, the harmonic metric may have a value of harmonic or non-harmonic, as described herein.

In some implementations, the bitstream includes the flag value. For example, the mid channel BWE encoder illustrated in FIG. 9 may determine the modified non harmonic HB flag (y) 920 and may transmit the modified non harmonic HB flag (y) 920 (e.g., via data in the bitstream indicating a value of the modified non harmonic HB flag (y) 920) to the decoder 300. In other implementations, the decoder determines the flag value at least partially based on a low band voicing value of a low band signal, where the low band signal corresponds to a low band portion of the audio signal. For example, the mid channel BWE decoder depicted in FIG. 10 may include the non harmonic high band detector 906 and the non harmonic high band flag modifier 922 of FIG. 9 and may determine the non harmonic HB flag (x) 910 (based on the low band voicing, the previous frame's gain frame, and an energy metric of the high-band mid channel) and the modified non harmonic HB flag (y) 1020 (based on a high-band gain frame parameter) during decoding. In other implementations, the bitstream includes a first flag value (e.g., the non harmonic HB flag (x) 910) and the decoder determines a gain frame parameter corresponding to a frame of the high band signal and modifies the first flag value to generate the flag value in response to the gain frame parameter being greater than a threshold (e.g., the decoder of FIG. 10 receives the non harmonic HB flag (x) 910 from an encoder and include the non harmonic high band flag modifier 922 to generate the modified harmonic HB flag (y) 1020).

The high band excitation signal may be generated by non-linearly extending the low band excitation signal and combining the non-linearly extended low band excitation signal with modulated noise, such as at the high-band excitation generator 362 of FIG. 10 functioning in a similar manner as described with reference to the high-band excitation generator 299 of FIG. 9. The method 1600 may include setting a value of at least one of a first gain associated with the non-linearly extended low band excitation signal and a second gain associated with the modulated noise based on the first flag value, such as Gain(1) and Gain(2) output by the high band mixing gains estimator 1012 and input to the high-band excitation generator 362 of FIG. 10. The modulated noise may be generated by non-linearly extending the low band excitation signal and by modulating a noise signal based on the non-linearly extended low band excitation signal and further based on a noise envelope control parameter. The noise envelope control parameter may be at least partially based on the first flag value, such as noise envelope control parameter 1018 of FIG. 10 generated by the noise envelope control parameter estimator 1016 based on the modified non harmonic HB flag (y) 920. The noise envelope control parameter may be further based on the low band voice factor (z) 1014 received at the noise envelope control parameter estimator 1016.

A synthesized version of the high band signal may be generated based on the high band excitation signal. For example, the high-band excitation signal may be used to generate the decoded high-band mid channel 662 of FIG. 3B, FIG. 6 and FIG. 10. The decoded high-band mid channel 662 may be used to generate the left high-band channel 330 and the right high-band channel 332. The synthesized version of the high band signal may be combined with a synthesized version of a low band signal (e.g., the left low-band channel 334 or the right low-band channel 336) to generate a synthesized version of the audio signal (e.g., the left channel 350 or the right channel 352). As another example, the decoder may be a stereo decoder and may generate the high band excitation signal during an inter-channel bandwidth extension (ICBWE) operation, such as the non-reference high-band excitation 638 of the ICBWE decoder 306 of FIG. 6.

The method 1600 may enable improved accuracy of synthesized audio signals where the original audio signal has a non-harmonic high band. Enhanced accuracy may enable an improved user experience during audio playback at a decoding device, such as the second device 106 of FIG. 1.

Figure 17:
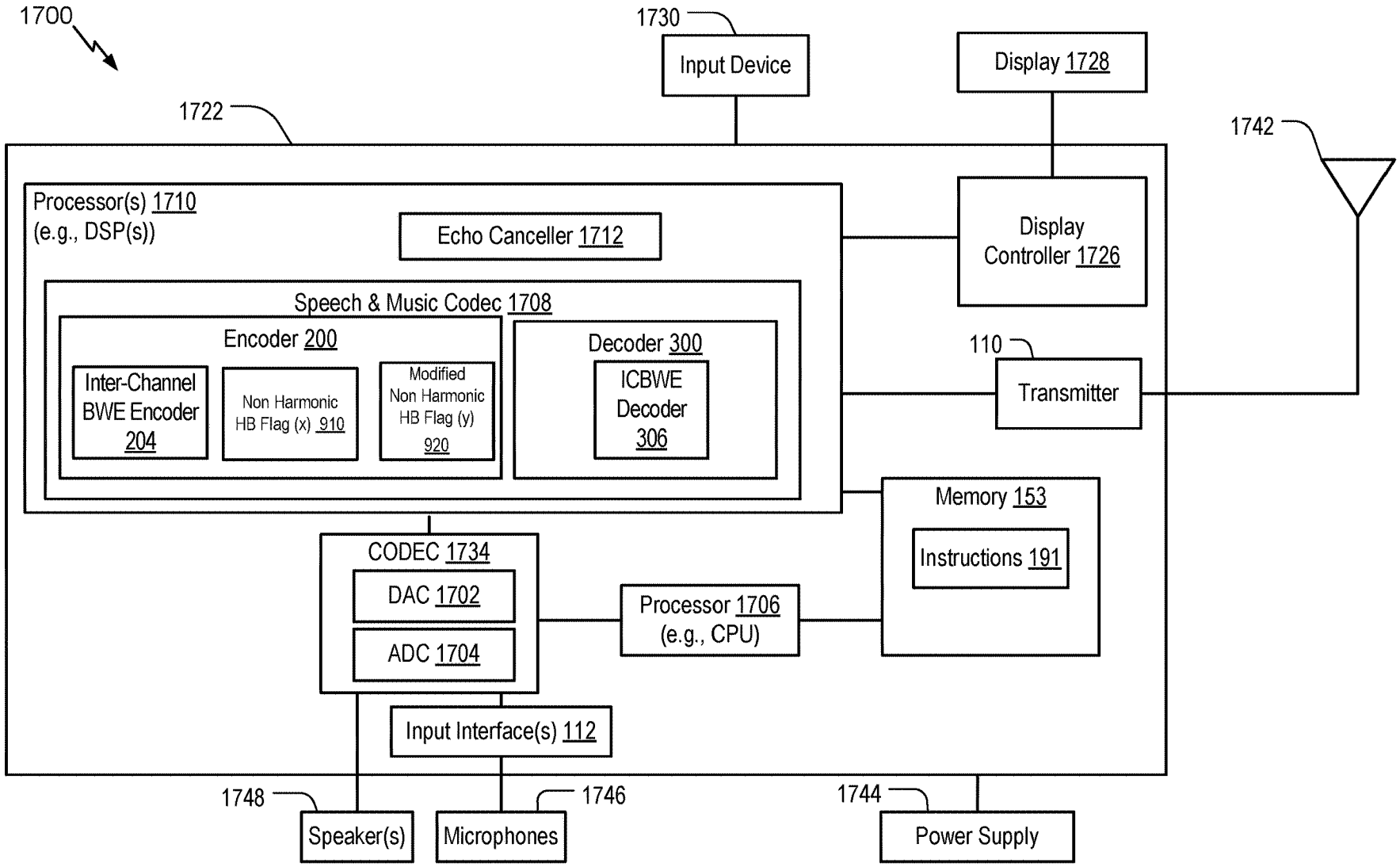
FIG. 17 is a block diagram of a particular illustrative example of a mobile device that is operable to determine a flag value indicating a harmonic metric of a high band signal.

Referring to FIG. 17, a block diagram of a particular illustrative example of a device (e.g., a wireless communication device) is depicted and generally designated 1700. In various implementations, the device 1700 may have fewer or more components than illustrated in FIG. 17. In an illustrative implementation, the device 1700 may correspond to the first device 104 of FIG. 1 or the second device 106 of FIG. 1. In an illustrative implementation, the device 1700 may perform one or more operations described with reference to systems and methods of FIGS. 1-16.

In a particular implementation, the device 1700 includes a processor 1706 (e.g., a central processing unit (CPU)). The device 1700 may include one or more additional processors 1710 (e.g., one or more digital signal processors (DSPs)). The processors 1710 may include a media (e.g., speech and music) coder-decoder (CODEC) 1708, and an echo canceller 1712. The CODEC 1708 may include the decoder 300, the encoder 200, or a combination thereof. The encoder 200 may include the ICBWE encoder 204, and the decoder 300 may include the ICBWE decoder 306. The encoder 200 may be configured to generate the non harmonic HB flag (x) 910. Additionally, in some implementations, the encoder 200 is configured to modify the non harmonic HB flag (x) 910 to generate the modified non harmonic HB flag (y) 920. The encoder 200 may be configured to use the non harmonic HB flag (x) 910, the modified non harmonic HB flag (y) 920, or both, as described herein with reference to at least FIGS. 1 and 9-16. The decoder 300 may be configured to receive or generate a non harmonic HB flag, a modified non harmonic HB flag, or both. The decoder 300 may be configure to use the non harmonic HB flag, the modified non harmonic HB flag, or both, as described herein with reference to at least FIGS. 1 and 9-16.

The device 1700 may include a memory 153 and a CODEC 1734. Although the CODEC 1708 is illustrated as a component of the processors 1710 (e.g., dedicated circuitry and/or executable programming code), in other implementations one or more components of the CODEC 1708, such as the decoder 300, the encoder 200, or a combination thereof, may be included in the processor 1706, the CODEC 1734, another processing component, or a combination thereof.

The device 1700 may include the transmitter 110 coupled to an antenna 1742. The device 1700 may include a display 1728 coupled to a display controller 1726. One or more speakers 1748 may be coupled to the CODEC 1734. One or more microphones 1746 may be coupled, via the input interfaces 112, to the CODEC 1734. In a particular implementation, the speakers 1748 may include the first loudspeaker 142, the second loudspeaker 144 of FIG. 1, or a combination thereof. In a particular implementation, the microphones 1746 may include the first microphone 146, the second microphone 148 of FIG. 1, or a combination thereof. The CODEC 1734 may include a digital-to-analog converter (DAC) 1702 and an analog-to-digital converter (ADC) 1704.

The memory 153 may include instructions 191 executable by the processor 1706, the processors 1710, the CODEC 1734, another processing unit of the device 1700, or a combination thereof, to perform one or more operations described with reference to FIGS. 1-16.

One or more components of the device 1700 may be implemented via dedicated hardware (e.g., circuitry), by a processor executing instructions to perform one or more tasks, or a combination thereof. As an example, the memory 153 or one or more components of the processor 1706, the processors 1710, and/or the CODEC 1734 may be a memory device, such as a random access memory (RAM), magnetoresistive random access memory (MRAM), spin-torque transfer MRAM (STT-MRAM), flash memory, read-only memory (ROM), programmable read-only memory (PROM), erasable programmable read-only memory (EPROM), electrically erasable programmable read-only memory (EEPROM), registers, hard disk, a removable disk, or a compact disc read-only memory (CD-ROM). The memory device may include instructions (e.g., the instructions 191) that, when executed by a computer (e.g., a processor in the CODEC 1734, the processor 1706, and/or the processors 1710), may cause the computer to perform one or more operations described with reference to FIGS. 1-16. As an example, the memory 153 or the one or more components of the processor 1706, the processors 1710, and/or the CODEC 1734 may be a non-transitory computer-readable medium that includes instructions (e.g., the instructions 191) that, when executed by a computer (e.g., a processor in the CODEC 1734, the processor 1706, and/or the processors 1710), cause the computer perform one or more operations described with reference to FIGS. 1-16.

In a particular implementation, the device 1700 may be included in a system-in-package or system-on-chip device 1722 (e.g., a mobile station modem (MSM)). In a particular implementation, the processor 1706, the processors 1710, the display controller 1726, the memory 153, the CODEC 1734, and the transmitter 110 are included in a system-in-package or the system-on-chip device 1722. In a particular implementation, an input device 1730, such as a touchscreen and/or keypad, and a power supply 1744 are coupled to the system-on-chip device 1722. Moreover, in a particular implementation, as illustrated in FIG. 17, the display 1728, the input device 1730, the speakers 1748, the microphones 1746, the antenna 1742, and the power supply 1744 are external to the system-on-chip device 1722. However, each of the display 1728, the input device 1730, the speakers 1748, the microphones 1746, the antenna 1742, and the power supply 1744 can be coupled to a component of the system-on-chip device 1722, such as an interface or a controller.

The device 1700 may include a wireless telephone, a mobile communication device, a mobile phone, a smart phone, a cellular phone, a laptop computer, a desktop computer, a computer, a tablet computer, a set top box, a personal digital assistant (PDA), a display device, a television, a gaming console, a music player, a radio, a video player, an entertainment unit, a communication device, a fixed location data unit, a personal media player, a digital video player, a digital video disc (DVD) player, a tuner, a camera, a navigation device, a decoder system, an encoder system, or any combination thereof.

Figure 18:
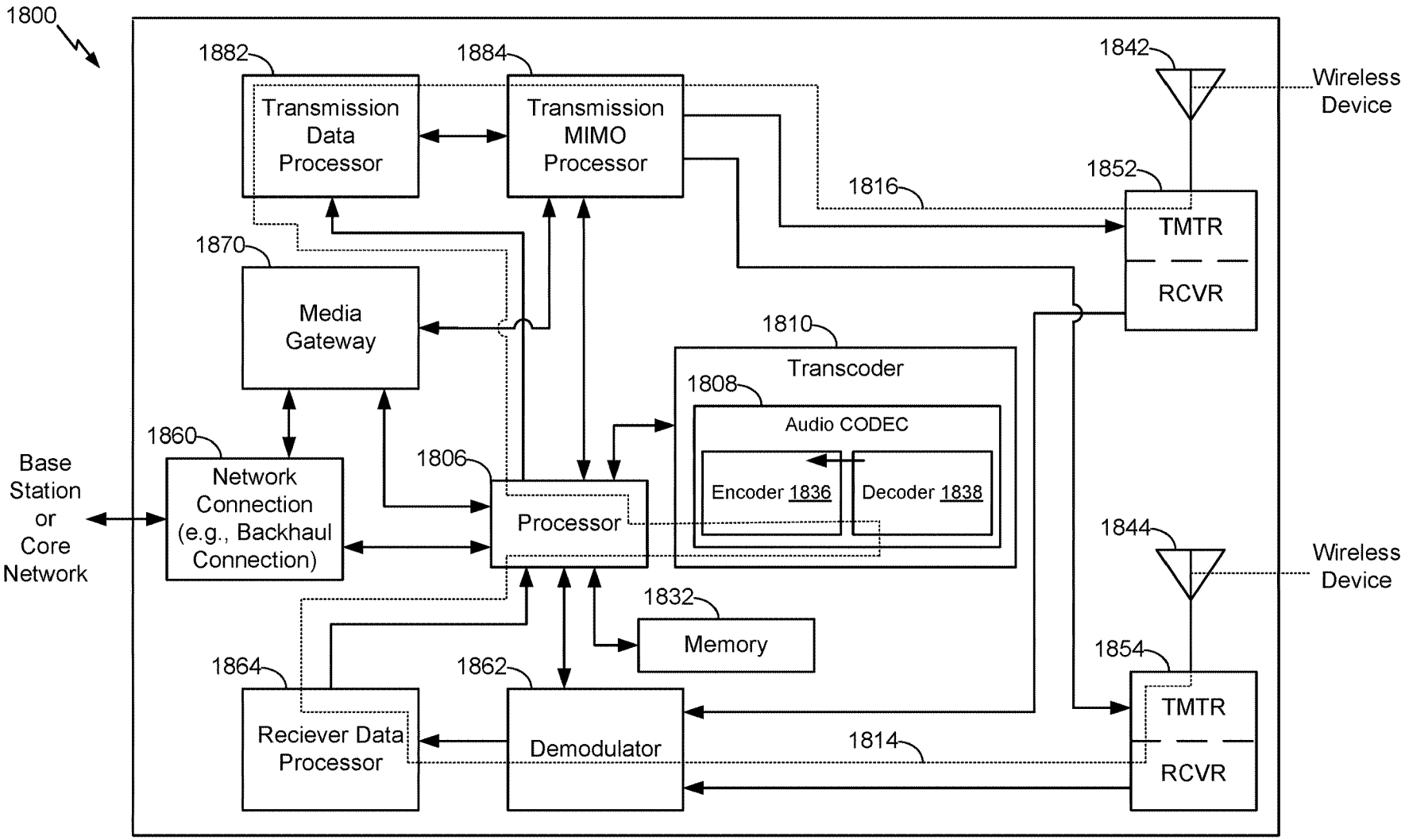
FIG. 18 is a block diagram of a base station that is operable to determine a flag value indicating a harmonic metric of a high band signal.

Referring to FIG. 18, a block diagram of a particular illustrative example of a base station 1800 is depicted. In various implementations, the base station 1800 may have more components or fewer components than illustrated in FIG. 18. In an illustrative example, the base station 1800 may include the first device 104 or the second device 106 of FIG. 1. In an illustrative example, the base station 1800 may operate according to one or more of the methods or systems described with reference to FIGS. 1-16.

The base station 1800 may be part of a wireless communication system. The wireless communication system may include multiple base stations and multiple wireless devices. The wireless communication system may be a Long Term Evolution (LTE) system, a Code Division Multiple Access (CDMA) system, a Global System for Mobile Communications (GSM) system, a wireless local area network (WLAN) system, or some other wireless system. A CDMA system may implement Wideband CDMA (WCDMA), CDMA 1X, Evolution-Data Optimized (EVDO), Time Division Synchronous CDMA (TD-SCDMA), or some other version of CDMA.

The wireless devices may also be referred to as user equipment (UE), a mobile station, a terminal, an access terminal, a subscriber unit, a station, etc. The wireless devices may include a cellular phone, a smartphone, a tablet, a wireless modem, a personal digital assistant (PDA), a handheld device, a laptop computer, a smartbook, a netbook, a tablet, a cordless phone, a wireless local loop (WLL) station, a Bluetooth device, etc. The wireless devices may include or correspond to the device 1700 of FIG. 17.

Various functions may be performed by one or more components of the base station 1800 (and/or in other components not shown), such as sending and receiving messages and data (e.g., audio data). In a particular example, the base station 1800 includes a processor 1806 (e.g., a CPU). The base station 1800 may include a transcoder 1810. The transcoder 1810 may include an audio CODEC 1808. For example, the transcoder 1810 may include one or more components (e.g., circuitry) configured to perform operations of the audio CODEC 1808. As another example, the transcoder 1810 may be configured to execute one or more computer-readable instructions to perform the operations of the audio CODEC 1808. Although the audio CODEC 1808 is illustrated as a component of the transcoder 1810, in other examples one or more components of the audio CODEC 1808 may be included in the processor 1806, another processing component, or a combination thereof. For example, a decoder 1838 (e.g., a vocoder decoder) may be included in a receiver data processor 1864. As another example, an encoder 1836 (e.g., a vocoder encoder) may be included in a transmission data processor 1882.

The transcoder 1810 may function to transcode messages and data between two or more networks. The transcoder 1810 may be configured to convert message and audio data from a first format (e.g., a digital format) to a second format. To illustrate, the decoder 1838 may decode encoded signals having a first format and the encoder 1836 may encode the decoded signals into encoded signals having a second format. Additionally, or alternatively, the transcoder 1810 may be configured to perform data rate adaptation. For example, the transcoder 1810 may down-convert a data rate or up-convert the data rate without changing a format the audio data. To illustrate, the transcoder 1810 may down-convert 64 kbit/s signals into 16 kbit/s signals.

The audio CODEC 1808 may include the encoder 1836 and the decoder 1838. The encoder 1836 may include the encoder 200 of FIG. 1. The decoder 1838 may include the decoder 300 of FIG. 1. The encoder 1836 may be configured to generate the non harmonic HB flag (x) 910. Additionally, in some implementations, the encoder 1836 is configured to modify the non harmonic HB flag (x) 910 to generate the modified non harmonic HB flag (y) 920. The encoder 1836 may be configure to use the non harmonic HB flag (x) 910, the modified non harmonic HB flag (y) 920, or both, as described herein with reference to at least FIGS. 1 and 9-16. The decoder 1838 may be configured to receive or generate a non harmonic HB flag (x) 910, a modified non harmonic HB flag(y) 920, or both. The decoder 1838 may be configure to use the non harmonic HB flag(x) 910, the modified non harmonic HB flag(y) 920, or both, as described herein with reference to at least FIGS. 1 and 9-16.

The base station 1800 may include a memory 1832. The memory 1832, such as a computer-readable storage device, may include instructions. The instructions may include one or more instructions that are executable by the processor 1806, the transcoder 1810, or a combination thereof, to perform one or more operations described with reference to the methods and systems of FIGS. 1-16. The base station 1800 may include multiple transmitters and receivers (e.g., transceivers), such as a first transceiver 1852 and a second transceiver 1854, coupled to an array of antennas. The array of antennas may include a first antenna 1842 and a second antenna 1844. The array of antennas may be configured to wirelessly communicate with one or more wireless devices, such as the device 1700 of FIG. 17. For example, the second antenna 1844 may receive a data stream 1814 (e.g., a bitstream) from a wireless device. The data stream 1814 may include messages, data (e.g., encoded speech data), or a combination thereof.

The base station 1800 may include a network connection 1860, such as backhaul connection. The network connection 1860 may be configured to communicate with a core network or one or more base stations of the wireless communication network. For example, the base station 1800 may receive a second data stream (e.g., messages or audio data) from a core network via the network connection 1860. The base station 1800 may process the second data stream to generate messages or audio data and provide the messages or the audio data to one or more wireless device via one or more antennas of the array of antennas or to another base station via the network connection 1860. In a particular implementation, the network connection 1860 may be a wide area network (WAN) connection, as an illustrative, non-limiting example. In some implementations, the core network may include or correspond to a Public Switched Telephone Network (PSTN), a packet backbone network, or both.

The base station 1800 may include a media gateway 1870 that is coupled to the network connection 1860 and the processor 1806. The media gateway 1870 may be configured to convert between media streams of different telecommunications technologies. For example, the media gateway 1870 may convert between different transmission protocols, different coding schemes, or both. To illustrate, the media gateway 1870 may convert from PCM signals to Real-Time Transport Protocol (RTP) signals, as an illustrative, non-limiting example. The media gateway 1870 may convert data between packet switched networks (e.g., a Voice Over Internet Protocol (VoIP) network, an IP Multimedia Subsystem (IMS), a fourth generation (4G) wireless network, such as LTE, WiMax, and UMB, etc.), circuit switched networks (e.g., a PSTN), and hybrid networks (e.g., a second generation (2G) wireless network, such as GSM, GPRS, and EDGE, a third generation (3G) wireless network, such as WCDMA, EV-DO, and HSPA, etc.).

Additionally, the media gateway 1870 may include a transcode and may be configured to transcode data when codecs are incompatible. For example, the media gateway 1870 may transcode between an Adaptive Multi-Rate (AMR) codec and a G.711 codec, as an illustrative, non-limiting example. The media gateway 1870 may include a router and a plurality of physical interfaces. In some implementations, the media gateway 1870 may also include a controller (not shown). In a particular implementation, the media gateway controller may be external to the media gateway 1870, external to the base station 1800, or both. The media gateway controller may control and coordinate operations of multiple media gateways. The media gateway 1870 may receive control signals from the media gateway controller and may function to bridge between different transmission technologies and may add service to end-user capabilities and connections.

The base station 1800 may include a demodulator 1862 that is coupled to the transceivers 1852, 1854, the receiver data processor 1864, and the processor 1806, and the receiver data processor 1864 may be coupled to the processor 1806. The demodulator 1862 may be configured to demodulate modulated signals received from the transceivers 1852, 1854 and to provide demodulated data to the receiver data processor 1864. The receiver data processor 1864 may be configured to extract a message or audio data from the demodulated data and send the message or the audio data to the processor 1806.

The base station 1800 may include a transmission data processor 1882 and a transmission multiple input-multiple output (MIMO) processor 1884. The transmission data processor 1882 may be coupled to the processor 1806 and the transmission MIMO processor 1884. The transmission MIMO processor 1884 may be coupled to the transceivers 1852, 1854 and the processor 1806. In some implementations, the transmission MIMO processor 1884 may be coupled to the media gateway 1870. The transmission data processor 1882 may be configured to receive the messages or the audio data from the processor 1806 and to code the messages or the audio data based on a coding scheme, such as CDMA or orthogonal frequency-division multiplexing (OFDM), as an illustrative, non-limiting examples. The transmission data processor 1882 may provide the coded data to the transmission MIMO processor 1884.

The coded data may be multiplexed with other data, such as pilot data, using CDMA or OFDM techniques to generate multiplexed data. The multiplexed data may then be modulated (i.e., symbol mapped) by the transmission data processor 1882 based on a particular modulation scheme (e.g., Binary phase-shift keying ("BPSK"), Quadrature phase-shift keying ("QSPK"), M-ary phase-shift keying ("M-PSK"), M-ary Quadrature amplitude modulation ("M-

QAM"), etc.) to generate modulation symbols. In a particular implementation, the coded data and other data may be modulated using different modulation schemes. The data rate, coding, and modulation for each data stream may be determined by instructions executed by processor 1806.

The transmission MIMO processor 1884 may be configured to receive the modulation symbols from the transmission data processor 1882 and may further process the modulation symbols and may perform beamforming on the data. For example, the transmission MIMO processor 1884 may apply beamforming weights to the modulation symbols. The beamforming weights may correspond to one or more antennas of the array of antennas from which the modulation symbols are transmitted.

During operation, the second antenna 1844 of the base station 1800 may receive a data stream 1814. The second transceiver 1854 may receive the data stream 1814 from the second antenna 1844 and may provide the data stream 1814 to the demodulator 1862. The demodulator 1862 may demodulate modulated signals of the data stream 1814 and provide demodulated data to the receiver data processor 1864. The receiver data processor 1864 may extract audio data from the demodulated data and provide the extracted audio data to the processor 1806.

The processor 1806 may provide the audio data to the transcoder 1810 for transcoding. The decoder 1838 of the transcoder 1810 may decode the audio data from a first format into decoded audio data and the encoder 1836 may encode the decoded audio data into a second format. In some implementations, the encoder 1836 may encode the audio data using a higher data rate (e.g., up-convert) or a lower data rate (e.g., down-convert) than received from the wireless device. In other implementations, the audio data may not be transcoded. Although transcoding (e.g., decoding and encoding) is illustrated as being performed by a transcoder 1810, the transcoding operations (e.g., decoding and encoding) may be performed by multiple components of the base station 1800. For example, decoding may be performed by the receiver data processor 1864 and encoding may be performed by the transmission data processor 1882. In other implementations, the processor 1806 may provide the audio data to the media gateway 1870 for conversion to another transmission protocol, coding scheme, or both. The media gateway 1870 may provide the converted data to another base station or core network via the network connection 1860.

Encoded audio data generated at the encoder 1836, such as transcoded data, may be provided to the transmission data processor 1882 or the network connection 1860 via the processor 1806. The transcoded audio data from the transcoder 1810 may be provided to the transmission data processor 1882 for coding according to a modulation scheme, such as OFDM, to generate the modulation symbols. The transmission data processor 1882 may provide the modulation symbols to the transmission MIMO processor 1884 for further processing and beamforming. The transmission MIMO processor 1884 may apply beamforming weights and may provide the modulation symbols to one or more antennas of the array of antennas, such as the first antenna 1842 via the first transceiver 1852. Thus, the base station 1800 may provide a transcoded data stream 1816, that corresponds to the data stream 1814 received from the wireless device, to another wireless device. The transcoded data stream 1816 may have a different encoding format, data rate, or both, than the data stream 1814. In other implementations, the transcoded data stream 1816 may be provided to the network connection 1860 for transmission to another base station or a core network.

In a particular implementation, one or more components of the systems and devices disclosed herein may be integrated into a decoding system or apparatus (e.g., an electronic device, a CODEC, or a processor therein), into an encoding system or apparatus, or both. In other implementations, one or more components of the systems and devices disclosed herein may be integrated into a wireless telephone, a tablet computer, a desktop computer, a laptop computer, a set top box, a music player, a video player, an entertainment unit, a television, a game console, a navigation device, a communication device, a personal digital assistant (PDA), a fixed location data unit, a personal media player, or another type of device.

In conjunction with the described techniques, a first apparatus includes means for receiving an audio signal. For example, the means for receiving may include the encoder 200 of FIG. 1, 2A, or 17, the filterbank 290 of FIG. 2A, the mid channel BWE encoder 206 of FIG. 2A or 2B, the ICBWE encoder 204 of FIG. 1 or 2A, the encoder 900 of FIG. 9, the CODEC 1708 of FIG. 17, the processor 1706 of FIG. 17, the instructions 191 executable by a processor, the CODEC 1808 or the encoder 1836 of FIG. 18, one or more other devices, circuits, or any combination thereof.

The first apparatus may also include means for generating a high band signal based on the received audio signal. For example, the means for generating the high band signal based on the received audio signal may include the encoder 200 of FIG. 1, 2A, or 17, the mid channel BWE encoder 206 of FIG. 2A or 2B, the ICBWE encoder 204 of FIG. 1 or 2A, the encoder 900 of FIG. 9, the CODEC 1708 of FIG. 17, the processor 1706 of FIG. 17, the instructions 191 executable by a processor, the CODEC 1808 or the encoder 1836 of FIG. 18, one or more other devices, circuits, or any combination thereof.

The first apparatus may also include means for determining a first flag value indicating a harmonic metric of the high band signal. For example, the means for determining the first flag value may include the encoder 200 of FIGS. 1, 2A, and 17, the mid channel BWE encoder 206 of FIG. 2A or 2B, the ICBWE encoder 204 of FIG. 1 or 2A, the encoder 900 of FIG. 9, the non harmonic high band detector 906 of FIG. 9, the non harmonic high band flag modifier 922 of FIG. 9, the CODEC 1708 of FIG. 17, the processor 1706 of FIG. 17, the instructions 191 executable by a processor, the CODEC 1808 or the encoder 1836 of FIG. 18, one or more other devices, circuits, or any combination thereof.

The first apparatus may also include means for transmitting an encoded version of the high band signal. For example, the means for transmitting may include the transmitter 110 of FIGS. 1 and 17, the first transceiver 1852 of FIG. 18, one or more other devices, circuits, or any combination thereof.

In conjunction with the described techniques, a second apparatus includes means for determining a gain frame parameter corresponding to a frame of a high-band signal. For example, the means for receiving may include the encoder 200 of FIG. 1, 2A, or 17, the filterbank 290 of FIG. 2A, the mid channel BWE encoder 206 of FIG. 2A or 2B, the ICBWE encoder 204 of FIG. 1 or 2A, the high-band gain frame estimator 263 of FIG. 2B or FIG. 9, the encoder 900 of FIG. 9, the CODEC 1708 of FIG. 17, the processor 1706 of FIG. 17, the instructions 191 executable by a processor, the CODEC 1808 or the encoder 1836 of FIG. 18, one or more other devices, circuits, or any combination thereof.

The second apparatus may also include means for comparing a gain frame parameter to a threshold. For example, the means for comparing a gain frame parameter to a threshold may include the encoder 200 of FIG. 1, 2A, or 17, the mid channel BWE encoder 206 of FIG. 2A or 2B, the ICBWE encoder 204 of FIG. 1 or 2A, the encoder 900 of FIG. 9, the non harmonic high band flag modifier 922 of FIG. 9, the CODEC 1708 of FIG. 17, the processor 1706 of FIG. 17, the instructions 191 executable by a processor, the CODEC 1808 or the encoder 1836 of FIG. 18, one or more other devices, circuits, or any combination thereof.

The second apparatus may also include means for modifying a flag in response to the gain frame parameter being greater than the threshold, the flag corresponding to the frame and indicating a harmonic metric of the high band signal. For example, the means for modifying the flag may include the encoder 200 of FIG. 1, 2A, or 17, the mid channel BWE encoder 206 of FIG. 2A or 2B, the ICBWE encoder 204 of FIG. 1 or 2A, the encoder 900 of FIG. 9, the non harmonic high band flag modifier 922 of FIG. 9, the CODEC 1708 of FIG. 17, the processor 1706 of FIG. 17, the instructions 191 executable by a processor, the CODEC 1808 or the encoder 1836 of FIG. 18, one or more other devices, circuits, or any combination thereof.

The second apparatus may also include means for transmitting an encoded version of the high band signal. For example, the means for transmitting may include the transmitter 110 of FIGS. 1 and 17, the first transceiver 1852 of FIG. 18, one or more other devices, circuits, or any combination thereof.

In conjunction with the described techniques, a third apparatus includes means for receiving at least a first audio signal and a second audio signal. For example, the means for receiving may include the encoder 200 of FIG. 1, 2A, or 17, the down-mixer 202, the filterbank 290 of FIG. 2A, the mid channel BWE encoder 206 of FIG. 2A or 2B, the ICBWE encoder 204 of FIG. 1 or 2A, the encoder 900 of FIG. 9, the CODEC 1708 of FIG. 17, the processor 1706 of FIG. 17, the instructions 191 executable by a processor, the CODEC 1808 or the encoder 1836 of FIG. 18, one or more other devices, circuits, or any combination thereof.

The third apparatus may also include means performing a downmix operation on the first audio signal and the second audio signal to generate a mid signal. For example, the means for performing the downmix operation may include the encoder 200 of FIG. 1, 2A, or 17, the down-mixer 202 of FIG. 2A, the mid channel BWE encoder 206 of FIG. 2A or 2B, the ICBWE encoder 204 of FIG. 1 or 2A, the encoder 900 of FIG. 9, the CODEC 1708 of FIG. 17, the processor 1706 of FIG. 17, the instructions 191 executable by a processor, the CODEC 1808 or the encoder 1836 of FIG. 18, one or more other devices, circuits, or any combination thereof.

The third apparatus may also include means for generating a low-band mid and a high-band mid signal based on the mid signal. For example, the means for generating the low-band mid signal and the high-band mid signal may include the encoder 200 of FIG. 1, 2A, or 17, the filterbank 290 of FIG. 2A, the mid channel BWE encoder 206 of FIG. 2A or 2B, the ICBWE encoder 204 of FIG. 1 or 2A, the encoder 900 of FIG. 9, the CODEC 1708 of FIG. 17, the processor 1706 of FIG. 17, the instructions 191 executable by a processor, the CODEC 1808 or the encoder 1836 of FIG. 18, one or more other devices, circuits, or any combination thereof.

The third apparatus may also include means for determining, based at least partially on a voicing value of the low band signal and a gain value corresponding to the high-band mid signal, a value of a multi-source flag associated with the high-band mid signal. For example, the means for determining the value of the multi-source flag may include the encoder 200 of FIGS. 1, 2A, and 17, the mid channel BWE encoder 206 of FIG. 2A or 2B, the ICBWE encoder 204 of FIG. 1 or 2A, the encoder 900 of FIG. 9, the non harmonic high band detector 906 of FIG. 9, the non harmonic high band flag modifier 922 of FIG. 9, the CODEC 1708 of FIG. 17, the processor 1706 of FIG. 17, the instructions 191 executable by a processor, the CODEC 1808 or the encoder 1836 of FIG. 18, one or more other devices, circuits, or any combination thereof.

The third apparatus may also include means for generating a high-band mid excitation signal based at least in part on the multi-source flag. For example, the means for generating the high-band mid excitation signal may include the encoder 200 of FIGS. 1, 2A, and 17, the mid channel BWE encoder 206 of FIG. 2A or 2B, the ICBWE encoder 204 of FIG. 1 or 2A, the encoder 900 of FIG. 9, high-band excitation generator 299 of FIG. 2B or FIG. 9, the multiplier 255, the multiplier 258, the summer 257, the CODEC 1708 of FIG. 17, the processor 1706 of FIG. 17, the instructions 191 executable by a processor, the CODEC 1808 or the encoder 1836 of FIG. 18, one or more other devices, circuits, or any combination thereof.

The third apparatus may also include means for generating a bitstream based at least in part on the high-band mid excitation signal. For example, the means for generating the bitstream may include the encoder 200 of FIGS. 1, 2A, and 17, the mid channel BWE encoder 206 of FIG. 2A or 2B, the ICBWE encoder 204 of FIG. 1 or 2A, the encoder 900 of FIG. 9, the CODEC 1708 of FIG. 17, the processor 1706 of FIG. 17, the instructions 191 executable by a processor, the CODEC 1808 or the encoder 1836 of FIG. 18, one or more other devices, circuits, or any combination thereof.

The third apparatus may also include means for transmitting the bitstream and the multi-source flag to a device. For example, the means for transmitting may include the transmitter 110 of FIGS. 1 and 17, the first transceiver 1852 of FIG. 18, one or more other devices, circuits, or any combination thereof.

In conjunction with the described techniques, a fourth apparatus includes means for receiving a bitstream corresponding to an encoded version of an audio signal. For example, the means for receiving may include the decoder 300 of FIG. 1, 3A, or 17, the mid channel BWE decoder 302 of FIG. 3A or 3B, the ICBWE decoder 306 of FIG. 3A or 6, the decoder 1000 of FIG. 10, the CODEC 1708 of FIG. 17, the processor 1706 of FIG. 17, the instructions 191 executable by a processor, the CODEC 1808 or the decoder 1838 of FIG. 18, one or more other devices, circuits, or any combination thereof.

The fourth apparatus may also include means for generating a high band excitation signal based on a low band excitation signal and further based on a first flag value indicating a harmonic metric of a high band signal, where the high band signal corresponds to a high band portion of the audio signal. For example, the means for generating the high band excitation signal may include the decoder 300 of FIG. 1, 3A, or 17, the mid channel BWE decoder 302 of FIG. 3A or 3B, the ICBWE decoder 306 of FIG. 3A or 6, the decoder 1000 of FIG. 10, the high-band excitation generator 362 of FIG. 3B or 10, the CODEC 1708 of FIG. 17, the processor 1706 of FIG. 17, the instructions 191 executable by a processor, the CODEC 1808 or the decoder 1838 of FIG. 18, one or more other devices, circuits, or any combination thereof.

It should be noted that various functions performed by the one or more components of the systems and devices disclosed herein are described as being performed by certain components. This division of components is for illustration only. In an alternate implementation, a function performed by a particular component may be divided amongst multiple components. Moreover, in an alternate implementation, two or more components may be integrated into a single component. Each component may be implemented using hardware (e.g., a field-programmable gate array (FPGA) device, an application-specific integrated circuit (ASIC), a DSP, a controller, etc.), software (e.g., instructions executable by a processor), or any combination thereof.

Those of skill would further appreciate that the various illustrative logical blocks, configurations, circuits, and algorithm steps described in connection with the implementations disclosed herein may be implemented as electronic hardware, computer software executed by a processing device such as a hardware processor, or combinations of both. Various illustrative components, blocks, configurations, circuits, and steps have been described above generally in terms of their functionality. Whether such functionality is implemented as hardware or executable software depends upon the particular application and design constraints imposed on the overall system. Skilled artisans may implement the described functionality in varying ways for each particular application, but such implementation decisions should not be interpreted as causing a departure from the scope of the present disclosure.

The steps of a method or algorithm described in connection with the implementations disclosed herein may be embodied directly in hardware, in software executed by a processor, or in a combination of the two. Software may reside in a memory device, such as random access memory (RAM), magnetoresistive random access memory (MRAM), spin-torque transfer MRAM (STT-MRAM), flash memory, read-only memory (ROM), programmable read-only memory (PROM), erasable programmable read-only memory (EPROM), electrically erasable programmable read-only memory (EEPROM), registers, hard disk, a removable disk, or a compact disc read-only memory (CD-ROM). An exemplary memory device is coupled to the processor such that the processor can read information from, and write information to, the memory device. In the alternative, the memory device may be integral to the processor. The processor and the storage medium may reside in an application-specific integrated circuit (ASIC). The ASIC may reside in a computing device or a user terminal. In the alternative, the processor and the storage medium may reside as discrete components in a computing device or a user terminal.

The previous description of the disclosed implementations is provided to enable a person skilled in the art to make or use the disclosed implementations. Various modifications to these implementations will be readily apparent to those skilled in the art, and the principles defined herein may be applied to other implementations without departing from the scope of the disclosure. Thus, the present disclosure is not intended to be limited to the implementations shown herein but is to be accorded the widest scope possible consistent with the principles and novel features as defined by the following claims.

What is claimed is:

1. A device comprising:

a multichannel encoder configured to:

receive at least a first audio signal and a second audio signal;

perform a downmix operation on the first audio signal and the second audio signal to generate a mid signal;

generate a low-band mid signal and a high-band mid signal based on the mid signal, the low-band mid signal corresponding to a low frequency portion of the mid signal and the high-band mid signal corresponding to a high frequency portion of the mid signal;

determine, based at least partially on a voicing value corresponding to the low-band mid signal and a gain value corresponding to the high-band mid signal, a value of a non harmonic high band flag associated with the high-band mid signal, wherein the non harmonic high band flag corresponds to whether the high-band mid signal is harmonic or non harmonic;

generate a first high band mixing gain and a second high band mixing gain based at least in part on the non harmonic high band flag; and generate a bitstream based at least in part on the first high band mixing gain and the second high band mixing gain.

2. The device of claim 1, wherein the multi-channel encoder is further configured to:

generate a non-linear harmonic excitation based on a low-band excitation signal, the low-band excitation signal based on the low-band mid signal;

generate modulated noise based on the non-linear harmonic excitation; and control, based on the non harmonic high band flag, mixing of the non-linear harmonic excitation and the modulated noise to generate a high-band mid excitation signal.

3. The device of claim 2, wherein the multi-channel encoder is further configured to generate the high-band mid signal by applying the first high band mixing gain to the non-linear harmonic excitation and applying the second high band mixing gain to the modulated noise prior to generating the high-band mid excitation signal.

4. The device of claim 1, wherein the multi-channel encoder is further configured to:

determine a gain frame parameter corresponding to a frame of the high-band mid signal;

compare the gain frame parameter to a threshold; and in response to the gain frame parameter being greater than the threshold, modify the value of the non harmonic high band flag.

5. The device of claim 4, wherein the multi-channel encoder is further configured to:

generate a synthesized version of the high-band mid signal based on the high-band mid excitation signal; and compare the frame of the high-band mid signal to a frame of the synthesized version of the high-band mid signal to generate the gain frame parameter.

6. The device of claim 4, wherein the first high band mixing gain and the second high mixing gain are modified based on the modified value of the non harmonic high band flag.

7. The device of claim 1, wherein the multi-channel encoder includes a stereo encoder that generates a non-reference high band excitation signal at least partially based on the non harmonic high band flag during an inter-channel band width extension (ICBWE) encoding operation.

8. The device of claim 1, wherein the multi-channel encoder is integrated into a mobile device or a base station.

9. The device of claim 1, wherein the first high band mixing gain and the second high mixing gain are also based on a gain in a previous frame.

10. The device of claim 1, wherein the first high band mixing gain and the second high mixing gain are also based on low band voice factors.

11. The device of claim 1, further comprising a transmitter configured to transmit a speech packet including the non harmonic high band flag to a second device.

12. The device of claim 1, wherein the high-band mid signal is non harmonic includes a determination of whether the non harmonic is strongly harmonic or weakly harmonic.

13. The device of claim 12, wherein the non harmonic high band flag has a value of 1 when the non harmonic is strongly harmonic, and the non harmonic high band flag has a value of 2 when the non harmonic is weakly harmonic.

14. The device of claim 13, wherein the value of the non harmonic high band flag is determined based on a support vector machine or a neural network.

15. A method comprising:

receiving at least a first audio signal and a second audio signal at a multi-channel encoder;

performing a downmix operation on the first audio signal and the second audio signal to generate a mid signal;

generating a low-band mid signal and a high-band mid signal based on the mid signal, the low-band mid signal corresponding to a low frequency portion of the mid signal and the high-band mid signal corresponding to a high frequency portion of the mid signal;

determining, based at least partially on a voicing value corresponding to the low-band mid signal and a gain value corresponding to the high-band mid signal, a value of a non harmonic high band flag associated with the high-band mid signal;

generating a first high band mixing gain and a second high band mixing gain based at least in part on the non harmonic high band flag, wherein the non harmonic high band flag corresponds to whether the high-band mid signal is harmonic or non harmonic; and generating a bitstream based at least in part on the first high band mixing gain and the second high band mixing gain.

16. The method of claim 15, further comprising:

generating a non-linear harmonic excitation based on a low-band excitation signal, the low-band excitation signal based on the low-band mid signal;

generating modulated noise based on the non-linear harmonic excitation; and controlling, based on the non harmonic high band flag, mixing of the non-linear harmonic excitation and the modulated noise to generate a high-band mid excitation signal.

17. The method of claim 16, wherein the multi-channel encoder is further configured to generate the high-band mid signal by applying the first high band mixing gain to the non-linear harmonic excitation and applying the second high band mixing gain to the modulated noise prior to generating the high-band mid excitation signal.

18. The method of claim 16, further comprising:

determining a gain frame parameter corresponding to a frame of the high-band mid signal;

comparing the gain frame parameter to a threshold; and in response to the gain frame parameter being greater than the threshold, modifying the value of the non harmonic high band flag.

19. The method of claim 18, wherein determining the gain frame parameter comprises:

generating a synthesized version of the high-band mid signal based on the high-band mid excitation signal; and comparing the frame of the high-band mid signal to a frame of the synthesized version of the high-band mid signal.

20. The method of claim 18, wherein the first high band mixing gain and the second high mixing gain are modified based on the modified value of the non harmonic high band flag.

21. The method of claim 15, wherein determining the value of the non harmonic high band flag, generating the high-band mid excitation signal, and generating the bitstream are performed at a mobile device or at a base station.

22. The method of claim 15, wherein the first high band mixing gain and the second high mixing gain are also based on a gain in a previous frame.

23. The method of claim 15, wherein the first high band mixing gain and the second high mixing gain are also based on low band voice factors.

24. The method of claim 15, further comprising transmitting a speech packet including the non harmonic high band flag to a second device.

25. The method of claim 15, wherein the high-band mid signal is non harmonic includes a determination of whether the non harmonic is strongly harmonic or weakly harmonic.

26. The method of claim 25, wherein the non harmonic high band flag has a value of 1 when the non harmonic is strongly harmonic, and the non harmonic high band flag has a value of 2 when the non harmonic is weakly harmonic.

27. The method of claim 26, wherein the value of the non harmonic high band flag is determined based on a support vector machine or a neural network.

* * * * *